US007156568B2

(12) United States Patent
Miyasaka

(10) Patent No.: US 7,156,568 B2
(45) Date of Patent: Jan. 2, 2007

(54) TAPE PRINTING APPARATUS, METHOD OF MANUFACTURING LABEL, PROGRAM, AND MEMORY MEDIUM

(75) Inventor: Noriaki Miyasaka, Okaya (JP)

(73) Assignee: Seiko Epson Corporation, Tokyo (JP)

( * ) Notice: Subject to any disclaimer, the term of this patent is extended or adjusted under 35 U.S.C. 154(b) by 10 days.

(21) Appl. No.: 10/755,870

(22) Filed: Jan. 12, 2004

(65) Prior Publication Data

US 2004/0211521 A1 Oct. 28, 2004

(30) Foreign Application Priority Data

Feb. 13, 2003 (JP) ..... 2003-034817
Feb. 13, 2003 (JP) ..... 2003-034818
Feb. 13, 2003 (JP) ..... 2003-034819
Feb. 13, 2003 (JP) ..... 2003-034820

(51) Int. Cl.
*B41J 11/70* (2006.01)
*B41J 29/32* (2006.01)

(52) U.S. Cl. ..... 400/621; 400/76

(58) Field of Classification Search ..... 400/621, 400/621.1, 621.2, 615.2
See application file for complete search history.

(56) References Cited

U.S. PATENT DOCUMENTS 3,921,781 A * 11/1975 Corte ..... 400/134.5
5,066,152 A * 11/1991 Kuzuya et al. ..... 400/621
5,531,530 A * 7/1996 Kuramoto et al. ..... 400/593
5,556,213 A * 9/1996 Kudo et al. ..... 400/621
5,676,478 A * 10/1997 Bowman et al. ..... 400/621
5,957,597 A * 9/1999 Kato ..... 400/621
5,971,639 A * 10/1999 Park ..... 400/621
5,975,779 A * 11/1999 Watanabe et al. ..... 400/615.2
6,302,605 B1 * 10/2001 Kanbe ..... 400/621
6,585,438 B1 * 7/2003 Hosokawa et al. ..... 400/621
6,705,784 B1 * 3/2004 Furuya et al. ..... 400/621
6,739,777 B1 * 5/2004 Kobayashi et al. ..... 400/621

FOREIGN PATENT DOCUMENTS

CN 1348867 5/2002
JP 2002-104716 4/2002

* cited by examiner

*Primary Examiner*—Daniel J. Colilla
(74) *Attorney, Agent, or Firm*—Hogan & Hartson LLP

(57) ABSTRACT

A tape made up of a base tape having a front printing surface and a rear adhesive surface, and a release tape covering the adhesive surface is mounted on a printing apparatus. A plurality of print images are printed on the printing surface in a manner arrayed in a longitudinal direction of the printing tape, and the printing tape is cut in the widthwise direction thereof. Connection cutting is performed such that at least a widthwise part of the release tape remains connected as a connection portion in a space between respective adjoining print images.

29 Claims, 42 Drawing Sheets

FIG. 27

| TAPE WIDTH | NOTCH LENGTH BY USER SETTING | CUTTER DRIVE RANGE | | CONNECTION WIDTH |
|---|---|---|---|---|
| | | | EACH SIDE OF CENTER CONNECTION | |
| 36mm | LARGE | 30mm | 15mm | SMALL |
| | ORDINARY | 24mm | 12mm | ORDINARY |
| | SMALL | 18mm | 9mm | LARGE |
| 24mm | LARGE | 20mm | 10mm | SMALL |
| | ORDINARY | 16mm | 8mm | ORDINARY |
| | SMALL | 12mm | 6mm | LARGE |
| 12mm | LARGE | 10mm | 5mm | SMALL |
| | ORDINARY | 8mm | 4mm | ORDINARY |
| | SMALL | 6mm | 3mm | LARGE |

〈NOTCH LENGTH〉
〈WIDE TAPE〉
〈NARROW TAPE〉
〈LARGE〉
〈ORDINARY〉
〈SMALL〉
ABC

TAPE PRINTING APPARATUS, METHOD OF MANUFACTURING LABEL, PROGRAM, AND MEMORY MEDIUM

BACKGROUND OF THE INVENTION

1. Field of the Invention

This invention relates to: a tape printing apparatus, for manufacturing labels containing therein plural sets of images sequentially printed on a printing tape; as well as a method of manufacturing a label; a program; and a memory medium.

2. Description of the Related Art

In case of manufacturing labels containing therein plural sets of images sequentially printed on a printing tape, in a conventional tape printing apparatus, the following method is employed. Namely, as shown in FIG. 40, after having printed each of the print images (or printed images) GZ1–GZ3, the obtained print is completely cut off into separate labels LZ1, LZ2, and LZ3 (full cutting or full-cutting as shown in FIG. 40A). Otherwise, only a base tape Tb (substrate tape) is cut off while leaving a release tape Ta (peel-off tape) which constitutes a tape T is left as it is (half cutting or half-cutting as shown in FIG. 40B).

In the above-described former full-cutting art, since each of the labels is separated for each of the labels right after printing, it is difficult to handle them (e.g., for storing, or the like). In the above-described latter half-cutting art, on the other hand, each of the labels can only be separated in a state of having no release tape attached thereto. It follows that the labels must be handled only as a complete set having attached thereto the release tape. It is therefore, inconvenient to handle the printed tape always accompanied with the release paper. It is therefore desired to manufacture a tape which is capable of being handled either as one set or individually (independently or separately).

SUMMARY OF THE INVENTION

According to a first aspect of this invention, there is provided a tape printing apparatus comprising: tape mounting means for mounting a printing tape made up of a base tape having a front printing surface and a rear adhesive surface, and a release tape covering the adhesive surface; printing means for printing a plurality of print images on the printing surface, said print images being arrayed in a longitudinal direction of the printing tape; cutting means for cutting the printing tape in a widthwise direction thereof; and control means for controlling the cutting means. The cutting means is capable of performing connection cutting in which at least a widthwise part of the release tape remains connected as a connection portion. The control means has connection-cutting control means for causing the cutting means to perform connection cutting in a space between each of the plurality of print images printed on the printing tape.

According to another aspect of this invention, there is provided a method of manufacturing a label comprising the steps of: mounting a printing tape made up of a base tape having a front printing surface and a rear adhesive surface, and a release tape covering the adhesive surface; printing a plurality of print images on the printing surface so as to be arrayed in a longitudinal direction of the printing tape; and cutting the printing tape in a widthwise direction thereof, wherein in the step of cutting, connection cutting is performed such that at least a widthwise part of the release tape remains connected as a connection portion.

According to the above-described tape printing apparatus and the method of manufacturing a label, the plurality of print images are printed in an array on the printing tape having the base tape and the release tape. Then, in a space between each set of the plurality of adjoining print images printed on the printing tape, there can be performed a cutting (connection cutting) in a state in which at least a part of the release tape, as seen in the widthwise direction thereof, remains connected (i.e., remains intact or uncut). In this case, the tape is connected at the connection portion right after the printing, and each of the print image portions, which form the respective labels, is not cut apart. Therefore, they are not in a state of separate pieces and are easy in keeping and managing. On the other hand, in case the print image portions are to be separated apart, they can be easily torn into pieces by hands, or the like, because they are connected together only at the connection portions. It is therefore not necessary to take the trouble of using a tool such as a pair of scissors in order to cut apart each of the labels. Each of the labels having printed thereon a plurality of print images continuously (or in series) can be manufactured in a manner easy to handle both as a lump (or in a set) and separately.

Preferably, the cutting means further comprises: half-cutting means for cutting only the base tape in the widthwise direction thereof; and full-cutting means for cutting both the base tape and the release tape in the widthwise direction thereof. The full-cutting means is capable of the connection cutting.

According to this arrangement, it is possible to perform cutting (half cutting) of only the base tape and cutting (full cutting) of both the base tape and the release tape, whereby connection cutting is possible by the full cutting. As a result, each of the space between respective adjoining sets of the print images can be subjected to connection cutting and also to half cutting. If half cutting between respective adjoining sets of the print images is combined, the base-tape side can be cut without leaving the connection portion. In this case, at the time of peeling as labels, the connection portion of the base tape need not be separated, resulting in easier and neat peeling of the labels.

Preferably, the tape printing apparatus further comprises cutting method selection means for selecting, as a cutting command out of a plurality of options, the cutting method under control by the cutting means.

According to this arrangement, since the cutting method can be selected as the cutting command out of a plurality of options, the user is free to select the cutting command to command the cutting method depending on how the user is thereafter going to use the tape having printed thereon the print images. Accordingly, there can be obtained a tape on which each of the print images are printed, in a state of being cut in a desired cutting method.

Preferably, the plurality of options of the cutting command include a half-cutting command for commanding the half-cutting, a connection-cutting command for commanding the connection, and a full-cutting command for commanding the full cutting so that the connection portion is not left behind. The options are selectable in a menu style.

According to this arrangement, since the plurality of options are selectable in a menu style out of the half-cutting command, the connection-cutting command, and the full-cutting command, the options can be easily selected. In addition, since the conventional half cutting and the full cutting (entire cutting) is also selectable, the apparatus is convertible with the conventional apparatus. As a result, the convenience of the user of the conventional apparatus is also secured.

Preferably, the tape printing apparatus further comprises connecting position selecting means for selecting a widthwise position of the connection portion out of a plurality of options.

According to this arrangement, the position of the connection portion in the widthwise direction is selectable. Therefore, there can be obtained a tape on which each of the print images is printed and which makes each label, in a state of being connected at an arbitrarily selected connecting position.

Preferably, the connecting position selecting means includes at least one of means for displaying in characters the options of the cutting positions and means for displaying an image, after cutting, of each of the options of the connecting positions.

According to this arrangement, each of the options of the connecting position such as a connection (i.e., connection at one widthwise end), an opposite end connection (i.e., connection at the opposite end), a center connection (i.e., connection at the center position), or the like, can be displayed in the form of characters. Otherwise, an image after cutting, or an external view of the tape after cutting, can be displayed in the form of an image. As a result, the connecting position can be easily selected in concrete.

Preferably, the cutting means is capable of performing normal-direction cutting in which the printing tape is cut from one end as a reference end as seen in the widthwise direction thereof to an opposite end thereof, and reverse-direction cutting in which the printing tape is cut in a reverse direction from the opposite end to the reference end.

According to this arrangement, since the printing tape can be cut in the normal direction from one reference end to the opposite end as well as in the reverse direction from the opposite end to the reference end, the cutting can be made by leaving a connection portion in an arbitrary position in the widthwise direction of the printing tape.

Preferably, the cutting means further comprises a drive motor (or driving motor) for driving the normal-direction cutting in one of the normal direction and the reverse direction, which are opposite to each other, and the reverse-direction cutting in the other of the normal direction and the reverse direction. The control means further comprises a rotation control means for controlling the rotation of the drive motor.

According to this arrangement, by controlling the drive motor such that normal-direction cutting is driven in one of the normal rotation and the reverse rotation which are opposite to each other in the direction of rotation and that the reverse-direction cutting is driven in the other of the normal rotation and the reverse rotation, the normal-direction cutting and the reverse-direction cutting can be controlled.

Preferably, the cutting means comprises: a cutter capable of performing slide cutting in both the normal direction and the reverse direction; cutter operating means capable of transferring the cutter among: a first state in which the cutter is away from a feeding passage of the printing tape by the printing means; a second state in which the cutter is located close to the feeding passage but is on a side of the reference end relative to the feeding passage; and a third state in which the cutter is close to the feeding passage but is on a side of the opposite end relative to the feeding passage. The normal-direction cutting is performed on a way of transfer from the second state to the third state, the reverse-direction cutting is performed on a way of transfer from the third state to the second state, and a state transfer is performed between the second state and the third state accompanying no cutting due to a state transfer through the first state.

According to this arrangement, the slide type of cutter can be transferred in its state among first, second and third states as described above so that the respective cutting and state transfer are performed. Therefore, in order to see which of the states the cutter is being transferred at present as well as the degree of the transfer, only the present state may be grasped, resulting in an easy cutting control.

Preferably, the tape printing apparatus further comprises connecting position selecting means for selecting the widthwise connecting position out of a plurality of options. The options include a reference-end connection for connection at the reference end, an opposite-end connection for connection at the opposite end, and a center connection for connection at a center. The control means comprises: opposite-end connection-cutting control means for causing the cutting means to perform, when the opposite-end connection is selected, the opposite-end connection cutting which executes the normal-direction cutting so that the connection portion becomes the opposite-end connection; reference-end connection-cutting control means for causing the cutting means to perform, when the reference-end connection is selected, the reference-end connection cutting which executes the reverse-direction cutting so that the connection portion becomes the reference-end connection; center connection-cutting control means for causing the cutting means to perform, when the center connection cutting is selected, both the normal-direction cutting and the reverse-direction cutting so that the connection portion becomes the center connection; and cutting control starting means for starting up one of the opposite-end connection-cutting control means, the reference-end connection-cutting control means, and the center connection-cutting control means depending on a result of selection of the connecting position so as to leave the connection portion.

According to this arrangement, the position of the connection portion can be selected from among the plurality of options including the reference-end connection, the opposite-end connection, and the center connection. Then, the cutting is performed depending on the result of selection of the connecting position such as: the normal-direction cutting (i.e., the opposite-end connection cutting) such that the connection portion becomes the opposite-end connection, thereby leaving the connection portion connected; the reverse-direction cutting (the reference-end connection cutting) so as to obtain the reference-end connection; and both the normal-direction cutting and the reverse-direction cutting (the center connection cutting) to attain the center connection cutting. In these cases, although the connecting position is difference from each other, they are all connected at the arbitrarily selected connection portions in a state right after the printing. They can therefore be easily handled in a lump. In addition, since they are connected at the connection portions, they can be easily torn off by hands, or the like, to manufacture labels with release tapes attached thereto.

According to another aspect of this invention, there is provided a tape printing apparatus comprising: tape mounting means for mounting a printing tape made up of a base tape having a front printing surface and a rear adhesive surface, and a release tape covering the adhesive surface; printing means for printing a plurality of print images on the printing surface, the print images being arrayed in a longitudinal direction of the printing tape while leaving a print-free portion which serves as a space between respective adjoining sets of the print images; cutting means for cutting the printing tape in a widthwise direction thereof; and control means for controlling said cutting means. The cutting means comprises: half-cutting means capable of performing widthwise half cutting in which only the base tape is cut; and full-cutting means capable of performing widthwise full cutting in which both the base tape and the release tape are cut and also capable of performing connection cutting in which a widthwise part thereof is left connected as a connection portion. The control means further comprises complex-cutting control means for causing the cutting means to perform complex (or composite) cutting which is made up of the connection cutting to substantially a center of the print-free portion and the half cutting to a neighborhood on both longitudinal sides of the connection cutting.

According to another aspect of this invention, there is provided a method of manufacturing a label, comprising the steps of: printing a plurality of print images on a printing tape made up of a base tape having a front printing surface and a rear adhesive surface, and a release tape covering the adhesive surface, the print images being arrayed in a longitudinal direction of the printing tape while leaving a print-free portion which serves as a space between respective adjoining sets of the print images; providing cutting means capable of performing connection cutting by full cutting in which both the base tape and the release tape are cut while leaving a widthwise part thereof connected as a connection portion, as well as of performing half cutting in which only the base tape is cut; and performing complex cutting made up of the connection cutting to substantially the center of the print-free portion and the half cutting to both longitudinal sides thereof.

According to the above-described tape printing apparatus and the method of manufacturing a label, a plurality of print images are printed on the printing tape which is made up of the base tape and the release tape, in a manner arraying the print images with a print-free portion (i.e., a portion having no printing) which serves as a space between each set of adjoining print images. Substantially the center of the print-free portions of the respective sets of the plurality of print images is subjected to full cutting (connection cutting) in which a widthwise part is left connected (or intact) as the connection portion, and the neighborhood of both longitudinal sides of the print-free portion (i.e., within the print-free portion, or on the border between each set of print images or on the inner side thereof) is subjected to half cutting, thereby performing complex cutting by the full cutting and the half cutting. In this case, since the tape is not separated apart at the connection portion in a state after being printed, they are not taken into separate pieces, resulting in an easy control or management as a lump. On the other hand, in case each of the print image portions is to be separated into independent pieces, it can be easily torn apart by hands because they are simply connected at the connection portion. There is thus no need of going to the trouble of using a pair of scissors, or the like. In addition, since there is left the space to the half cutting on both longitudinal sides of the connection portion, the label can be separated while leaving a release tape which covers the end portion of each label (i.e., without the lack of the release tape). Still furthermore, when the tape is to be adhered to an object of adhesion, only the label having a good aesthetic appearance due to neat cutting can be easily separated from the release tape. In this manner, each of the labels having sequentially printed on the tape a plurality of print images can be manufactured in a neat manner for easy handling either singly (i.e., one piece only) or in a lump.

Preferably, the tape printing apparatus further comprises cutting method selection means for selecting the cutting method in a menu style by the cutting means out of a plurality of options as a cutting command. The plurality of options include a half-cutting command for commanding the half-cutting, a complex-cutting command for commanding the complex cutting, and a full-cutting command for commanding the full cutting so that the connection portion is not left behind.

According to this arrangement, a cutting command can be selected out of a plurality of options. Therefore, depending on the circumstances as to how the tape having printed thereon the print images is thereafter put to use, the cutting command to give a cutting method can be arbitrarily selected. In this manner, the tape can be obtained in a state in which each of the print images is printed by a desired method. The plurality of options of cutting method include half-cutting command, complex-cutting command, and full-cutting command such that they can be selected in a menu style. Therefore, one of them is easily selectable as the cutting command. Further, since the half cutting and the full cutting which are conventionally available can also be selected, there can be secured compatibility with the conventional apparatuses, thereby securing the convenience of the user of the conventional apparatuses.

Preferably, the full-cutting means is capable of performing a normal-direction cutting in which the printing tape is cut from one end as a reference end as seen in the widthwise direction thereof to an opposite end thereof, and a reverse-direction cutting in which the printing tape is cut in a reverse direction from the opposite end to the reference end.

According to this arrangement, there can be performed the normal-direction cutting to cut the printing tape from one widthwise end (reference end) of the tape to the opposite end thereof, and the reverse-direction cutting to cut the tape in a reverse direction from the opposite end to the reference end. Therefore, the tape can be cut (connection cutting) at an arbitrary position in the widthwise direction of the tape.

Preferably, the full-cutting means further comprises a drive motor for driving the normal-direction cutting in one of the normal direction and the reverse direction, which are opposite to each other, and the reverse-direction cutting in the other of the normal direction and the reverse direction. The control means further comprises a rotation control means for controlling the rotation of said drive motor.

According to this arrangement, by controlling the drive motor which drives the normal-direction cutting in the normal direction or the reverse direction which are opposite to each other and which drives the reverse-direction cutting in the other of the normal direction and the reverse direction, the normal-direction cutting and the reverse-direction cutting of the cutting means can be controlled.

Preferably, the full-cutting means comprises: a cutter capable of performing slide cutting in both the normal direction and the reverse direction; cutter operating means capable of transferring the cutter among: a first state in which the cutter is away from a feeding passage of the printing tape by the printing means; a second state in which the cutter is located close to the feeding passage but is on a side of the reference end relative to the feeding passage; and a third state in which the cutter is close to the feeding passage but is on a side of the opposite end relative to the feeding passage. The control means causes the cutter to perform, through state transfer control by the cutter operating means, the normal-direction cutting on a way of direct transfer from the second state to the third state, the reverse-direction cutting is performed on a way of direct transfer from the third state to the second state, and a state transfer between the second state and the third state accompanying no cutting due to a state transfer through the first state.

According to this arrangement, the sliding type of cutter is transferred in state among the first state, the second state, and the third state to thereby perform normal-direction cutting on the way from the second state to the third state and the reverse-direction cutting on the way from the third state to the second state. Further, the state transfer between the second state and the third state accompanying no cutting can also be performed through the first state. Therefore, the cutting control can be easily performed only by grasping the present state, such as which of the state transfer the cutter is presently in, as well as its degree.

Preferably, the tape printing apparatus further comprises connecting position selecting means for selecting a widthwise connecting position of the connection portion out of a plurality of options. The options include a reference-end connection for connection at the reference end, an opposite-end connection for connection at the opposite end, and a center connection for connection at a center.

According to this arrangement, the widthwise position of the connection portion can be selected as the connecting position from the plurality of options inclusive of one end, the opposite end, and the center portion. Therefore, the tape having printed thereon each of the print images to form respective labels can be obtained in a state in which the labels are connected at the arbitrarily selected desired connecting position.

Preferably, the control means comprises: opposite-end connection-cutting control means for causing the cutting means to perform, when the opposite-end connection is selected, the opposite-end cutting which executes the normal-direction cutting so that the connection portion becomes the opposite-end connection; reference-end connection-cutting control means for causing the cutting means to perform, when the reference-end connection is selected, the reference-end connection cutting which executes the reverse-direction cutting so that the connection portion becomes the reference-end connection; center connection-cutting control means for causing the cutting means to perform, when the center connection cutting is selected, both the normal-direction cutting and the reverse-direction cutting so that the connection portion becomes the center connection; and cutting control starting means for starting up one of the opposite-end connection-cutting control means, the reference-end connection-cutting control means, and the center connection control means depending on a result of selection of the connecting position so as to leave the connection portion.

According to this arrangement, the widthwise position of the connection portion can be selected as the connecting position out of the plurality of options inclusive of the reference-end connection, the opposite-end connection, and the center connection. Then, there can be performed cutting to suit the result of selection of the connecting position such as the normal-direction cutting (opposite-end connection cutting) to make the connection portion to be the opposite-end connection, the opposite-direction (or reverse-direction) cutting (reference-end connection cutting)to attain the reference-end connection, and both the normal-direction cutting and the reverse direction cutting (center connection cutting) to attain the center connection. In these cases, although the connecting position is different from one another, the tape remains connected at the connection portion whose connecting position is arbitrarily selected, in a state right after printing. Therefore, the labels can be easily handled in a lump and, because they are connected together only at the connection portions, they can be easily separated by tearing off with hands. The labels can thus be manufactured for easy handling with the release tape even separately (individually).

According to still another aspect of this invention, there is provided a tape printing apparatus in which a plurality of print images arrayed in a longitudinal direction of a printing tape are printed on a front printing surface thereof, the printing tape being made up of a base tape having the front printing surface and a rear adhesive surface, and a release tape covering the adhesive tape, the printed printing tape being cut for each of the print images in a longitudinal direction thereof. The printing apparatus comprises: half-cutting means capable of performing widthwise half cutting in which only the base tape is cut; full-cutting means capable of performing widthwise full cutting in which both the base tape and the release tape are cut and also capable of performing connection full-cutting in which a widthwise part thereof is left connected as a connection portion; cutting method selecting means for selecting a cutting method out of a plurality of options inclusive of a complex cutting made up of the connection full-cutting to a border between respective adjoining sets of the plurality of print images and the half cutting to both longitudinal sides of the border, and a connection cutting which performs both the full cutting and the half cutting to the border; and control means for controlling the half-cutting means and the full-cutting means according to a selected cutting method.

According to this arrangement, the plurality of print images are printed in an array on the printing tape having the base tape and the release tape. The cutting method to cut the printing tape in the widthwise direction is selectable from the plurality of options inclusive of the connection cutting and the complex cutting. According to the selected cutting method, the printing tape is cut into each of the individual print images. When the complex cutting is selected, full cutting to form the connection portion (connection full-cutting) is performed to the border between the respective adjoining sets of the plurality of print images so that a part of the widthwise direction remains in a state of being connected, as well as half cutting is performed to each of the neighborhood on both sides thereof. When the connection cutting is selected, connection full-cutting is performed to the border between the respective adjoining sets of the plurality of print images to form the connection portion, as well as half cutting is performed. In these cases, since the printing tape is connected at the connection portion so as not to be separated apart, easy management and keeping as a lump are possible. On the other hand, when each of the print images is to be separated as an individual label, they are connected only at the connection portions, so that they can be easily separated with hands. There is thus no need of cutting them apart with a tool such as a pair of scissors, or the like. In addition, by half cutting, only the good-looking labels whose ends are neatly cut can be easily released from the release tape for subsequent attaching to a target object. Especially, in the case of complex cutting, at the time of separating, there is a space to the half cutting. Therefore, they can be separated while leaving the release tape (without lack of the release tape) which covers the end of each of the labels. As a result, by utilizing various cutting methods, each of the plurality of print images continuously printed on the printing tape can be manufactured in a manner easily handled and neatly. It may alternatively so arranged that, at the time of complex cutting, there may be performed, to the connection portion, half cutting which is similar in kind to the connection cutting.

Preferably, the plurality of print images are printed, when the complex cutting is selected, while leaving a print-free portion in a space inclusive of the border and both longitudinal sides of the border, and the complex cutting is performed on the print-free portion.

According to this arrangement, when the complex cutting is selected, printing is made while leaving a print-free portion at the border (the object of connection full-cutting) between the adjoining sets of each of the print images and in the neighborhood (the object of half cutting) on both sides thereof. Therefore, the print-free portion becomes an open space. Since the complex cutting is performed to the print-free portion, half cutting is performed along the border line on both longitudinal sides of each of the print images, whereby each of the labels of the respective print images can be made into a suitable size. In addition, since an adequate space can be secured between the connection full-cutting portion (connection portion) and the half-cutting portion, each of the labels can be separated without the possibility of lacking the release tape to cover the end portions of each of the labels even if they are roughly separated by tearing off with hands.

Preferably, the plurality of options include an option to command only the half cutting and an option to command the full cutting so as to leave no connection portion.

According to this arrangement, as the cutting method, there can be selected the conventional half cutting and the full cutting. Therefore, compatibility with the conventional apparatuses can also be secured, and the ease of use of a user with the conventional apparatus can also be secured.

Preferably, the full-cutting means comprises a slide cutter to perform the full cutting by a sliding movement in the widthwise direction, and cutter operating means to cause the slide cutter to perform the sliding movement. The half-cutting means comprises a slide half cutter to perform the half cutting by a sliding movement in the widthwise direction, and half-cutter operating means to cause the slide half cutter to perform the sliding movement. The slide half cutter has a construction identical with the slide cutter whose notch depth is made small, and the half-cutter operating means has a construction identical with the cutter operating means.

According to this arrangement, the full-cutting means having the slide cutter and the cutter operating means to cause the slide cutter to perform sliding movement has substantially the same construction, except for the cutting depth, as the half cutting means having the slide half cutter to perform the half cutting and the cutter operating means to cause the slide half cutter to perform the sliding movement. Therefore, the same control can be made to both, thereby simplifying the control.

Preferably, the tape printing apparatus further comprises connecting position selecting means for selecting a widthwise position of the connection portion out of a plurality of options.

According to this arrangement, the widthwise position of the connection portion can be selected out of the plural options. Therefore, there can be obtained a tape on which each of the print images to form each of the labels is printed in a state of being connected together at an arbitrarily selected connecting position.

According to still another aspect of this invention, there is provided a tape printing apparatus in which a plurality of print images arrayed in a longitudinal direction of a printing tape are printed on a front printing surface thereof, the printing tape being made up of a base tape having the front printing surface and a rear adhesive surface and a release tape covering the adhesive tape, the printed printing tape being cut for each of the print images in a longitudinal direction thereof. The printing apparatus comprises: tape width detecting means for detecting a width of the tape; cutting means for cutting the printing tape in a widthwise direction thereof; and control means for controlling the cutting means. The cutting means comprises full-cutting means capable of performing widthwise full cutting in which both the base tape and the release tape are cut and also capable of performing connection cutting in which a widthwise part thereof is left connected as a connection portion. The control means further comprises connection notch-cutting control means for controlling the full cutting means so as to perform connection notch-cutting on a border between respective adjoining sets of the plurality of print images.

According to this arrangement, a plurality of print images are printed in a longitudinal array on a printing tape having the base tape and the release tape. The border between the respective adjoining sets of the plurality of the printed print images is subjected to the full cutting in the widthwise direction of the printing tape such that a widthwise part thereof remains connected as the connection portion. This is done by notch-cutting (connection notch cutting) by a cutting length corresponding to the detected tape width. In this case, since the cutting length is the one depending on the tape width, an adequate connection width can be secured irrespective of the tape width. In a state right after printing, the tape remains connected by the connection portion of an adequate width, with the result that each of the print images to form each of the labels is not torn off. Therefore, the tape will not be broken into separate pieces and is easy in management and keeping in a lump. On the other hand, when each of the print image parts must be separated into an individual piece as a label, it can be easily separated by tearing off with hands, or the like, because it is connected only at the connection portion. It follows that a tool such as a pair of scissors is not required in separating operation. Each of the labels having continuously printed print images can be manufactured for easy handling as a lump or individually depending on the tape width.

Preferably, the cutting means further comprises half-cutting means capable of performing widthwise half cutting in which only the base tape is cut.

According to this arrangement, cutting of only the base tape (half cutting) is possible. Therefore, various cutting methods are made available by the combination of cutting of both the base tape and the release tape (full cutting), connection notch-cutting, or the like.

Preferably, the control means controls the half-cutting means to perform the half cutting to the connection portion.

According to this arrangement, the connection portion left uncut in the connection notch-cutting is subjected to half cutting, and the base tape is cut without leaving the connection portion. Therefore, when the tape is released as a label, the connection portion of the base tape need not be separated, with the result that the label can be easily released in a good-looking manner.

Preferably, a plurality of options in relative notch depths showing a ratio between a total width and the notch depth, in the widthwise direction of the tape, and an absolute notch depth corresponding to a combination of each of the options and each of detectable tape widths, are defined in advance. The control means comprises: relative notch depth selection means for selecting one of the options in the relative notch depths; and notch depth setting means for setting, corresponding to the detected tape width and the selected relative notch depth, a corresponding absolute notch length as a notch length in the connection notch cutting.

According to this arrangement, there are defined in advance a plurality of options in relative notch depths showing a ratio between a total width and the notch depth, and an absolute notch depth corresponding to a combination of each of the options and each of detectable tape widths so that a relative notch depth can be selected out of the options. Therefore, irrespective of whether the tape width is large or small, an adequate connection width can be secured and, further, the notch depth can be arbitrarily selected within the adequate range of the connection width with due reflection of the ease with which the user can separate the labels. Each of the print images can thus be obtained in a state of being connected to each other with a desired connection width.

Preferably, the relative notch length selection means comprises at least one of: means for displaying in characters the options of the relative cutting depths; and means for displaying an image, after cutting, of each of the options of the relative notch depths.

According to this arrangement, each of the options of the relative notch depths such as "long (or large)," "normal (or ordinary)," and "short (or small)" can be displayed in the form of characters (e.g., display of characters "long"), or an image after cutting can be displayed in the form of image. Therefore, the notch depth can be concretely and easily selected.

Preferably, the full-cutting means comprises: a slide cutter capable of normal-direction cutting in which cutting is made in a direction from a reference end which is one widthwise end of the printing tape to an opposite end thereof, and of reverse-direction cutting in which cutting is made in a reverse direction from the opposite end to the reference end; and cutter operating means capable of slidably moving the slide cutter in the normal and reverse directions.

According to this arrangement, there can be performed the normal-direction cutting from the reference end to the opposite end and the reverse-direction cutting from the opposite end to the reference end. Therefore, cutting (connection cutting) can be performed while leaving a connection portion in an arbitrary widthwise position of the printing tape.

Preferably, the tape printing apparatus further comprises connecting position selecting means for selecting a widthwise position of the connection portion out of a plurality of options, and the options include a reference-end connection for connection at the reference end, an opposite-end connection for connection at the opposite end, and a center connection for connection at a center.

According to this arrangement, the widthwise position of the connection portion can be selected as the connecting position out of the plurality of options. Since the options of the connecting position include one widthwise end, the opposite widthwise end, and the center portion, there can be obtained a tape on which each of the print images to form each of the labels is printed in a state in which they are connected together at an arbitrarily selected connecting position.

Preferably, the connecting position selecting means includes at least one of means for displaying in characters the options of the cutting positions and means for displaying an image, after cutting, of each of the options of the connecting positions.

According to this arrangement, each of the options of the connecting position such as reference-end (one widthwise end) connection, opposite-end connection, and center position can be displayed in the form of characters, or in the form of an image after cutting. Therefore, the connecting position can be easily and concretely selected.

According to another aspect of this invention, there is provided a program which causes to perform each of the means in the above-described tape printing apparatus.

According to still another aspect of this invention, there is provided a program which is capable of performing the above-described label manufacturing method.

According to still another aspect of this invention, there is provided a memory medium which stores the above-described program in a manner readable by the tape printing apparatus which is capable of processing program.

According to the above-described arrangement, by carrying out the program stored in the memory medium, labels having printed thereon the respective print images can be prepared in a manner easily handled b6th in a lump and individually.

BRIEF DESCRIPTION OF THE DRAWINGS

The above and other objects and the attendant features of this invention will become readily apparent by reference to the following detailed description when considered in conjunction with the accompanying drawings wherein:

FIG. 27 is a table showing an example of setting of cutter drive range;

DETAILED DESCRIPTION OF THE PREFERRED EMBODIMENTS

Description will now be made about the preferred embodiments of the tape printing apparatus relating to this invention with reference to the accompanied drawings.

Figure 1A:
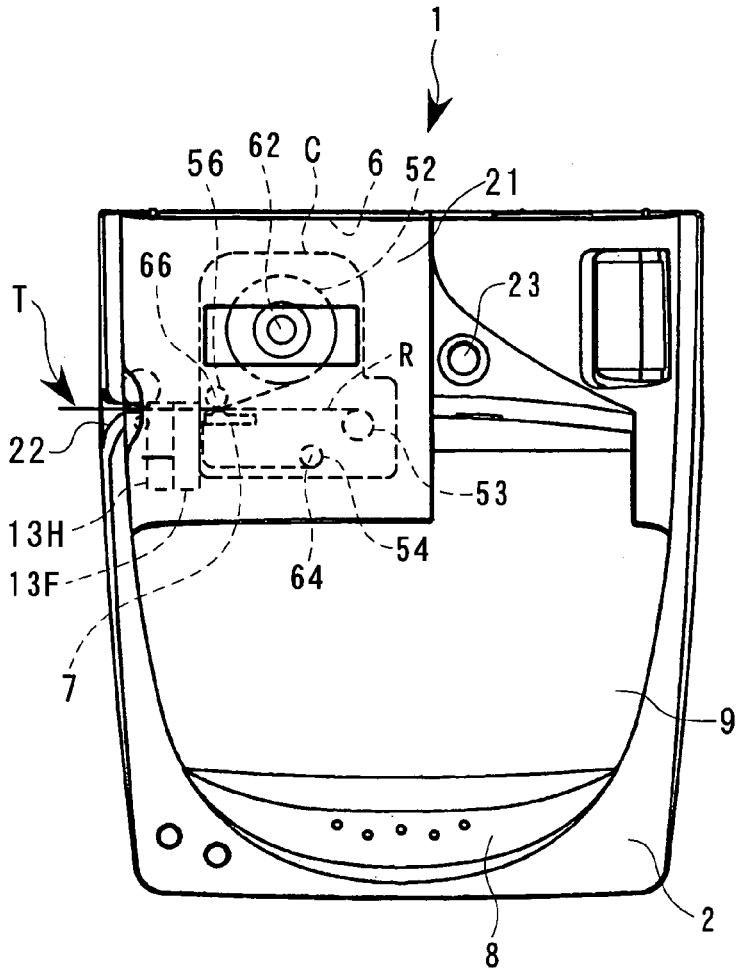
FIG. 1A is an external plan view of a tape printing apparatus and FIG. 1B is a perspective view of a tape cartridge according to one embodiment of this invention.
Figure 2:
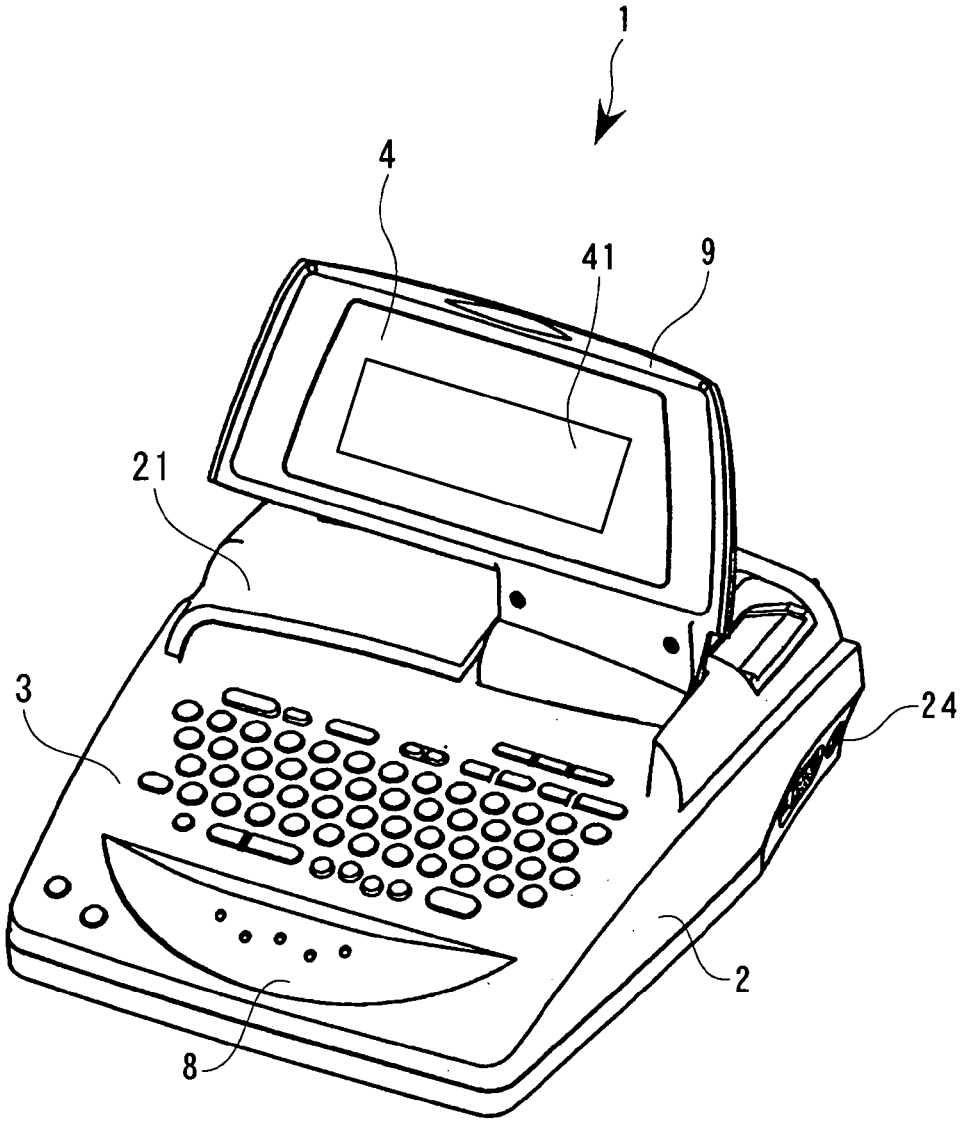
FIG. 2 is an external perspective view thereof in a state in which a cover is lifted open.

As shown in FIGS. 1A and 2, the tape printing apparatus 1 is made up of: an apparatus casing (apparatus main body) 2 which serves as a side enclosure; an open-close lid 21 which is disposed on the left side of a rear upper surface of the apparatus casing 2 and which can be opened and closed; and a push button 23 which is disposed on the right of the open-close lid 21, for opening and closing the open-close lid 21. In the front center part of the apparatus casing 2, there is disposed, in a swelled manner, a crescent part 8 having arranged therein exposed lamps. At the rear of the crescent 8 is disposed a key board 3 which is made up of various keys. On top of the key board 3 is mounted a cover main body 9 of a size large enough to cover the key board 3 in a manner to be freely opened and closed, the cover main body 9 being positioned in an intermediate position in the back and forth direction. On an inner side of the cover main body 9 is assembled a display 4.

The cover main body 9 is to protect the key board 3 in its closed state, and is left open in its opened state into a posture inclined upward and rearward about a hinge at a rear right portion of the cover main body 9 so as to expose the key board 3 this side the cover main body 9. The display 4 is arranged in its front in the opened state of the cover main body 9 so that the input work becomes ready. On an inside of the display 4, there is disposed a rectangular display screen 41 for displaying thereon the results of input from the key board 3, or the like.

Figure 3:
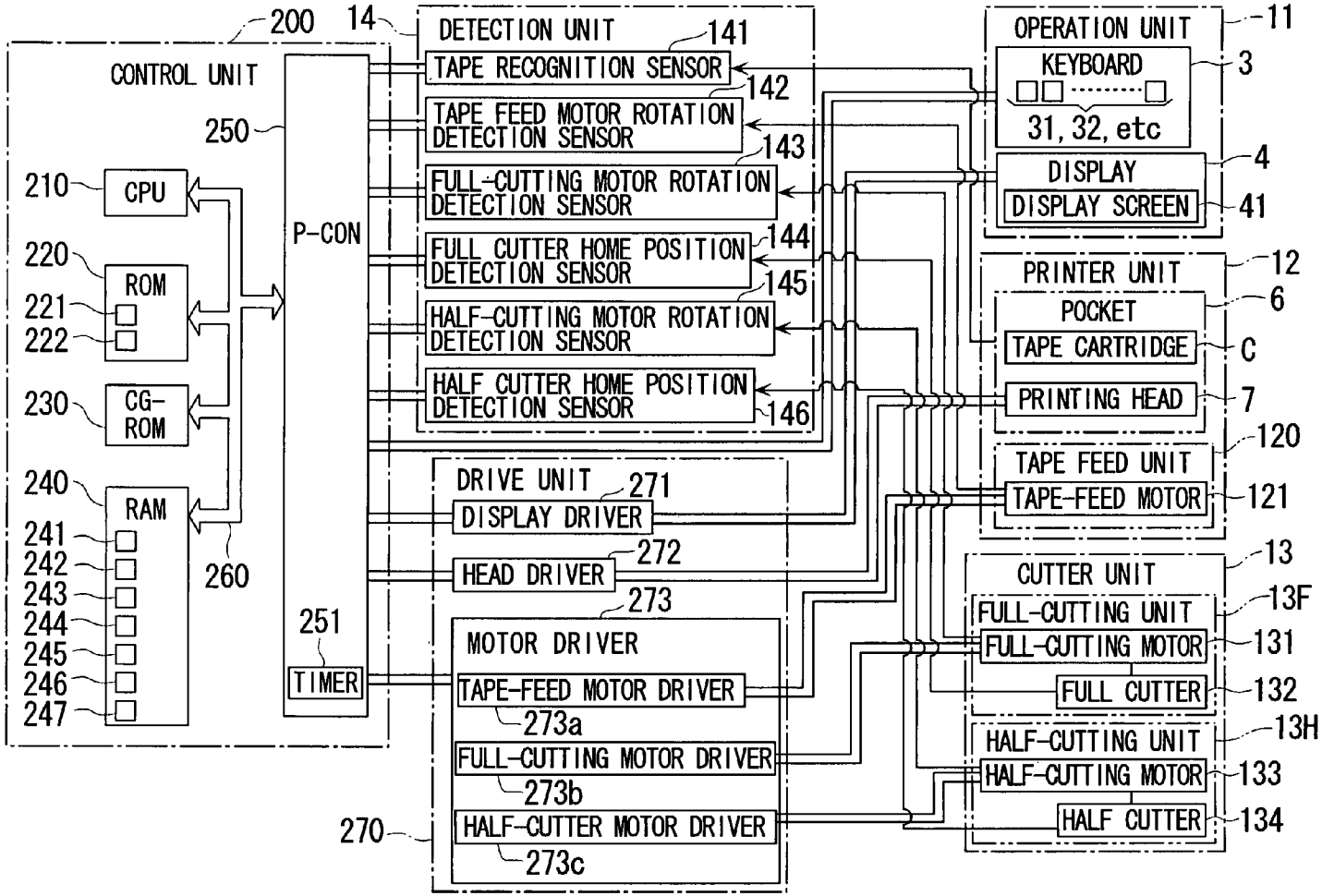
FIG. 3 is a block diagram of a control system of the tape printing apparatus.
Figure 4A:
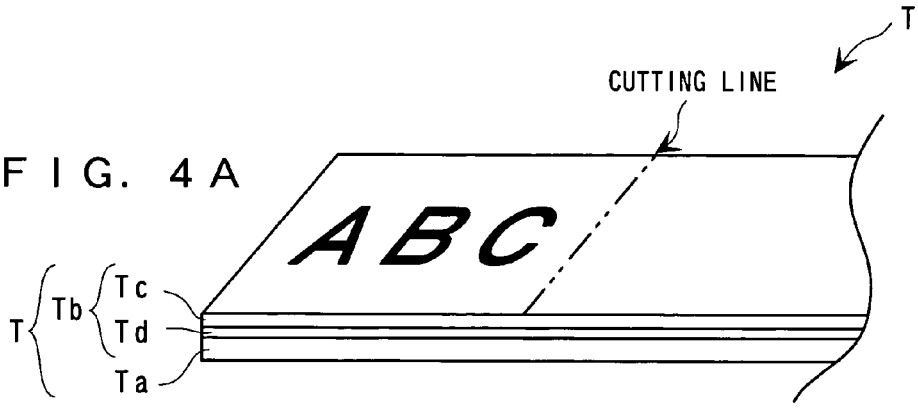
FIGS. 4A–4D are explanatory views showing one example of a result of printing as well as of cutting.
Figure 4B:
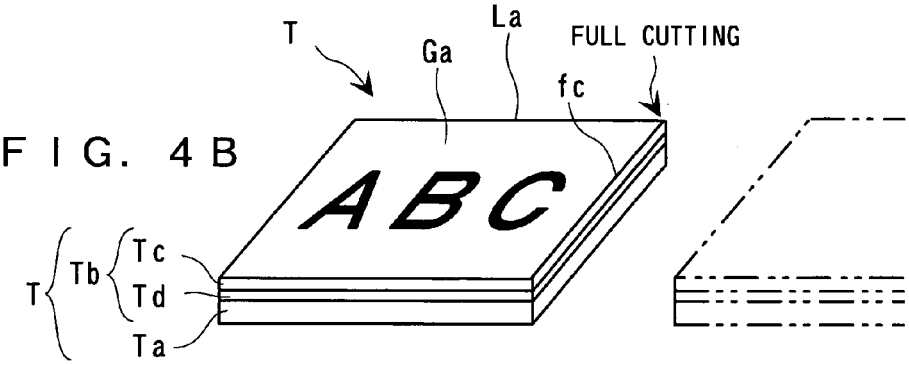
Figure 4C:
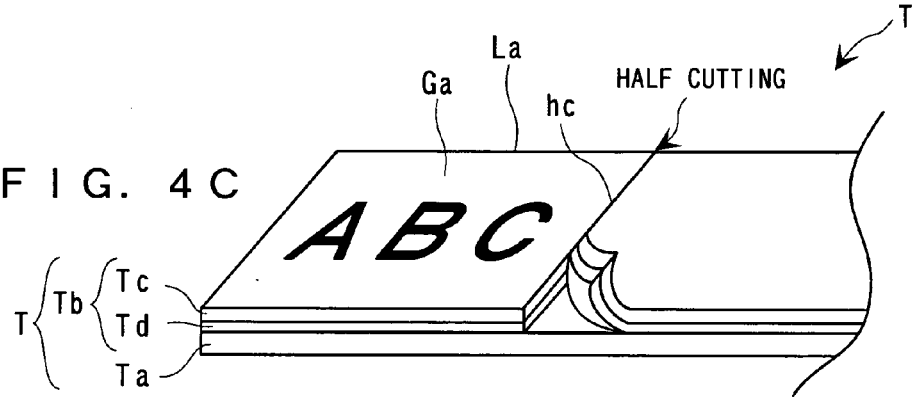
Figure 4D:
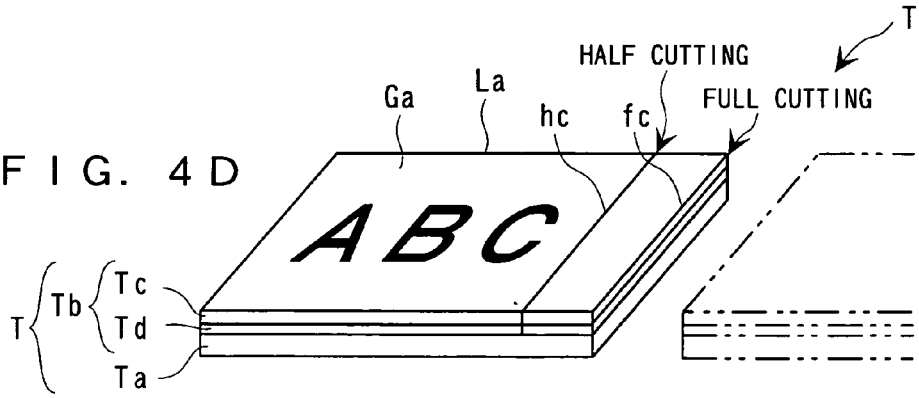

As shown in FIG. 3, the tape printing apparatus 1 is made up of basic constituent elements such as: an operation unit (or operating part) 11 having the key board 3 and the display 4 for executing the function of an interface with a user; a printer unit 12 having a printing head (thermal head) 7 and a tape feed unit 120 for executing printing on a printing tape T (heareinafter also simply referred to as a tape) which is mounted inside a pocket (cartridge mounting part, tape mounting part); a cutter unit 13 for executing various cutting of the tape T after printing; a detection unit 14 for executing various detection with various sensors; a drive unit (or driving unit) 70 for driving various circuits with various drivers; and a control unit 200 for executing control of various units inside the tape printing apparatus 1.

For this purpose, the apparatus casing 2 contains therein a circuit board (not illustrated), aside from the printer unit 12, the cutter unit 13, the detection unit 14, or the like. This circuit board has mounted thereon the driver unit 270, the control unit 200, or the like, aside from a power source unit, and is connected to an AC adapter connector 24 or to a battery (not illustrated) which is a detachably mounted NiCad battery, or the like.

As shown in FIGS. 4A–4D, the tape T is made up of a release tape (or a peel-off tape) Ta, and a base tape (or a substrate tape) Tb which are laminated together. The base tape Tb is made up of an image-receiving layer Tc which constitutes a surface on which printing is made (printing surface), and a rear surface thereof (an adhesive layer) Td which is formed on the rear surface of the image-receiving layer Tc. A printed tape T (label element, print image, Ga; or label region La) exposes the adhesive layer Td as a result of releasing or separating the release tape Ta from the base tape Tb, thereby being adhered, through this adhesive layer Td, to an object or target of adhesion.

As shown in FIGS. 1A and 3, the printer unit 12 is provided with a pocket 6 on an inner side of the open-close lid 21. A tape cartridge C is detachably mounted in the pocket 6 in a state in which the open-close lid 21 is left open. On the left side of the apparatus casing 2, there is formed a tape exit 22 which is in communication with an outside of the apparatus and which is used for discharging the printed portion of the tape T.

Figure 1B:
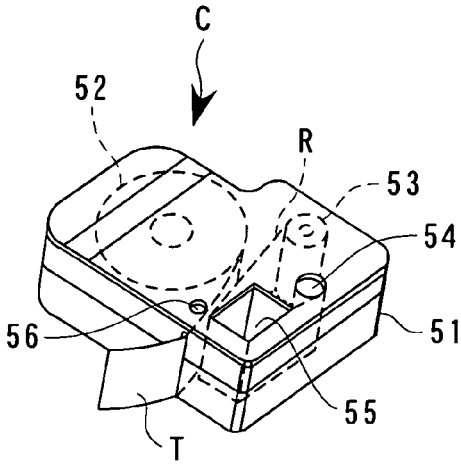

As shown in FIG. 1B, the tape cartridge C is formed of a cartridge casing 51 which constitutes an outer shell. The tape cartridge C contains therein the tape T of a certain width (about 4.5 mm–48 mm) and an ink ribbon R, and has formed therein a through opening 55 to which the printing head 7 faces. The tape T is rolled about a tape reel 52 with the release tape Ta lying on the inside in a manner capable of being reeled out or delivered. The ink ribbon R is rolled about a ribbon delivery reel 53 and a ribbon take-up reel 54. Plural kinds of tape cartridges C are available depending on the tapes T to be contained therein.

In a portion in which the tape T and the ink ribbon R overlap each other, there is housed a platen roller (platen) 56 to correspond to the printing head 7. In a state in which the tape cartridge C is mounted, the printing head 7 comes into abutment with that rear surface of the ink ribbon R which is exposed to the through opening 55, thereby printing desired character, or the like, onto the surface of the tape T by thermal driving.

The tape cartridge C has on its rear surface a plurality of small detection holes (not illustrated) so that the kind of the tapes T of different widths, or the like, can be detected. To correspond to these detection holes, a tape recognition sensor 141 such as a micro-switch, or the like, is provided for detection of each of the detection holes. It is thus possible to detect the presence or absence of the tape T itself (strictly speaking, as to whether the tape cartridge C is mounted or not), and to detect the kind of the tape T (strictly speaking, the kind of the tape cartridge C). In place of the plurality of detection holes, a label having a bit pattern may be attached to the tape cartridge C to represent the kind of the tape T for detection thereof by means of optical detection, or the like.

The pocket 6 is provided, in an uprising manner, with: a platen drive shaft 66 which engages with the platen 56 for rotation thereof with an electric motor made up of a DC motor serving as a drive source; a take-up drive shaft 64 which is engaged with the platen 56 for rotation thereof; and a positioning pin 62.

The tape feed unit 120 is disposed in a space between the side portion and the lower portion of the pocket 6 and rotates the platen drive shaft 66 and the take-up shaft 64 by means of the tape-feed motor 121 disposed in a side portion of the pocket 6 serving as the power source (drive source). The tape feed unit 120 is made up of: the tape-feed motor 121; the platen drive shaft 66; the take-up drive shaft 64; a reduction gear train (not illustrated) which transmits the power of the tape-feed motor 121 to each of the drive shafts; and an encoder (not illustrated) which detects the rotational frequency (rotational speed) of the tape-feed motor 121. The encoder is adhered to a coaxial extension of a worm which is fixed to a main shaft of the tape-feed motor 121, and has detection holes which are formed in a plurality of portions in a disk-like periphery.

Figure 9:
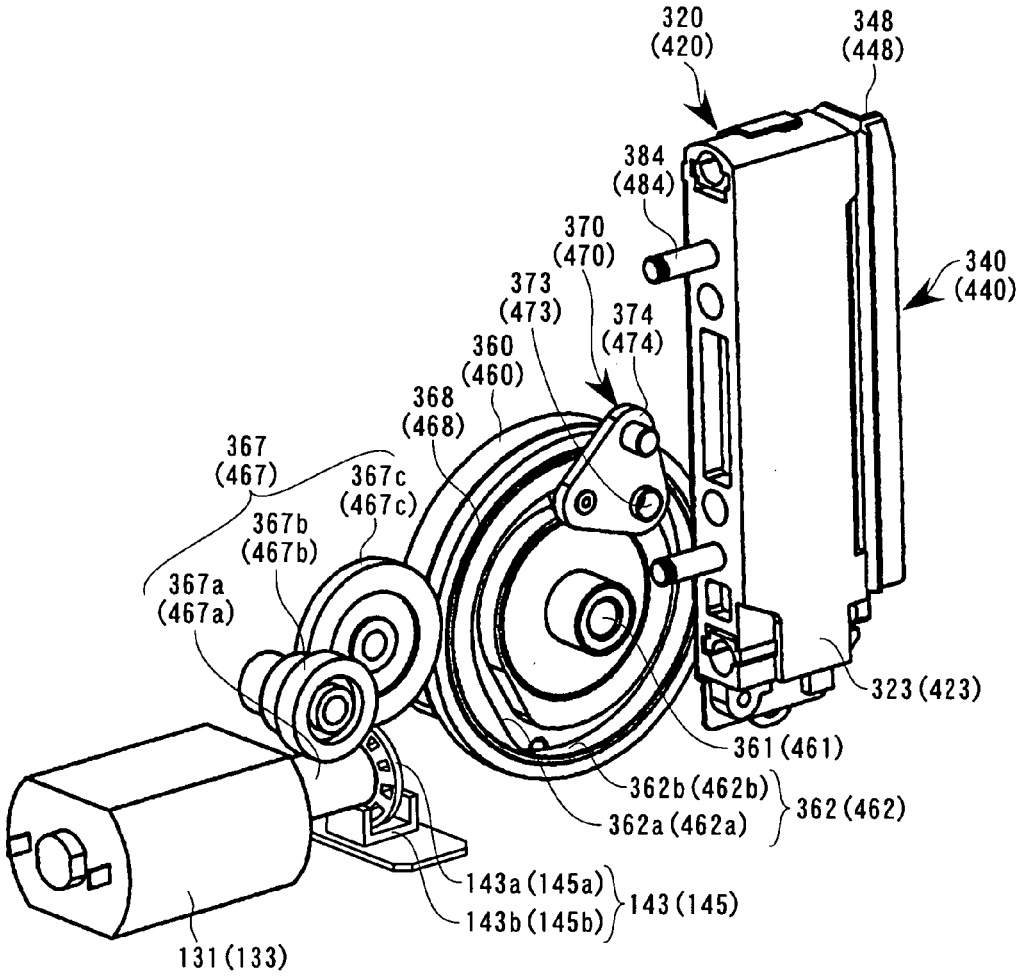
FIG. 9 is an explanatory view of the cutter operating mechanism, particularly of a drive mechanism (or driving mechanism)

A sensor 142, in the detection unit 14, for detecting the rotation of the tape-feed motor 121 (which is similar to the sensor 143 for detecting the rotation of a full-cutting motor, or a full cutter motor, to be described hereinafter with reference to FIG. 9) is provided with a photo-sensor (not illustrated) in which a light-emitting element and a light-receiving element are disposed to lie opposite to each other. The light from the light-emitting element passes through the rotating detection holes and is received by the light-receiving element. The blinking of the received light is opto-electronically converted for being outputted to the control unit 200 as a pulse signal. The rotational frequency is detected by the number of pulses.

In case a user or operator uses the tape printing apparatus 1, the open-close lid 21 is opened by pushing the push button 23. Once the tape cartridge C is mounted in the pocket 6, the platen drive shaft 66 and the take-up drive shaft 64 are engaged with the platen 56 and the ribbon take-up reel 54, respectively. The tape T and the ink ribbon R are inserted into the space between the platen 56 and the printing head 7. When the open-close lid 21 is closed, the printing head 7 having thermal elements arranged in the widthwise direction of the tape is pivoted in a manner to pinch the tape T and the ink ribbon R to urge the platen 56, thereby attaining a state of ready for printing.

By opening the cover main body 9 in the above-described state, the key board 3 is left open. By operating the key board 3 while looking at the display 4 which is located at the front, the print information such as desired characters, or the like, is inputted and compiled, and a command is given to execute printing. As a result of these operations, the printing processing (printing step) is started. The tape T and the ink ribbon R to be discharged or fed by the drive of the tape-feed motor 121 run parallel with each other at the printing head 7 portion. The printing head 7 is simultaneously driven for heating, and the ink on the ink ribbon R is thermally transferred to the tape T, whereby printing is executed.

The ink ribbon R after printing is taken up by the ribbon take-up reel 54, and the printed tape T is fed toward the tape exit 22 along the feed passage. After the printing has been finished, the printed tape T is stopped after being fed by a predetermined length and is subjected to various cutting by the cutting unit 13 depending on various settings as explained hereinafter (see FIGS. 4A–4B, 14A–14D, 15A–15D).

The cutting unit 13 is provided, in a portion between the pocket 6 and the tape exit 22, with: a full-cutting unit (full-cutting means) 13F on an upstream side of the feed passage; and a half-cutting unit (half-cutting means) 13H on a downstream side. The full-cutting unit 13F is to cut (full-cut or completely cut) both the base tape Tb and the release tape Ta of the tape T, for example, to cut off the label region La which is the printed portion off from the tape T (see FIG. 4B). The half-cutting unit 13H is, on the other hand, to cut only the base tape Tb (half-cut or partially cut) so as to leave the tape T connected through the release tape Ta (see FIG. 4C).

The full-cutting unit (full-cutting means) 13F is made up of: a full cutter 132; and a cutter operating mechanism 300 (see FIG. 10) which operates the full cutter 132 as a drive source of the full-cutting motor 131 which is made of a DC motor. The half-cutting unit (half-cutting means) 13H is provided with a cutter operating mechanism 400 to operate the half cutter 134 with a half-cutting motor, or a half-cutter motor, 133 similarly made of a DC motor serving as the drive source.

Figure 5A:
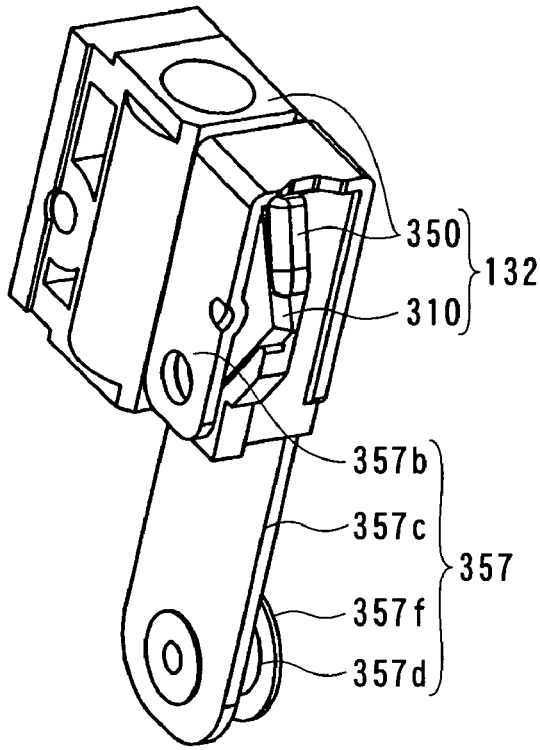
FIGS. 5A and 5B are explanatory perspective views showing a full cutter and a half cutter, respectively, with a carriage.

As shown in FIG. 5A, the full cutter 132 is made up of: a cutter blade 310 which has a two-edged angular blade capable of cutting in both upward and downward directions; and a cutter holder 350. The amount of projection of the cutter blade 310 beyond the cutter holder 350 is adjusted so as to secure an amount of projection sufficient to cut from the base tape Tb to the release tape Ta. The cutter blade 310 is mounted on the carriage 357 and is mounted, in this state, on the cutter operating mechanism 300. The carriage 357 is made up of: a holding part 357*b* which coat the cutter blade 310 in a substantially C-shape in cross section and holds the cutter holder 350; a downwardly extended piece 357*c*; an engaging projection 357*d* which projects at right angles on the opposite side of the lower end portion; and a pull-stop 357*f*.

Figure 5B:
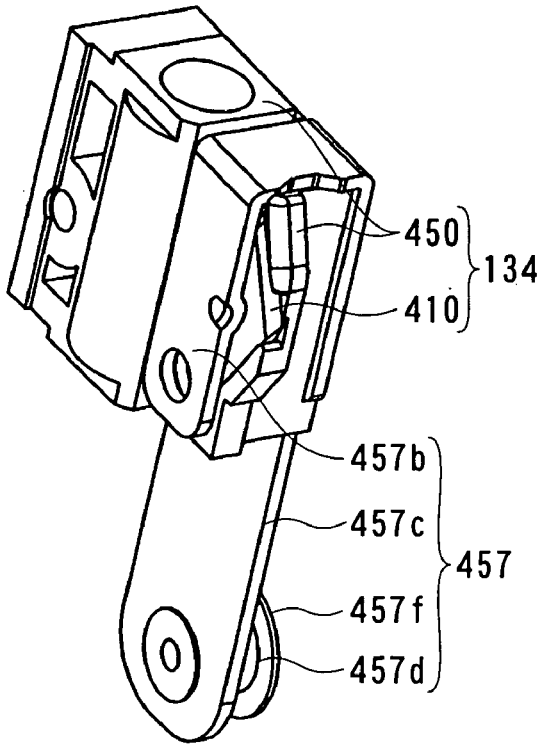
Figure 6:
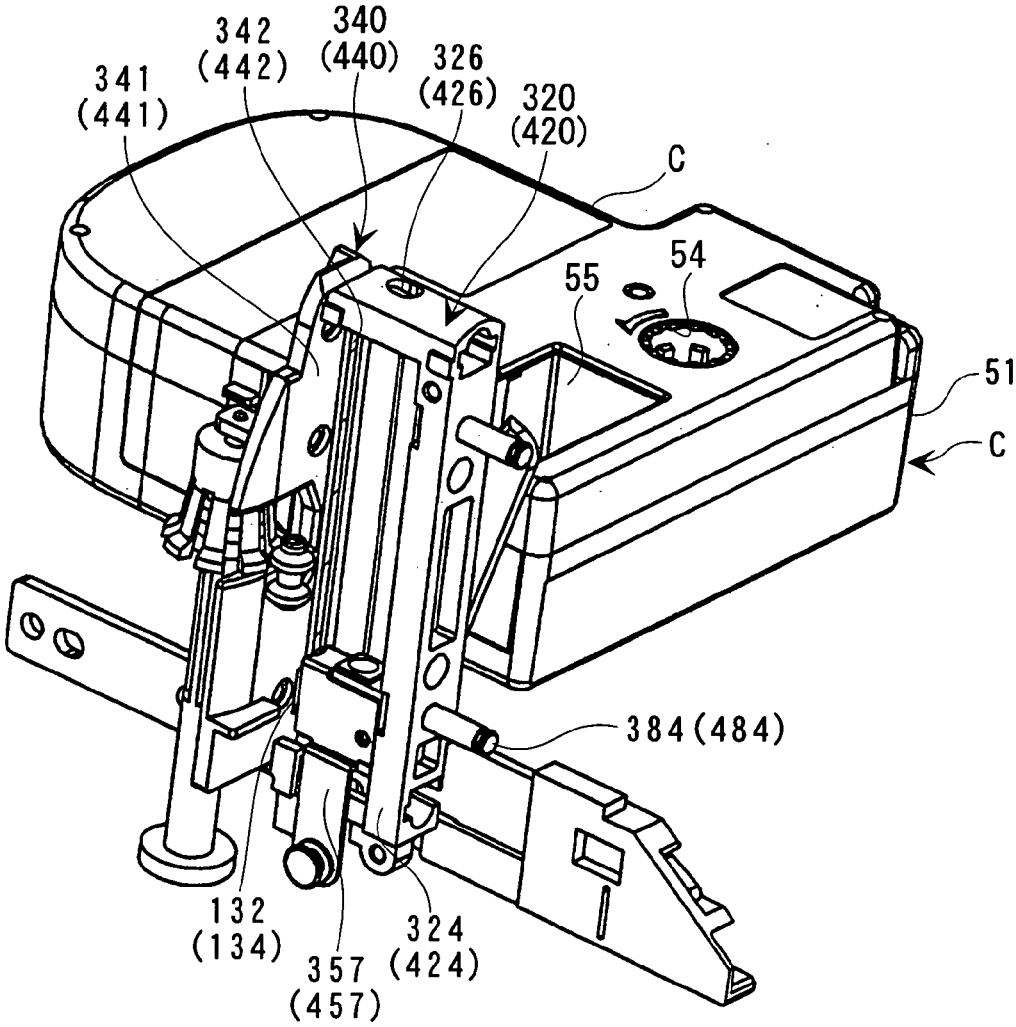
FIG. 6 is an explanatory view showing a cutter operating mechanism, particularly a carriage, a tape receiving plate and a tape holding member, as well as a positional relationship thereof with a tape cartridge.
Figure 7:
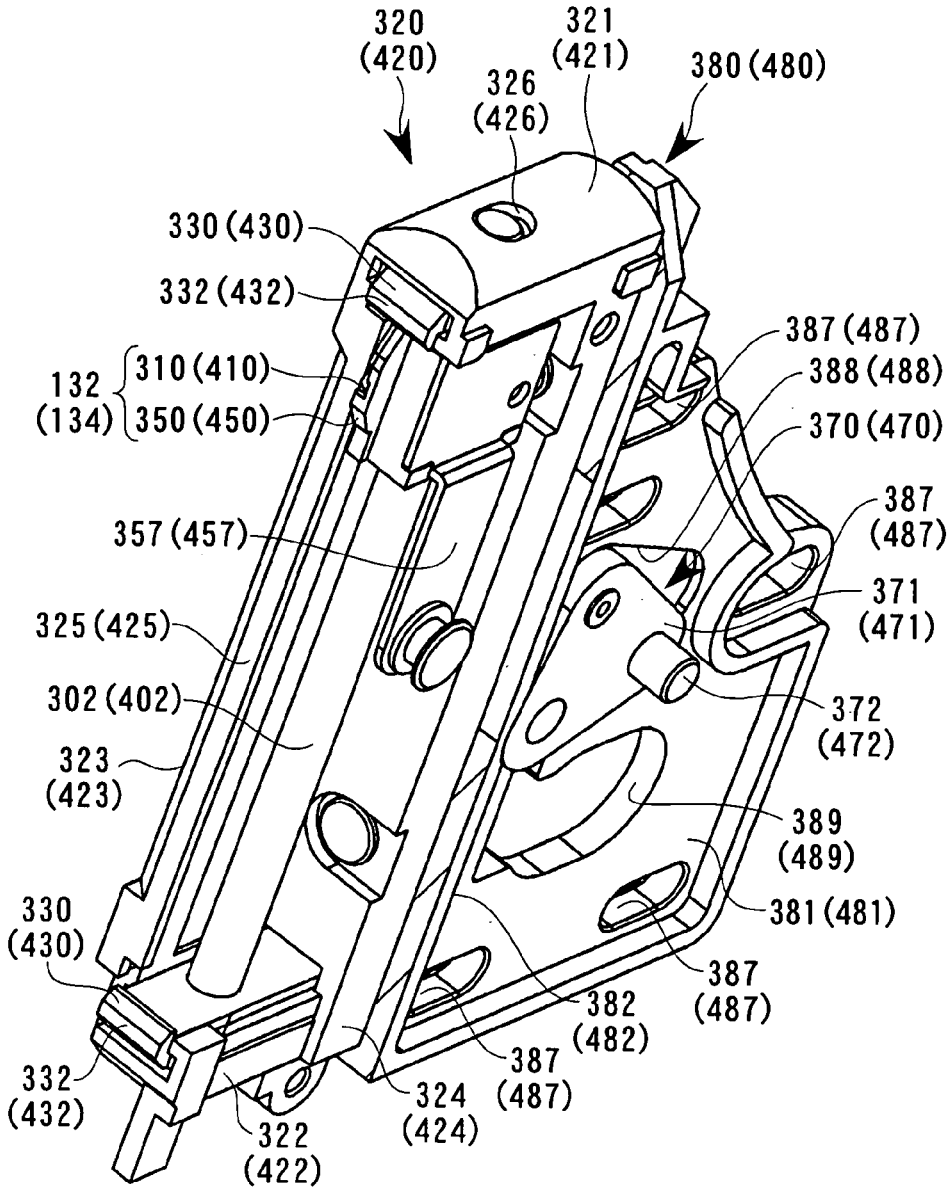
FIG. 7 is an explanatory view showing the cutter operating mechanism, particularly of the carriage, a tape holding member and a supporting block, as well as a positional relationship thereof.
Figure 8:
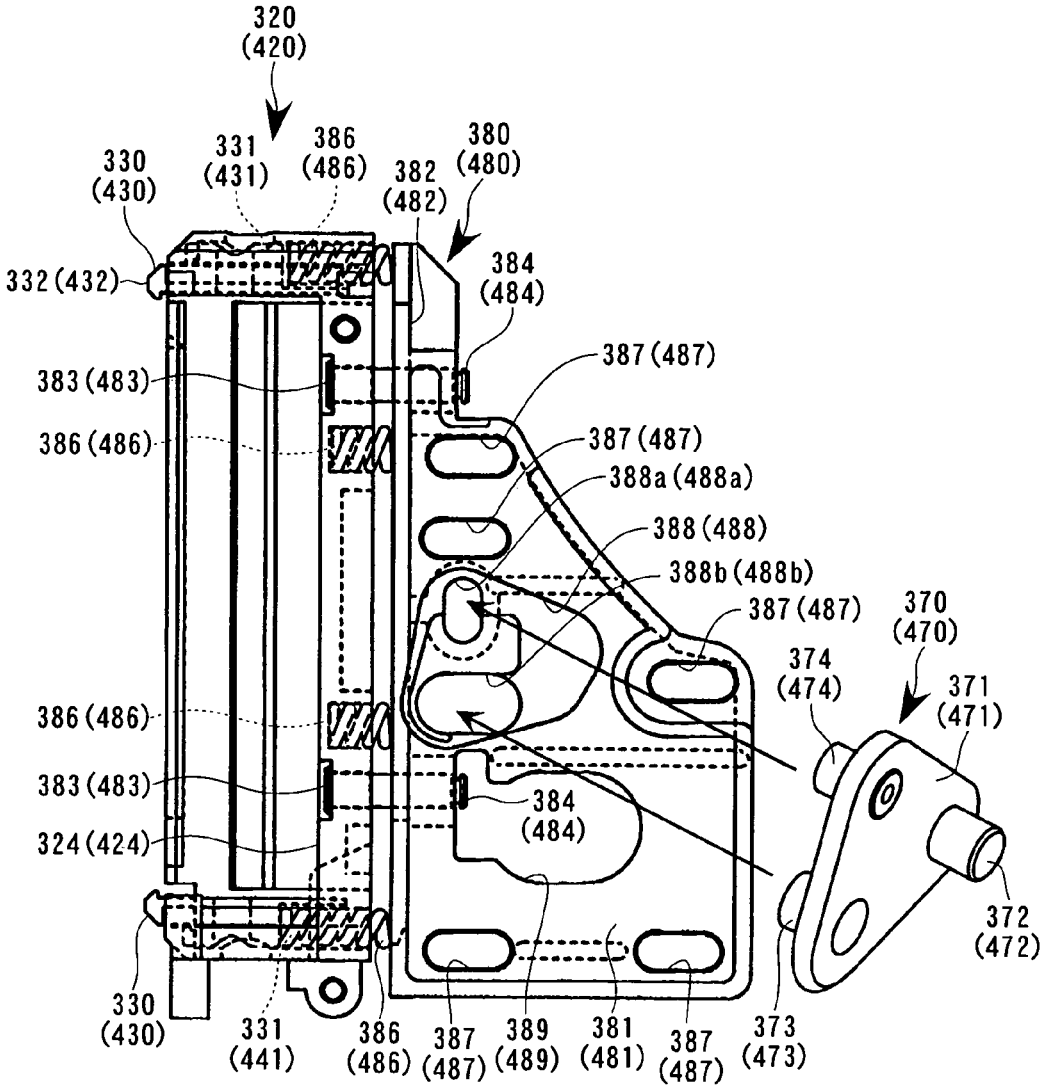
FIG. 8 is an explanatory view showing the cutter operating mechanism, particularly of the tape holding member and the supporting block, as well as the positional relationship thereof.

As shown in FIG. 5B, the half cutter 134 is made up of: a cutter blade 410 which has a single-edged angular blade capable of cutting in an upward direction; and a cutter holder 450. The amount of projection of the cutter blade 410 beyond the cutter holder 450 is adjusted so as to cut only the base tape Tb. Like the above-described full cutter 132, the cutter blade 410 is mounted on a carriage 457. The carriage 457 is made up of: a holding part 457*b*; a downwardly extended piece 457*c*; an engaging projection 457*d*; and a pull-stop 457*f*, and is mounted on the cutter operating mechanism 400.

The cutter operating mechanism 300 of the full-cutting unit 13F and the cutter operating mechanism of the half-cutting unit 13H are arranged in the sliding type of cutter operating mechanism having the same basic construction except that the arrangement of both the cutters 132, 134 and of the motors as the drive source are different from each other. In the illustration and in the following description, reference numerals in the order of three hundreds (300s) refer to the cutter operating mechanism 300 side, and parenthesized reference numerals in the order of four hundreds (400s) refer to the cutter operating mechanism 400 side. The full cutting unit 13F lies on the upstream side of the tape T feed passage, and the half cutting unit 13H lies on the downstream side thereof. Therefore, they should actually be located in different positions in the illustration. However, for the sake of simplicity, this difference is neglected in the following description.

As shown in FIGS. 6–13, the cutter operating mechanism 300 (400) is made up of: a tape receiving plate 340 (440) having a tape receiving surface 341 (441) in which a receiving slit 342 (443) is formed in a vertically (up and down) sliding direction opposite to the cutter blade 310 (410); a tape holding member 320 (420) which is disposed to lie correspondingly; a guide shaft 302 (402) which is held perpendicular to the tape holding member 320 (420); a full cutter 132 (half cutter 134) which is slidably mounted on the guide shaft 302 (402); a pair of blade positioning members 330 (430) which are disposed on both upper and lower ends of the guide shaft 302 (402); and a cutter operating system which operates the above.

The tape holding member 320 (420) is made up of: a top plate 321 (421) and a bottom plate 322 (422) which lie opposite to each other as seen in the vertical direction; two side plates 323 (423), 324 (424) which connect these upper and lower plates together; and a tape holding surface 325 (425) which lies opposite to the tape receiving plate 340 (440). By means of this tape holding surface 325 (425) the tape T can be urged toward, and fixed to, the tape receiving surface 341 (441). The tape T can thus be prevented from deviating in position at the time of cutting and also be prevented from deviating in printing position after cutting.

The tape holding member 320 (420) has formed therein a slot 326 (426) in each of the upper plate 321 (421) and the bottom plate 322 (422), respectively (only the upper plate is illustrated). The guide shaft 302 (402) is disposed parallel with the tape receiving plate 340 (440) such that the upper and lower ends thereof are slidably fitted into these slots 326 (426).

On an inner side of the upper plate 321 (421) and the bottom plate 322 (422), there are disposed a pair of blade positioning members 330 (430) formed in a plate piece so as to be integral with the guide shaft 302 (402) and be movable toward, and away from, the tape receiving member 340 (440). Each of the blade positioning members 330 (430) has formed therein a spring receiving surface 331 (431) to abut one end of the spring 386 (486). The spring receiving surface 331 (431) is urged by the spring 386 (486) such that an abutment part 332 (432) which projects beyond the tape receiving member 320 (420) by a predetermined amount resiliently comes into abutment with the tape receiving member 340 (440).

The cutter operating system is made up of: a rotary disk 360 (460) which is operated to rotate; an input plate 370 (470) which converts the rotary motion to a swinging movement; a supporting block 380 (480) which converts the swinging movement to a back-and-forth (reciprocating) linear movement; and an input arm 390 (490) which converts the rotary movement of the rotary disk to a swinging movement.

The supporting block 380 (480) has formed therein laterally elongated mounting slots 387 (487) at suitable positions of a base plate 381 (481) and is disposed on a frame (not illustrated) so as to be movable back and forth relative to the tape receiving plate 340 (440) by means of pins, or the like. An input plate mounting recessed portion 388 (488) into which can be fitted the input plate 370 (470) is formed in a recessed manner. On the inside thereof, there are formed a vertically elongated engaging recessed portion 388*a* (488*a*) and a laterally elongated hole 388*b* (488*b*). The input plate mounting recessed portion 388 (488) is formed such that the input plate 370 (470) can be swung therein. The base plate 381 (481) has formed in a lower part thereof a rotary shaft insertion hole 389 (489) for inserting therethrough a rotary shaft 361 (461) of the rotary disk 360 (460).

The supporting block 380 (480) has a flange 382 (482) which is vertically formed at right angles to that end portion of the base plate 381 which lies on the side of the tape holding member 320 (420). This flange 382 (482) and the side plate 324 (424) of the tape holding member 320 (420) are caused to lie opposite to each other at a distance therebetween and are connected together by connecting pins 383 (483) at two, i.e., upper and lower, points. Each of these connecting pins 383 (483) is disposed along a sliding direction of the tape holding member 320 (420) and is fixed at its one end to the side plate 324 (424) and is slidably inserted at the other end thereof into the flange 382 (482). A pull-stop 384 (484) is formed at a front end thereof. The lower connecting pin 383 (483) is projected into an inserting hole 384 (484) of the rotary shaft, and a pull-stop 384 (484) is formed at a front end thereof.

The rotary disk 360 (460) rotates about the rotary shaft 361 (461) which penetrates through the rotary shaft inserting hole 389 (489) and has on one surface thereof an end surface cam groove 362 (462) and a crank projection 363 (463) on the other surface thereof. On a periphery of the rotary disk 360 (460), there is formed in a recessed manner a detection recess 364 (464). A full cutter home position detection sensor 144 (half cutter home position detection sensor 146) such as a micro-switch, or the like, for detecting the detection recess is formed near the periphery.

The end surface cam groove 362 (462) is formed into an annular shape by serially connecting a small-diameter arcuate groove 362*a* (462*a*) and a large-diameter arcuate groove 362*b* (462*b*). The supporting block 380 (480) can thus be subjected to a reciprocating linear movement, i.e., a back-and-forth movement relative to the tape receiving plate 340 (440), in an intermittent manner.

The drive mechanism of the rotary disk 360 (460) is made up of: a full-cutting motor 131 (half-cutting motor 133); and a gear train 367 (467) which transmits the rotary force thereof to the rotary disk 360 (460). The gear train 367 (467) is made up of: a worm gear 367*a* (467*a*); a worm wheel 367*b* (467*b*); and an intermediate gear 367*c* (467*c*). The rotary force of the intermediate gear 367*c* (467*c*) is transmitted to the rotary disk 360 (460) through a drive gear 368 (468) which is formed integrally with the rotary disk 360 (460).

At the front end of the coaxial shaft of the worm which is fixed to the main shaft of the full-cutting motor 131 (half-cutting motor 133), there is disposed an encoder 143*a* (145*a*) which has formed therein a plurality of detecting openings in the periphery thereof. The rotary detection sensor 143 for the full-cutting motor (rotary sensor 145 for the half-cutting motor) in the detection unit 14 (see FIG. 3) has a photo-sensor 143*b* (145*b*) in which a light-emitting element and a light-receiving element are disposed to lie opposite to each other so as to face the detection opening. The blinking of the received light is opto-electronically converted for being outputted to the control unit 200 as a pulse signal. The rotational frequency is detected by the number of pulses.

The input plate 370 (470) is arranged as follows. Namely, on one surface of the base plate 371 (471) having a triangular external shape, or the like, a cam projection 372 (472) is provided in a projecting manner so as to form an end surface cam mechanism by being engaged with the end face cam groove 362 (462) of the rotary disk 360 (460). On a rear surface side of the base plate, there is formed a supporting shaft 373 (473) and an engaging projection 374 (474). The supporting shaft 373 (473) penetrates through a laterally elongated hole 388*b* (488*b*)in the supporting block 380 (480) and is fixed in parallel with the rotary shaft 361 (461). The input plate 370 (470) is arranged to be slidable about the supporting shaft 373 (473). The engaging projection 374 (474) is fitted into the engaging recess 388*a* (488*a*) in the supporting block 380 (480) in a manner to be movable up and down.

The input arm 390 (490) is rotatably supported at its base end portion on a supporting shaft 391 (491) which is parallel with the rotary shaft 361 (461). In an intermediate portion of the input arm 390 (490), there is formed a crank slot 392 (492) which is engaged with a crank projection 363 (463) of the rotary disk 360 (460) to thereby constitute a swinging crank mechanism. At a front end portion there is formed a slot 393 (493) along the radius of swinging movement.

The crank slot 392 (492) has formed in its intermediate portion a power transmission-free portion 394 (494) at which the rotary force of the rotary disk 360 (460) is not transmitted to the input arm 390 (490). On both ends thereof there are formed power transmission portions 395 (495) and 396 (496). The engaging projection 357*d* (457*d*) of the carriage 357 (457) is pivotally mounted in the slot 393 (493) so as to be slidable in a direction of swinging radius of the input arm 390 (490) slot 393 (493).

Figure 10:
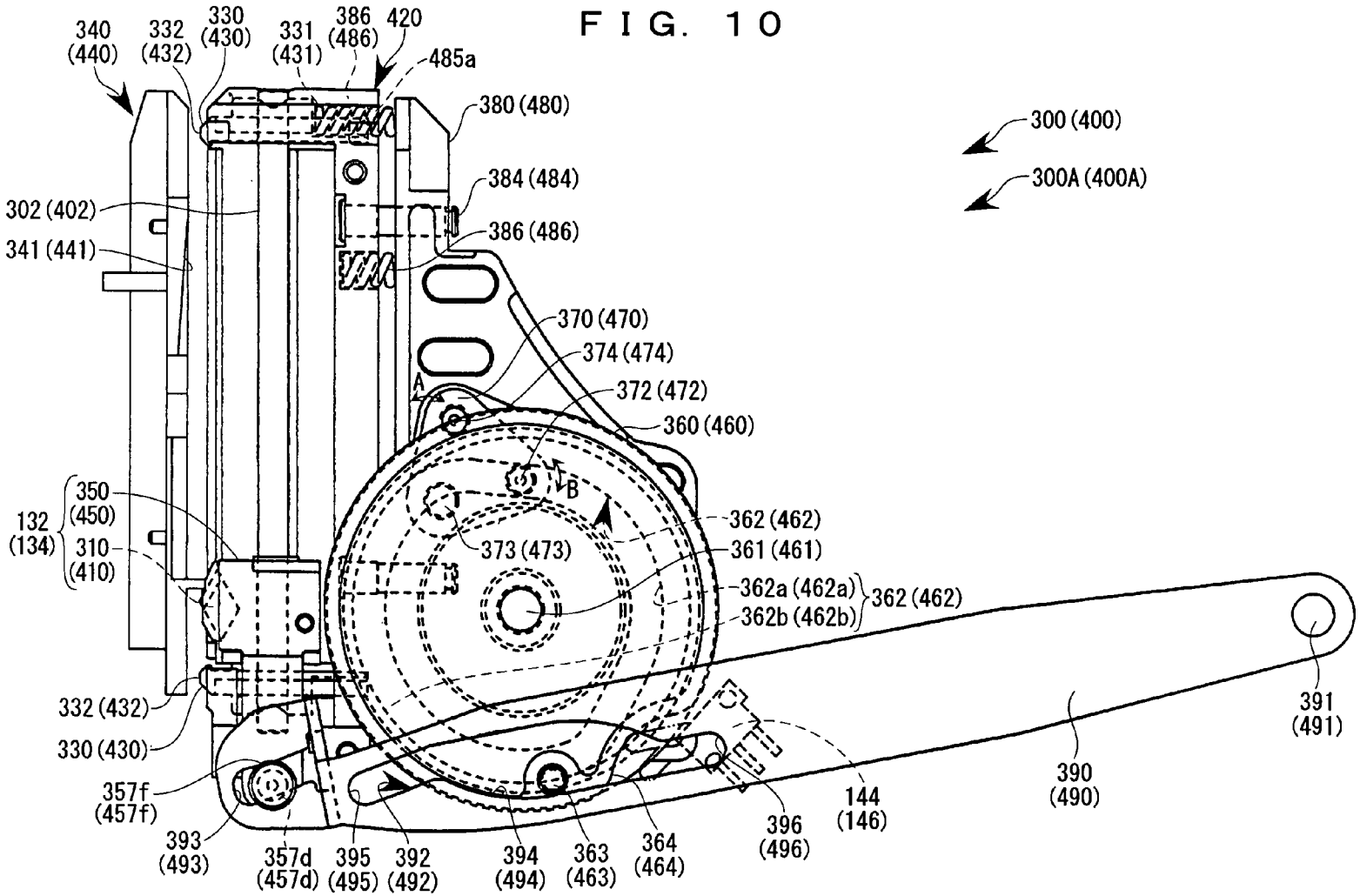
FIG. 10 is an explanatory view of a full-cutting unit and a half-cutting unit in a state "A" which is the home position of the cutter operating mechanism.
Figure 11:
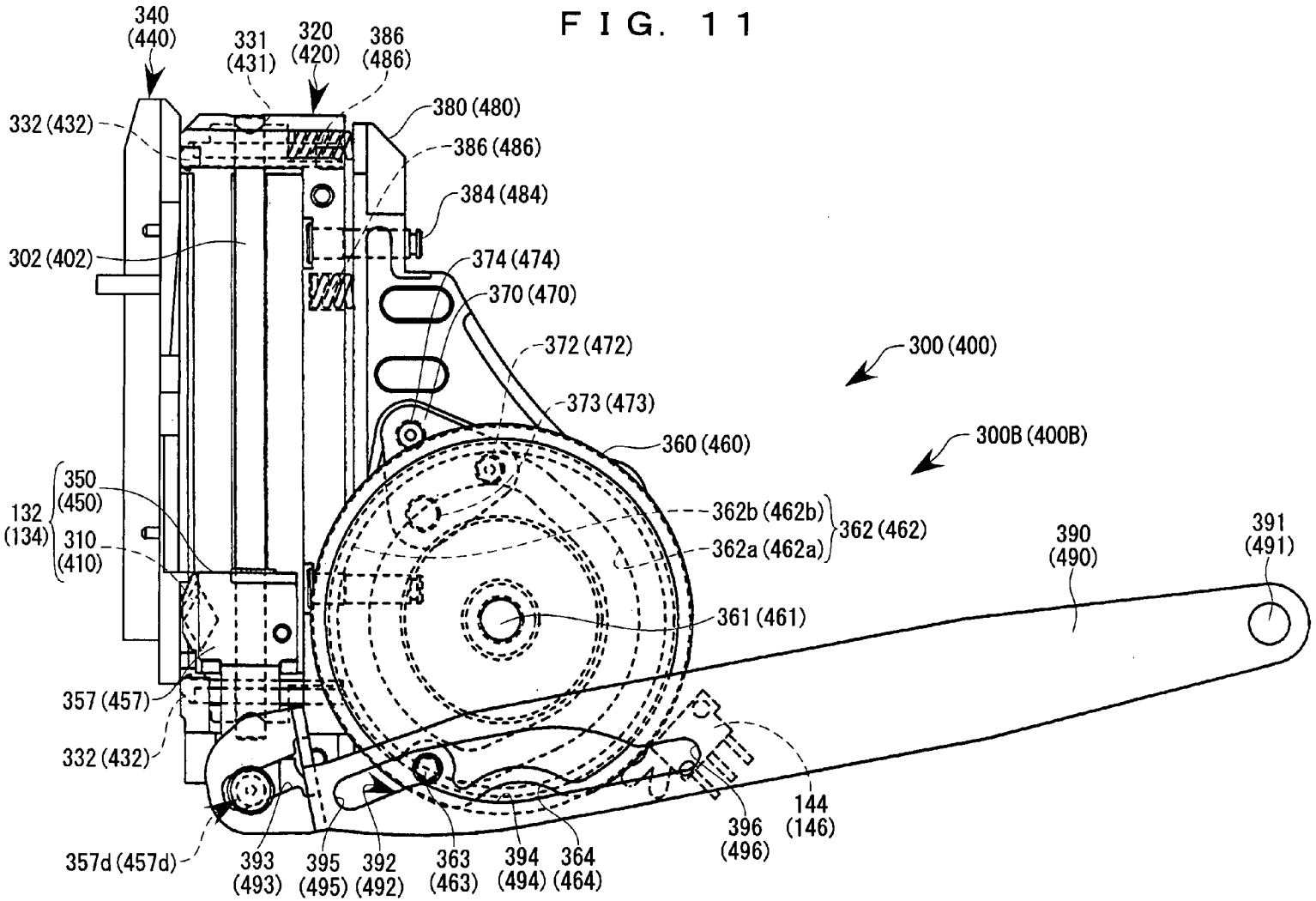
FIG. 11 is an explanatory view thereof in a state "B" of the cutter operating mechanism.

Among the states of the cutter operating mechanism 300 (400), the state as shown in FIG. 10 of detecting position (hereinafter called a home position) of the full cutter home position detection sensor 144 (i.e., the state in which the reference end is departed) is defined as a state 300A (400A). The state in which, as shown in FIG. 11, the rotary disk 360 (460) is rotated clockwise as seen in the figure and the tape receiving member 320 (420) is brought into abutment with the tape receiving plate 340 (440) (i.e., the state in which the tape T is pushed: reference end is close) is defined as a state 300B (400B).

Figure 12:
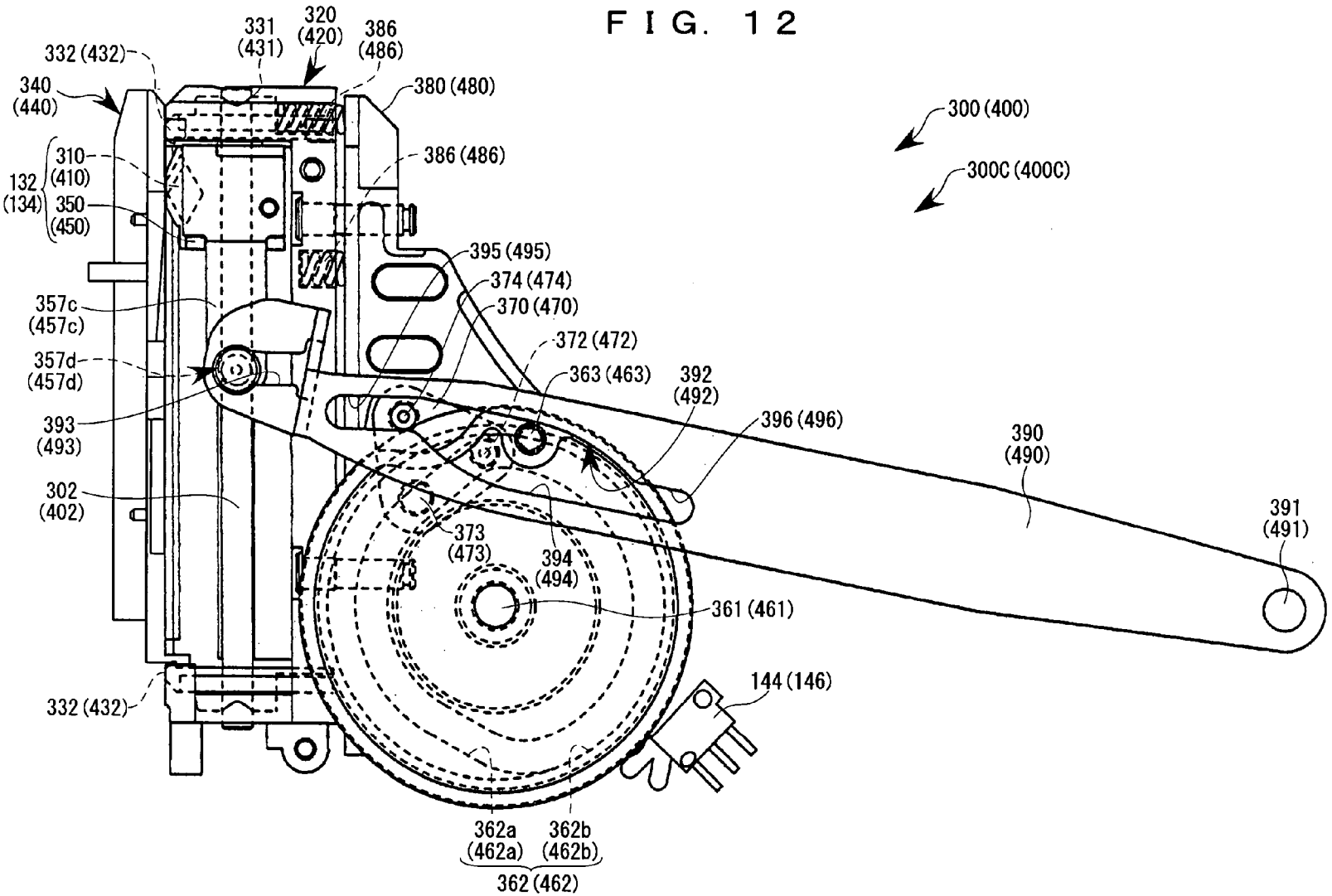
FIG. 12 is an explanatory view thereof in a state "C" of the cutter operating mechanism.
Figure 13:
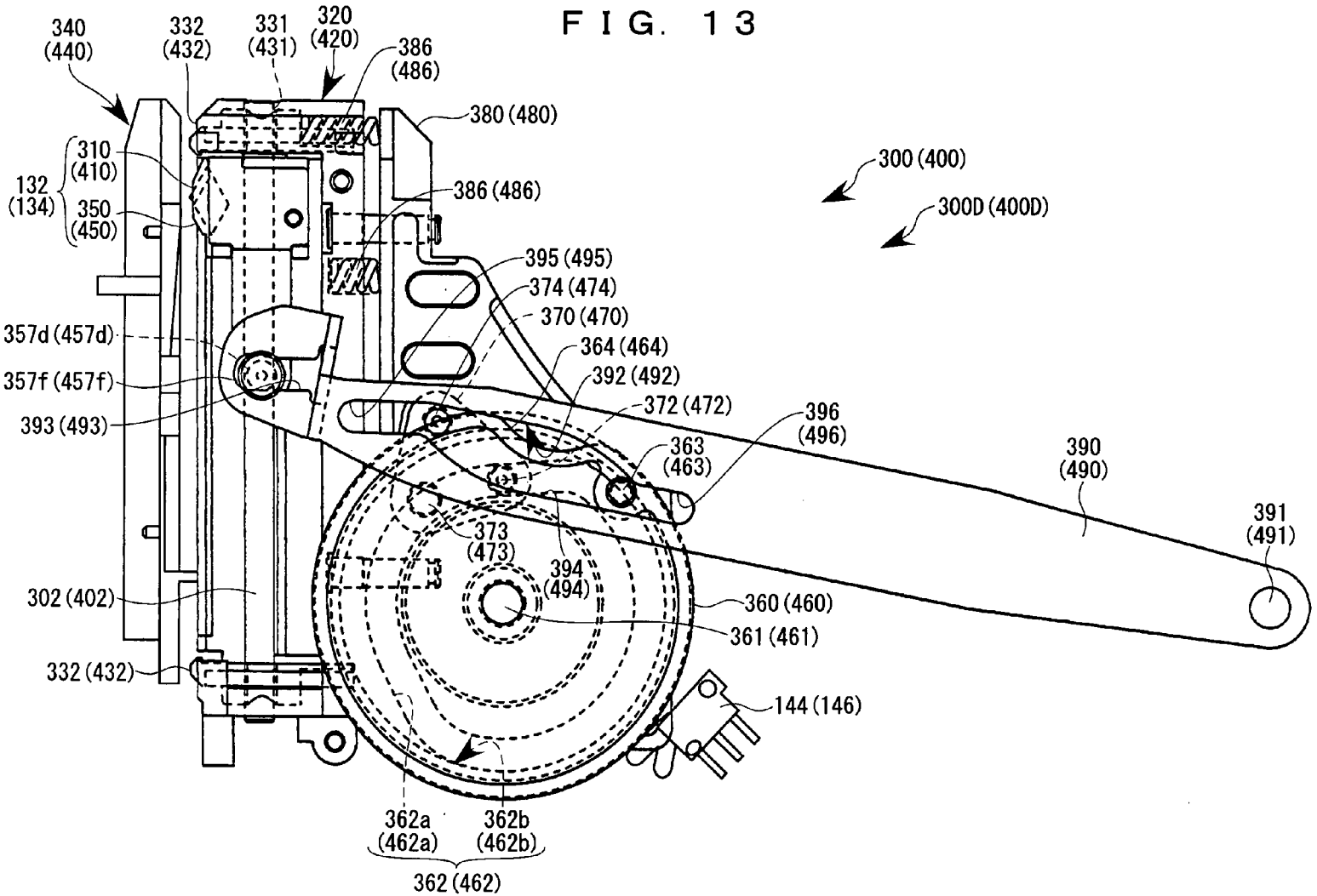
FIG. 13 is an explanatory view thereof in a state "D" of the cutter operating mechanism.

Similarly, the state as shown in FIG. 12 in which the rotary disk 360 (460) is rotated clockwise as seen in the figure while the tape holding member 320 (420) is kept in abutment and the full cutter 132 (half cutter 134) has moved to an upper end (i.e., the state in which the opposite end is close) is defined as a state 300C (400C). Further, the state in which the rotary disk 360 (460) is rotated clockwise as seen in the figure and, as shown in FIG. 13, the tape pushing member 320 (420) is departed from the tape receiving plate 340 (440) (i.e., a state in which the tape T is released: opposite end is departed) is defined as a state 300D (400D).

In this case, when the rotary disk 360 (460) is rotated clockwise as seen in the figure with the full-cutting motor 131 (half-cutting motor 133) serving as the drive source, the state will move from the state 300A (400A) to the state 300B (400B), and to the state 300C (400C), and further to the state 300D (400D), and back to the state 300A (400A) in a circulating manner. By thus controlling to execute the above-described transfer of states, the cutting operation in the upward direction can be repeated.

First, the state 300A (400A) is a state of waiting position (home position) in which the tape holding member 320 releases the tape T and the transportation and printing can be executed. The full cutter 132 (half cutter 134) is in a state of ready (waiting) for cutting in which it is away from the tape receiving plate 340 (440).

When the rotary disk 360 (460) rotates clockwise as seen in the figure, the crank projection 363 (463) moves only within the power transmission-free portion 394 (494) in the state of transfer from the state 300A (400A) to the state 300B (400B). Therefore, the input arm 390 (490) does not move up and down and the full cutter 132 (half cutter 134) neither moves up and down. However, the supporting block 380 (480) is moved close to the tape receiving plate 340 (440) through the input plate 370 (470). The tape T is thus sandwiched by the tape holding member 320 (420) and the tape receiving plate 340 (440) for fixing the tape T. As a result of this operation, the full cutter 132 (half cutter 134) moves to the cutting preparation position and is set in position by the abutment of the pair of blade positioning members 330 (430) with the tape receiving plate 340 (440).

Next, when the rotary disk 360 (460) rotates clockwise as seen in the figure, the crank projection 363 (463) rotates in a state of being engaged with the power transmission part 395 (495) of the crank slot 392 (492) in the motion from the state of 300B (400B) to the state of 300C (400C). The rotary motion of the rotary disk 360 is transferred to the swinging movement from the bottom to the up. Further, the cutter holder 350 (450) is transferred to the back and forth linear movement of moving up along the carriage 357 (457), whereby the full cutter 132 (half cutter 134) is caused to execute cutting motion from down to up (upward cutting motion).

When the rotary disk 360 (460) further rotates clockwise as seen in the figure, the crank projection 363 (463) moves within the power transmission-free portion 394 (494) in the motion from the state 300C (400C) to the state 300D (400D). The input arm 390 (490) and the full cutter 132 (half cutter 134) does not move up and down, but the supporting block 380 (480) is departed from the tape receiving plate 340 (440) through the input plate 370 (470). The tape holding member 320 (420) and the full cutter (half cutter 134) is also departed accordingly. As a result, the tape T is released once again from the tape holding member 320 (420), so that the transfer and printing become possible.

Next, when the rotary disk 360 (460) further rotates clockwise as seen in the figure, the crank projection 363 (463) rotates in a state of being engaged with the power transmission part 396 (496) of the crank slot 392 (492) in the motion from the state of 300D (400D) to the state of 300A (400A). This rotary motion is converted to the swinging movement from up and down of the input arm 390 (490), and is further converted to the return linear movement in which the cutter holder 350 (450) is lowered. During this time, the tape holding member 320 (420) and the full cutter 132 (half cutter 134) are away from the tape receiving plate 340 (440). Therefore, the full cutter 132 (half cutter 134) moves from up to down (downward movement).

As described above, in the cutter moving mechanism 300 (400), the rotary disk 360 (460) is rotated clockwise as seen in the figure with the full-cutting motor 131 (half-cutting motor 133) as the drive source. The control is made such that a circulating state transfer is attained from the state 300A (400A) to the state 300B (400B), to the state 300C (400C), to the state 300D (400D), and to the state 300A (400A). It is thus possible to repeat the cutting motion in the vertical (up and down) direction.

Let us define the clockwise direction of rotation of the rotary disk 360 to be the normal direction of rotation. Then, the full-cutting motor 131 of this embodiment is capable of rotating in the reverse (or opposite) direction of rotation (reverse rotation). In addition, as shown in FIG. 5A, the full cutter 132 is capable of executing not only the cutting operation in the upward direction (normal direction of cutting), but also the cutting operation in the direction from up to down (revere direction cutting). A description will now be made about this operation.

When the rotary disk 360 is rotated counterclockwise as seen in the figure with the full-cutting motor 131 as the drive source, the state is transferred in a circulating manner from the state of 300A to the state of 300B, to the state of 300C, to the state of 300D, to the state of 300C, to the state of 300B, and to the state of 300A. By controlling to execute this transfer of states, the cutting operation in the downward direction can be repeated.

First, in the motion from the state of 300A to the state of 300D, the rotary disk 360 is rotated in the counterclockwise direction as seen in the figure from the state of 300A in the waiting position (home position). The crank projection 393 is thus rotated through engagement with the power transmission part 396 and, as a result, the full cutter 132 is moved up by the swinging movement of the input arm 390 from the bottom to the top. During this time, since the full cutter 132 is away from the tape receiving plate 340 together with the tape holding member 320, or the like, the full cutter 132 moves upward without accompanying the cutting operation.

Next, in the motion from the state of 300D to the state of 300C, the rotary disk further rotates counterclockwise as seen in the figure, and the crank projection 363 moves within the power transmission-free portion 394. Therefore, while there is no up and down movement of the input arm 390 and the full cutter 132, the supporting block 380 comes closer to the tape receiving plate 340 through the input plate 370. The tape T is thus fixed by being sandwiched by the tape holding member 320 and the tape receiving plate 340. The full cutter 132 is moved to the cutting start position to make preparations for cutting, and the pair of blade positioning members 330 are fixed in position by being brought into abutment with the tape receiving plate 340.

Then, in the motion from the state of 300C to the state of 300B, the rotary disk 360 is rotated counterclockwise as seen in the figure, and the crank projection 363 is pivotally moved in a state of being engaged with the power transmission part 395. As a result of swinging movement of the input arm 390 from up to down, the full cutter 132 is caused to execute downward cutting operation.

In the motion from the state 300B to the state 300A, the rotary disk 360 further rotates counterclockwise as seen in the figure, and the crank projection 363 moves within the power transmission-free portion 394. Therefore, the input arm 390 and the full cutter 132 do not move up and down, but the supporting block 380 departs from the tape receiving plate 340 through the input plate 370. As a result, the tape holding member 320 and the full cutter 132 also depart accordingly. The tape T is thus once again released from the tape holding member 320 into a state in which it is capable of being transported and printed.

As described above, the cutter operating mechanism 300 rotates the rotary disk 360 counterclockwise as seen in the figure with the full-cutting motor 131 serving as the drive source and, by controlling so as to execute the circulating transfer from the state of 300A to the state of 300D, to the state of 300C, to the state of 300B, and to the state of 300A, the downward cutting motion can be repeated.

It is to be noted that this cutter operating mechanism 300 is capable of executing still various cutting operations by making use of the above-described up and down movements. Description will now be made about these cutting operations.

Figure 14A:
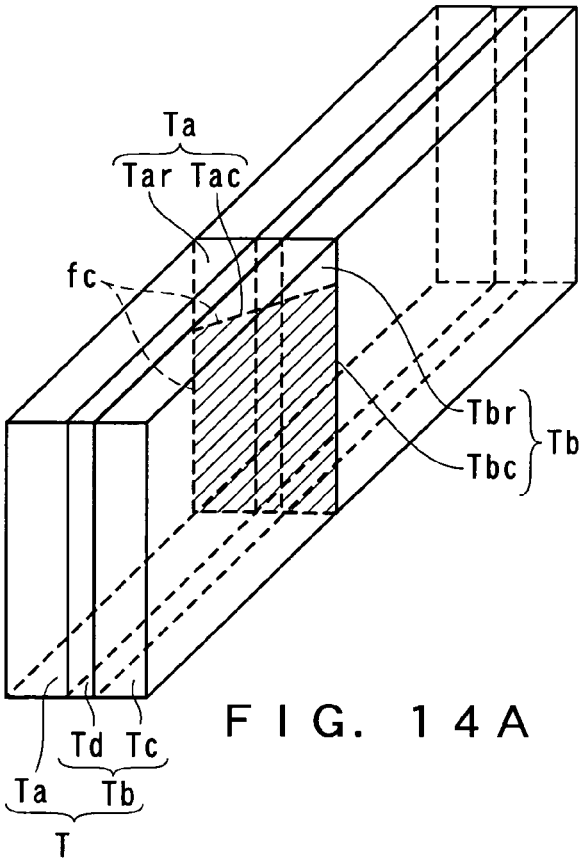
FIGS. 14A thorough 14D are explanatory views showing cut images and sections of a tape in case various connection cutting accompanying no half cutting is performed on the tape.
Figure 14B:
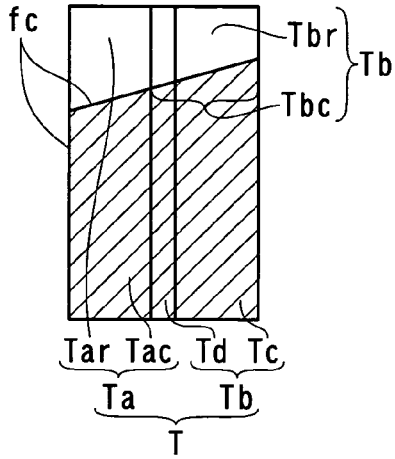

In the motion from the state of 300B to the state of 300C, the full cutter 132 is subjected to the cutting movement in the upward direction (normal direction) as a result of rotation of the rotary disk 360 in the clockwise rotation (hereinafter referred to as the normal rotation, or rotation in the normal direction). If this operation is stopped half (or stopped on the way) so that the full cutter 132 is returned by the counterclockwise rotation (hereinafter referred to as the reverse rotation, or rotation in the reverse direction) of the rotary disk 360, the following cutting mode can be executed. Namely, as shown in FIGS. 14A and 14B, for example, while leaving a connecting portion or connection portion (connection portion Tbr of the base tape Tb+ connection portion Tar of the release tape Ta) as it is (i.e., without cutting) on an upper side as seen in the figure, only the lower side as seen in the figure (cutting portion Tbc of the base tape Tb+ cutting portion Tac of the release tape Ta: illustrated by hatched lines) is cut. This kind of cutting is hereinafter referred to as "connection cutting with an upper side left connected" or "upper-side connection cutting."

Figure 14C:
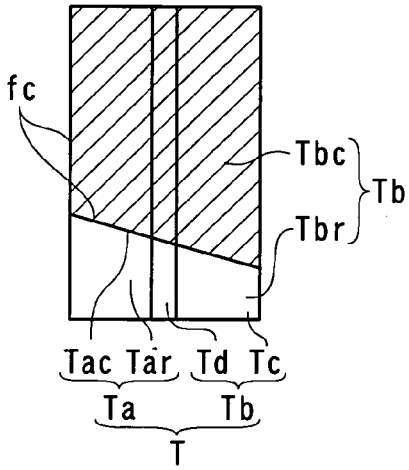

Similarly, in the motion from the state of 300C to the state of 300B, for example, the full cutter 132 is subjected to the cutting operation in the downward direction (reverse direction). If this cutting operation is stopped on the way so as to return the full cutter by rotation in the normal direction, a special cutting can be executed, as shown in FIG. 14C, in which only an upper side (cutting portion Tbc+ cutting portion Tac) is cut while leaving a connection portion (connection portion Tbr+ connection portion Tar) as it is (i.e., without cutting). This kind of cutting is hereinafter referred to as "connection cutting with a lower side left connected" or "lower-side connection cutting."

Figure 14D:
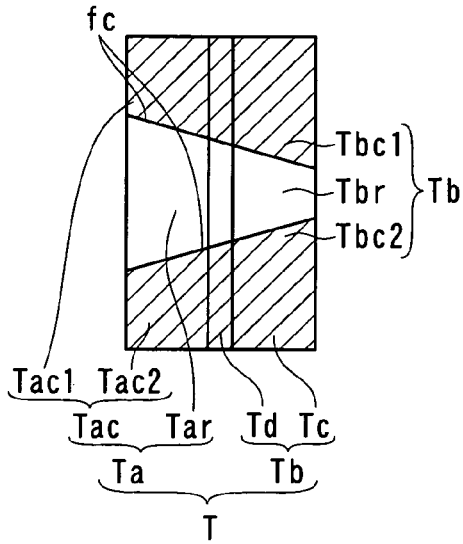

Further, if the upward cutting (cutting in the upward direction) from the lower side (i.e., the motion from the state of 300B to an intermediate position of the state of 300C) and the downward cutting (cutting in the downward direction) from the upper side (i.e., the motion from the state of 300C to an intermediate position of the state of 300B) are combined, a special cutting is possible in which, as shown in FIG. 14D, only the upper side (cutting portion Tbc1+ cutting portion Tac1) and the lower side (cutting portion Tbc2+ cutting portion Tac2) are cut while leaving a connection portion in a center portion as seen in the figure as it is. This kind of cutting is hereinafter referred to as "connection cutting with a center portion left connected" or "center connection cutting."

In the above-described "upper-side connection cutting," "lower-side connection cutting," and "center-portion connection cutting," the base tape Tb is cut (full cut) in the same manner as the release tape Ta. Alternatively, it is possible to combine, as shown in FIGS. 15A–15D, half cutting hc so that the base tape Tb is cut off without retaining the connection portion. In this arrangement, when the tape is released for use as a label, it is not necessary to separate the connection portion Tbr of the base tape Tb, with the result that the releasing becomes easier.

Figure 15A:
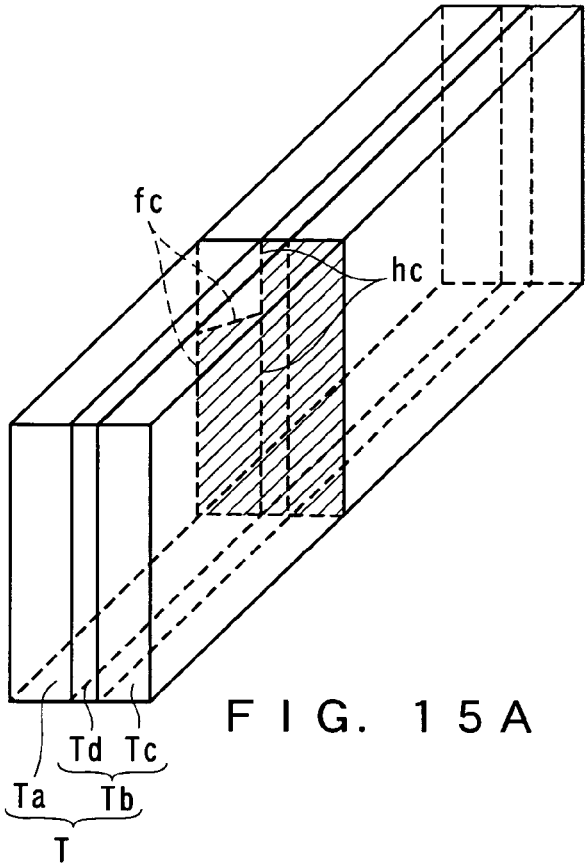
FIGS. 15A–15D are explanatory views, similar to those in FIGS. 14A–14D, of an example in case various connection cutting accompanying half cutting is performed on the tape.
Figure 15B:
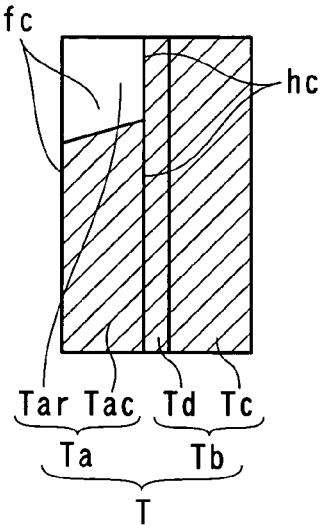
Figure 15C:
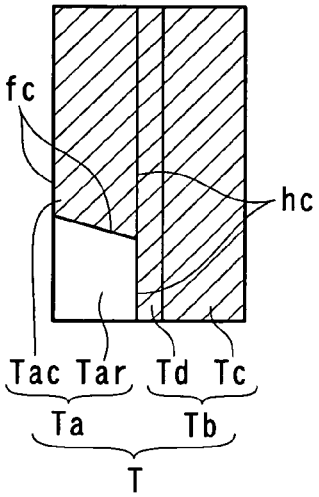
Figure 15D:
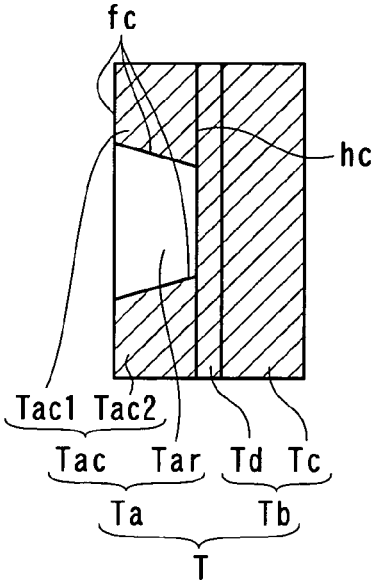

Hereinafter, the example in which the half cutting hc is combined is employed as the "connection cutting." Namely, FIGS. 15A and 15B show "upper-side connection cutting", FIG. 15C is a "lower-side connection cutting", and FIG. 15D is a "center connection cutting."

In this embodiment, the full cutting unit 13F and the half cutting unit 13H are separately provided. Alternatively, as an arrangement in which the full cutter 132 can be adjusted to become closer to the tape receiving plate 340, it may be so arranged that the full cutting unit 13F and the half cutting unit 13H can be used in common with each other. Further, it may also be so arranged that the half cutting unit 13H can execute reverse rotation of the motor or the cutting motion in the reverse direction.

With reference to FIG. 3, the description will now be returned to the entire apparatus. The detection unit 14 is made up of: the above-described tape recognition sensor 141; the sensor 142 for detecting the rotation of the tape-feed motor; the sensor 143 for detecting the rotation of the full-cutting motor; the full cutter home position detection sensor 144; the half-cutting motor rotation detection sensor 145; and the half-cutter home position detection sensor 146. Depending on the necessity, some of the above may be omitted.

The drive unit 270 is made up of: a display driver 272; a head driver 272; and a motor driver 273. The display driver 271 drives the display 4 of the operation unit 11 depending on the instruction in the control signal to be outputted from the control unit 200. Similarly, the head driver 272 drives the printing head 7 of the printer unit 12 according to the instruction of the control unit 200. The motor driver 273 is made up of: a feed motor driver 273*a* which drives the feed motor 131 of the printer unit 12; a full-cutting motor driver 273*b* which drives the full-cutting motor 131 of the cutter unit 13; and a half cutter driver 273*c* which drives the half-cutting motor 133 also of the cutter unit 13. The motor driver 273 drives each of the motors according to the instruction also from the control unit 200.

The operation unit 11 is provided with the key board 3 and the display 14. The display 4 has a display screen 41 on which a display screen of 96 dots×64 dots can be displayed, the display screen 41 being disposed on an inside of a rectangular shape of about 6 cm wide (X-axis direction)× about 4 cm long (Y-axis direction). A user inputs data from the key board 3 so that the printing data such as character array image data, or the like, can be prepared and compiled, or the result of inputting is can be visually recognized, or various kinds of commands, selection instructions, or the like, can be inputted from the key board 3.

The key board 3 has disposed therein: character key group 31 inclusive of alphabet key group, figure key group, kana-key group such as hirakana and katakana, external character key group which is used to call external characters for selecting purpose; and function key group 32 which is to designate various operation modes. The function key group 32 includes: switching key; printing key for giving commands on the printing processing; selection key for giving selection commands such as data determination in text inputting, line shifting, selection of screens, or the like; and four cursor keys for moving a cursor to the up, down, left, and right directions, or for moving the display range on the display screen 41. It may be so arranged that individual keys are provided for each key inputting operation, or fewer keys may be employed in combination with the shift keys, or the like, for inputting purpose.

The control unit 200 is provided with: a central processing unit (CPU) 210; a read-only memory (ROM) 220; a character generator ROM (CG-ROM) 230; a random access memory (RAM) 240; and a peripheral control circuit (P-CON) 250. They are connected to one another by an internal bus 260.

The ROM 220 has a control program region 221 which stores therein control program to be processed in the CPU 210, and a control data region 222 which stores therein control data inclusive of a color conversion table, a character modification table, a cutter drive range setting table (to be described hereinafter; see FIG. 27), or the like. The CG-ROM 230 stores therein font data such as characters (inclusive of figures, marks, images) which are prepared in the tape printing apparatus 1. When code data to specify the characters, or the like, are given, corresponding font data are outputted.

The RAM 240 has a back-up at the time of switching off, and has regions such as: various flag/register group; text data region 242; display image data region 243; print image data region 244; picture register image data region 245; external character register image data region 246; various buffer regions 247 such as letter development buffer, print buffer, or the like. The RAM 240 is used as a working region for control processing.

In a state in which the text data are inputted and compiled by the key board 3 (text compiling state), the tape printing apparatus 1 stores therein the inputted text data into the text data region 242 of the RAM 240. The inputted text data are developed into image and are stored in the display data region 243 as the image data (display image data) and are displayed, depending on the necessity, by outputting them on the display screen 41 of the display 4. The state of the display screen 41 at the time of text data inputting/compiling is referred to as "text compilation screen." In a state of displaying the text compilation screen, or the like, the result of the compilation according to various settings is stored in the screen image data region 244 as the print image data (printing image data).

The P-CON 250 has built therein a logic circuit which supplements the function of the CPU 210 and also handles interface signals with the peripheral circuits, as constituted by a gate array and custom LSI. A timer 251 for counting various times is also built in as the function inside the P-CON 250. The P-CON 250 is connected to the various sensors of the detection unit 14 and to the key board 3. Various detected signals from the various sensors of the detection unit 14 and the various commands and input data from the key board 3 are captured into the internal bus 260 as they are or with due processing. In a manner interlocked with the CPU 210, the data and the control signals as outputted from the CPU 210, or the like, to the internal bus 260 are outputted to the drive unit 270 as they are or with due processing.

In the above-described arrangement, in accordance with the control program inside the ROM 220, the CPU 210 inputs various detection signals, various command signals, various data, or the like, through the P-CON 250. The font data from the CG-ROM 230, various data in the RAM 240, or the like, are processed, and control signals are outputted to the drive unit 270 through the P-CON 250. The printing head 7 is thus controlled to thereby print on the tape T under given conditions, and an overall control of the entire tape printing apparatus 1 such as positional control in printing, cutting control in cutting the tape T, display control on the display screen 41, or the like.

Figure 16:
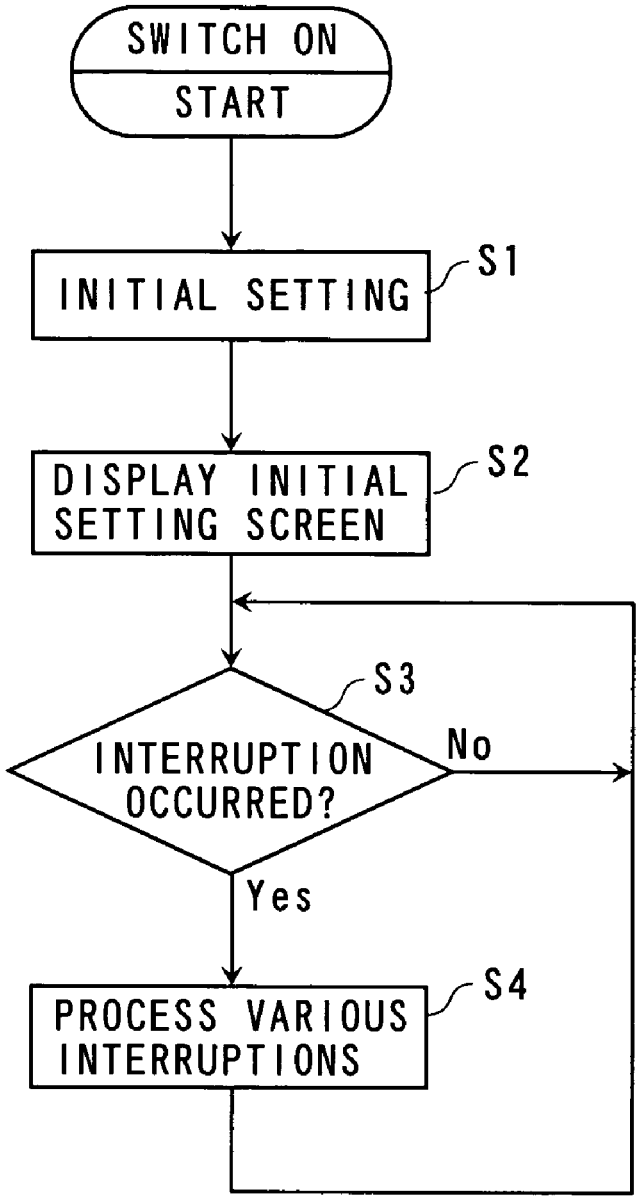
FIG. 16 is a flow chart showing an approximate processing of the entire control of the tape printing apparatus.

With reference to FIG. 16, a description will now be made about the processing flow of the entire control of the tape printing apparatus 1. When the power switch is pressed (switched on), the processing or procedure is started. First, initial setting is made (S1) to restore the various retreated flags, or the like, to thereby return the state back to the state at the time of last switching off. Then, the display screen of the last time is displayed as the initial setting screen (S2).

The subsequent processing in the figure, i.e., judgment as to whether the input is made by the key board or not (S3), and the various interrupting processing (S4) are conceptually illustrated. Actually, after the initial screen display is finished (S2), the interruption by the key board inputting, or the like, is accepted and this state is maintained (S3: No) until other interruption occurs. If other interruption occurs (S3: Yes), the processing transfers to the interruption processing (S4) and, as soon as the interruption processing is finished, the original state is maintained again (S3: No).

As described above, the tape printing apparatus 1 performs or executes the main processing in the form of interruption processing. Therefore, if the preparation for print image forming has been made, the interruption for printing command occurs when the user issues a printing command at an arbitrary timing. The printing processing is thus started and the print image can be printed based on the print image data. In other words, the operating procedures to the printing can be arbitrarily selected by the user.

Regarding the method of preparing a label by the tape printing apparatus 1, a description will now be made about a typical example relating to the cutting function, with reference to a screen display on the display 4.

Figure 17:
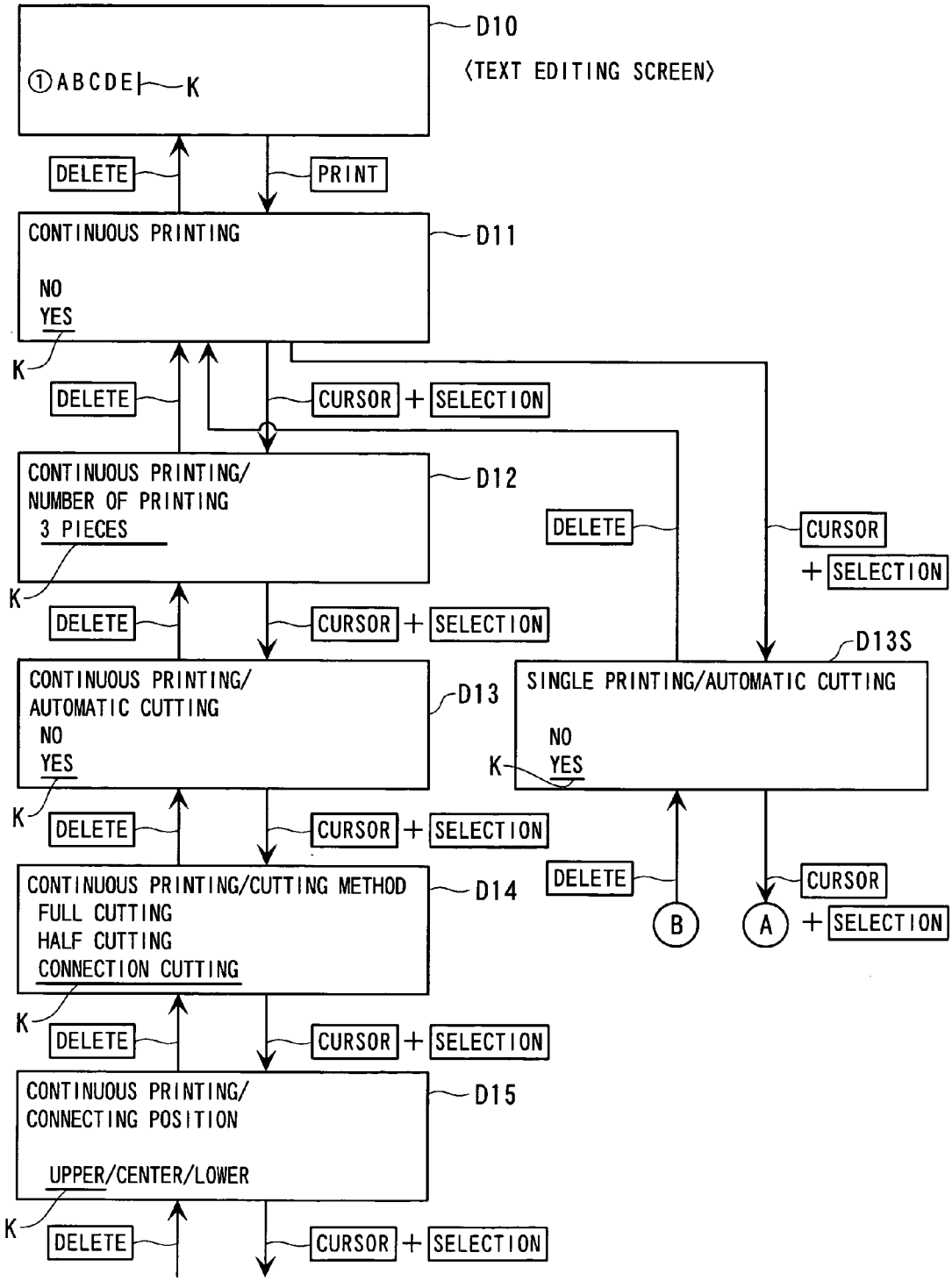
FIG. 17 is an explanatory view of a display screen and typical operations on the display screen showing an example when continuous printing is designated and connection cutting is designated in setting printing operations.

As shown in FIG. 17, in the text editing screen, when the character string "ABCDE" on the first line is inputted by the user, the illustrated display state appears (screen D10: hereinafter, the state of the display screen 41 is referred to by reference characters such as D10, D11, D12, etc., and description is made hereinafter only by reference to those reference characters). The mark ① on the screen shows that the text on the first line is being inputted. As a result, the text "ABCDE" as inputted by the user (corresponding character string image) is being displayed. The alphabet "E" has attached thereto a mark (cursor K) to indicate the cursor position.

In the following description, the term "single printing" means a single or independent printing to be made based on one text data (text file). Here, the character string "ABCDE" as displayed on the text editing screen is printed once (one unit print). On the other hand, the term "continuous printing" means a sequential or serial printing for the plural times (plural unit prints). In the example in FIG. 19A, three times of printing (three unit prints) made up of print images G11–G13 are illustrated.

As shown in FIG. 17, when the printing key is depressed or operated by the user in the state (D10) of displaying the text editing screen, a screen for selection of presence of absence of "continuous printing" is displayed (D11). In the tape printing apparatus 1, the user can delete various commands by the key input by pushing a delete key. By pushing the delete key in the above-described state (D11), it is possible to return to the original state (D10) of displaying the text editing screen. The same applies to the following and description thereof is omitted.

On the above-described selected screen (D11), an option of "Yes" and "No" is displayed. The user can select and designate one out of the options by operating the cursor.

For example, if cursor key "↓ or →" is pushed once in a state in which "No" is designated (hereinafter referred to as "selection display"), the screen changes to the state in which "Yes" is selected and displayed. If the cursor key n or "↑ or ←" is pushed once, a state appears in which "Yes" has been selected and displayed. If the cursor key "↑ or ←" is pushed in this state, "No" is selected and displayed. If a selection key is pushed in a state in which "No" has been selected and displayed, a selection is made not to execute continuous printing, i.e., instead of the continuous printing, a single printing is selected. The screen transfers to the operating screen in the lower hierarchy (layer) of the single printing.

Here, it is assumed that the selection key is pushed in a state in which "Yes" is selected and displayed (D11). Then, "Yes" in "continuous printing" is selected and transfers to the operating screen (here, input screen) of the lower hierarchy in the "continuous printing" and urges the inputting of the "number of printing" by the cursor K. If "3" is inputted (D12) by the cursor in this state, the screen transfers to the operating screen in the still lower hierarchy (here, selection screen or selecting screen). On this selection screen, display is made as to whether "automatic cutting" is selected ("Yes") or not ("No") (D13).

Here, if "Yes" is selected and displayed (D13) and selection key is pushed, selection is made of "Yes" in "automatic cutting" in "continuous printing." Then, the screen transfers to the operating screen of the lower hierarchy. Among the "cutting method" of "automatic cutting" in "continuous printing," there are displayed options (alternatives) in the form of "full cutting", "half cutting", "continuous cutting," or the like (D14). On this selection screen (D14), the cutting method on the way of the "continuous printing" can be selected (hereinafter referred to as "an intermediate cutting"). The cutting after the last print image (hereinafter referred to as "final cutting") shall be "full cutting."

If the "continuous cutting" is selected as it is (D14), the screen transfers to an operating screen of a further lower hierarchy (here, selection screen). As the "connecting position" (position of the connecting position Tar in FIGS. 14 and 15, or the like) of the "connection cutting" among the "automatic cutting" of the "continuous printing," options of "upper", "center", and "lower" are displayed (D15: see FIGS. 17 and 18). Among them, the option of "upper" shows the "upper-side connection cutting" (FIGS. 15A and 15B), the option of "center" shows the "center connection cutting" (FIG. 15D), and the option of "lower" shows "lower-side connection cutting" (FIG. 15C).

Figure 18:
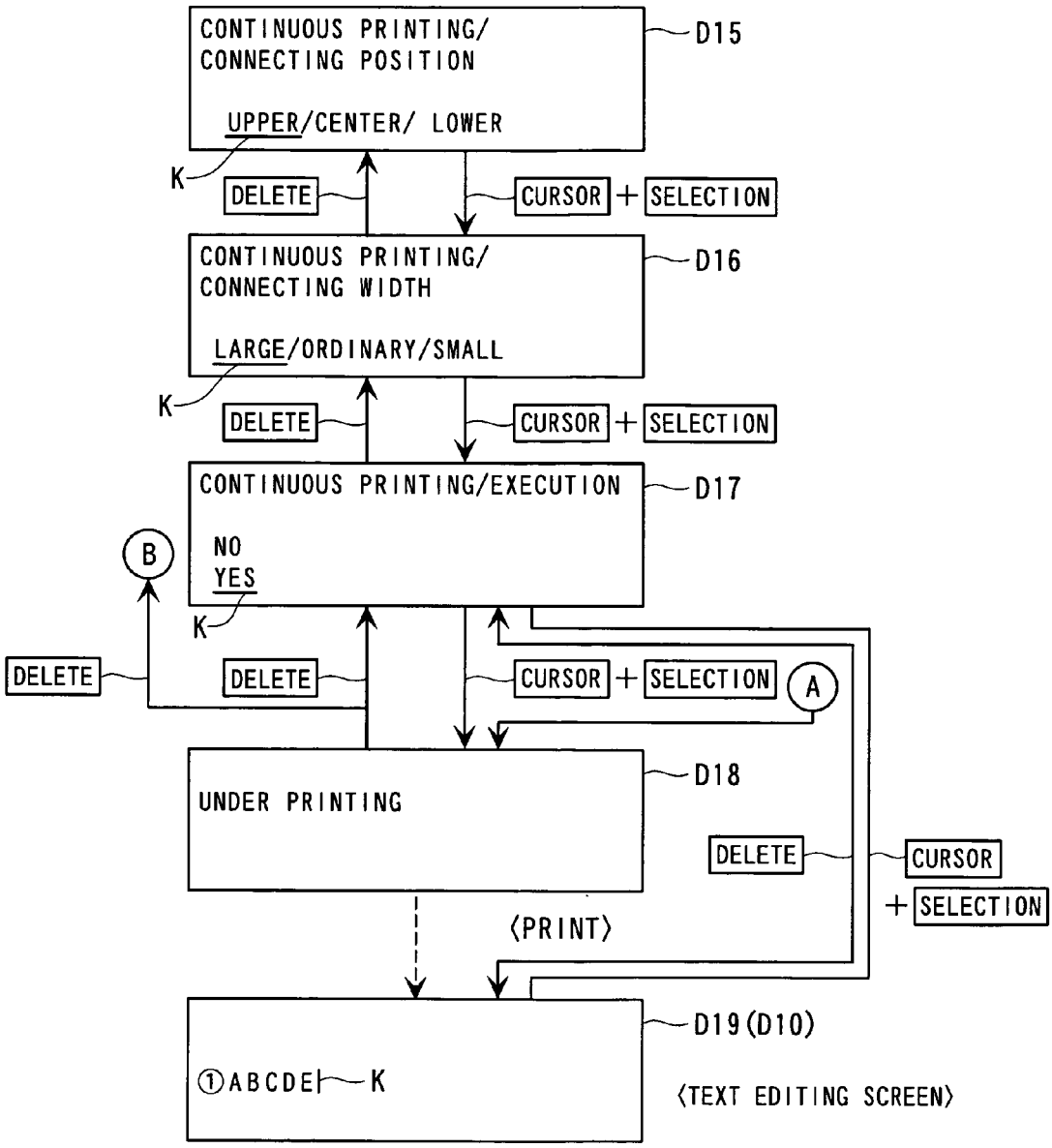
FIG. 18 is an explanatory view of those operations similar to those in FIG. 17 which follow the operations in FIG. 17.

If the "upper" is selected on the selection screen (D15) as shown in FIG. 18, the procedure or program transfers to an operation screen (here, the selection screen) of a lower hierarchy. In this lower hierarchy, there are displayed options of "large", "ordinary," and "small" as a "connection width or connecting width" (size in the tape-width direction at connection portion Tar) of the "continuous cutting" in the "continuous printing" (D16). This is the setting of that amount in the widthwise direction of the tape which is to be left as the connection portion in the "upper-side connection cutting." Depending on the options of "large", "ordinary," and "small," the width of connection (conversely, the width of cutting) is adjusted (FIGS. 20A–20C and 27).

If "ordinary" is selected as it is (D16), the procedure transfers to the next operation screen (here, the selection screen), and there is displayed an option as to whether the "continuous printing" shall be executed or not, i.e., an option of "Yes" or "No" in "execution" of "continuous printing" (D17).

Figure 19A:
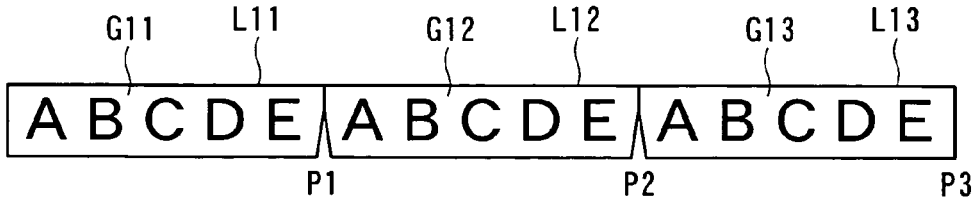
FIGS. 19A–19D are explanatory views of an example of labels showing the result of printing when the connection cutting is designated in the continuous printing, as well as the result of cutting and separation.
Figure 19B:
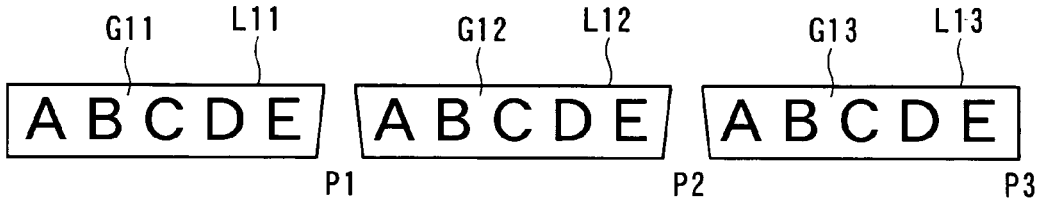

If "No" is selected (D17), the procedure returns to the original text editing screen (D19; same as D10). If "Yes" is selected as it is (D17), a message of "under printing (or in the course of printing)" is displayed and, as shown in FIG. 19A, three sets of print images G11–G13 each made up of letters "ABCDE" are continuously printed in sequence. The cut positions P1, P2 which correspond to the borders between respective adjoining sets of print images are subjected to the above-described "upper-side connection cutting." After this cutting is finished, the procedure returns to the original text editing screen (D19). Then, as shown in FIG. 19B, each label L11–L13 can be easily cut off when necessary.

If "No" is selected (D11 in FIG. 17) in the option of "continuous printing", on the other hand (i.e., "single printing" is selected), the procedure transfers to the operating screen (selection screen) of the lower hierarchy in "single printing." On this selection screen, a display is made of an option as to whether "automatic cutting" is made ("Yes") or not ("No") (D13S). If any one of them is selected here, after setting it, a display of message "under printing" is made and a character string image made up of a character string "ABCDE" is printed as a print image of single printing (D18 in FIG. 18). Once the printing is finished, the procedure returns to the original text editing screen (D19; same as D10).

As described hereinabove, in a state as shown in FIG. 19A right after the printing by "continuous printing," each of the labels L11–L13 is connected at the connection portions and is not cut off. The labels are therefore not separated from each other and are thus free from troubles such as collecting together the scattered labels. In this manner, if the labels are not immediately used, they can be kept in a lump (or as a single group of labels), resulting in easier handling and management. On the other hand, if each of the labels must be separated from each other, since they are connected together only at the connection portions, they can be easily separated into pieces with hands. It is therefore not necessary to use a tool such as a pair of scissors, or the like, for separating them.

Namely, a plurality of print images G11–G13 can be continuously printed on the tape T, and each of the labels L11–L13 of the respective print images G11–G13 can be managed either in a lump or separately (or individually). Further, by subjecting the space between each of the labels not only to full cutting (fc in FIG. 14A), but also to half cutting (ha in FIG. 15A) in combination, only the release tape Ta need be separated. In addition, since the end of each label (end of the base tape Tb) is cut in a neat manner by half cutting, the label has a good aesthetic appearance.

The widthwise position of the connection portion can be selected as the "connecting position" in a menu style out of a plurality of options such as the illustrated "upper" (upper-side connection: end portion in the widthwise direction), the "lower" (lower-side connection: the opposite end), and "center" (center connection: center portion), or the like. Therefore, each of the labels on which the print images are printed on the tape can be obtained in a state in which they are connected at a desired connecting position which is arbitrarily and easily selected from these plurality of options. In the above-described example, the "upper-side connection" has been illustrated ("upper" has been selected in D15). Needless to say, "center connection" (by selecting "center") or "lower-side connection" (by selecting "lower") similarly functions to manufacture each of the labels L11–L13 in a manner easily manageable either in a lump or separately.

Still furthermore, since the widthwise length of the connection portion can be selected out of a plurality of options such as "large", "ordinary," and "small" as connection width in a menu style, the connecting length can be easily and arbitrarily selected to suit the conditions such as the ease with which the label can be separated, or the like. There can thus be obtained a tape on which is printed each of the print images to serve as each of the labels in a state of being connected with a desired connection width.

Furthermore, since the cutting method can be selected as the cutting command in a menu style out of a plurality of options such as "half cutting" (half-cutting command), "full cutting" (full-cutting command), "connection cutting" (connection cutting command), or the like, the cutting command to command the cutting method can be easily and arbitrarily selected depending on how the printed tape is used. As a result, there can be obtained a tape having printed the print image, in a state being cut according to the desired cutting method. In addition, since it is also possible to select out of the conventional "half cutting" and the "full cutting," it is compatible with the conventional type of apparatuses, resulting in an ease of use by the user of the conventional apparatus.

The selection screen (D14) in the above-described cutting method is to select the cutting method for the center-cutting method, and the final cutting is arranged to be "full cutting." However, the final cutting may also be arranged to be selectable by providing a similar selection screen. In addition, the selection of the cutting method in this final cutting may be arranged to be in common with the selection of the cutting method of the "single cutting."

In this case, if a selection is made not to make the "continuous printing" ("No" for "continuous cutting") (D11), instead of the selection screen (D13S) for "automatic cutting" in the "single printing," a selection screen of "automatic cutting after final printing" (hereinafter called as "final automatic cutting") is displayed. After selecting and setting one of them, a display is made of "under printing" and the print image of "ABCDE" is printed. After executing the set "final cutting," the procedure returns to the original text editing screen (D19). When the "continuous printing" is selected to be executed ("Yes" for "execution" of "continuous printing") (D17), the above-described selection screen for "final automatic cutting" is commonly displayed so that either of "No" and "Yes" can be selected and set. In this case, subsequent to the display of "under printing," "continuous printing" of the three print images G11–G13 and "continuous cutting" and set "final cutting" are executed (D18), the procedure returns to the original text editing screen (D19).

In the above-described example, various settings and execution (performance) of "continuous printing" are arranged to be started (processing is started) by pushing the same key as that for the "single printing." It may also be arranged that "continuous printing" is started by providing, e.g., a continuous printing key, or the like, independent of the "continuous printing." Furthermore, various settings of the "continuous printing" may be separately started by an independent key independent of the key for execution thereof (e.g., continuous printing key and continuous printing execution key).

Still furthermore, in the above-described example, only one print image as displayed on the text editing screen is designated, as an object of continuous printing, to be printed in a plurality of printing sheets (three in the above example) so that the same print image (e.g., the above-described "ABCDE") can be printed continuously. Therefore, this example can be utilized for preparing the same label in a large number in a lump. Alternatively, the label may be arranged to be of different specification.

Figure 19C:
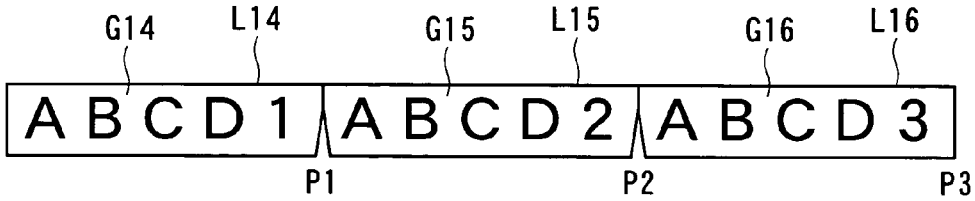
Figure 19D:
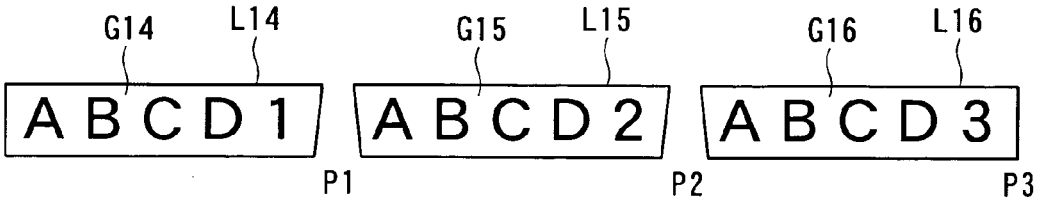

In case a numeral is contained in a character string like "ABCD1," the specification of "continuous printing" may be arranged to be printed by sequentially changing the numeral such as the three print images G14–G16 of "ABCD1," "ABCD2," and "ABCD3" as shown in FIG. 19C. Alternatively, a new function may be set in the name of "serial number printing," or the like, as a different type of "continuous printing." In this case, as shown in FIG. 19D, the printed tape can also be easily separated as labels L14–L16 depending on the necessity. It is also possible to adjust the connection width (cutting width) to "large", "ordinary," and "small" (FIGS. 20D–20F).

Further, the specification of the "continuous printing" can be arranged to be a continuous printing of a plurality of print images to be printed based on a plurality of text data. Otherwise, as a different type of "continuous printing," a new function may be provided in the name of "group printing," or the like. In this case, "ABCDE," "ABCDE," and "ABCDE" are group-wise registered in advance as three sets in the same group. Then, by giving a command to execute this kind of continuous printing (group printing), the printing as shown in FIG. 19A is possible. If three sets of "ABCD1," "ABCD2," and "ABCD3" are registered, the printing can be made as shown in FIG. 19C, so that it can be used for general purpose.

Figure 24A:
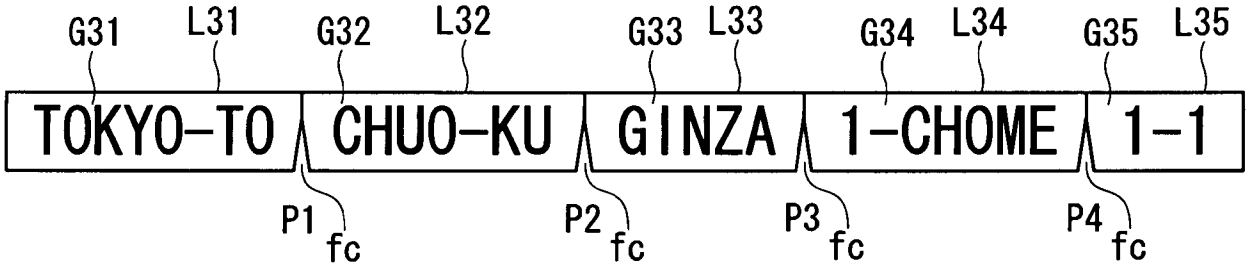
FIGS. 24A and 24B are explanatory views, similar to those in FIGS. 19A–19D and 22A–22F, of an example of printing continuously related print images.
Figure 25A:
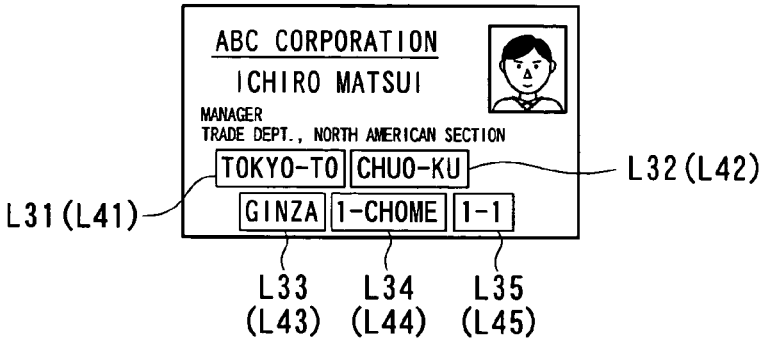
FIGS. 25A–25C are explanatory views of an example of printing each of labels in FIGS. 22A–22F on a name card, post card, and envelope, respectively.
Figure 25B:
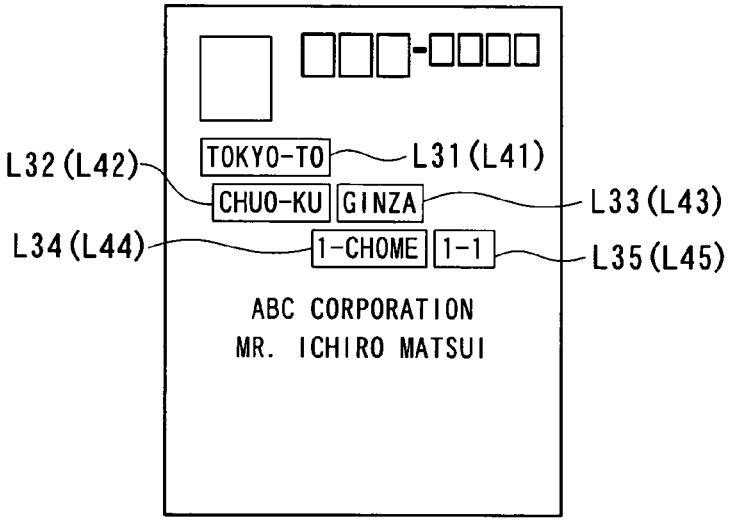
Figure 25C:
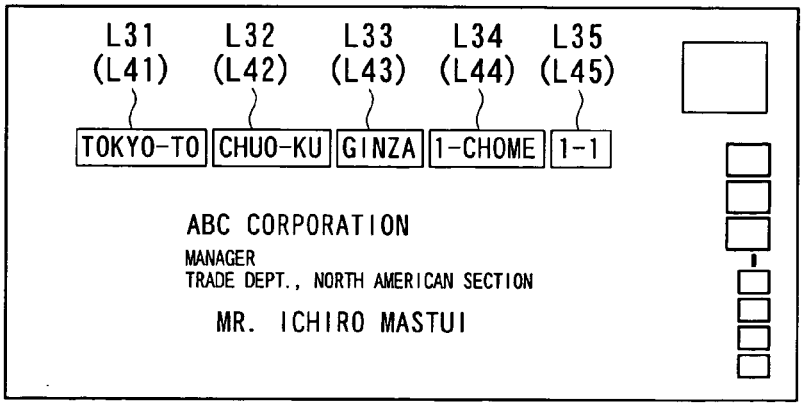

In the specification of this "group printing," in response to a large number of printing pages, the character strings as registered in the same group can be printed from the front end in sequence (or in a command to circulate) for the number of designated pages. In the case of specification for "group printing," as shown in FIGS. 24A and 25, a series of address descriptions (segments) such as "Tokyo-to," "Chuo-ku," "Ginza," "1-chome," "1—1" or the like, are registered in the same group so that they can be continuously printed as print images G31–G35. When each of the labels G31–G35 is attached or adhered, the arrangement, or the like, of each line can be arbitrarily adjusted (e.g., depending on the size to which the labels are adhered, such as a name card, post card, envelope, or the like) (see FIGS. 25A–25C). Aside from the above, the name, title, section name, or the like, may also be included. Furthermore, in this specification, the connection width (cutting width) can be adjusted (see FIG. 27). (Note: The address is represented here in the order of the Japanese own style instead of a European style of "1—1, Ginza 1-chome, Chuo-ku, Tokyo-to.")

The above-described method of label manufacturing of the tape printing apparatus 1 is applicable as a program to be processed in a tape printing apparatus 1 that can be processed by a program. It is also applicable to a memory medium such as a compact disc (CD), or the like, for storing therein such a program. By storing this kind of program and reading it out of the memory medium for execution, a plurality of print images can be continuously printed on the tape. Each of the labels of respective print images can be manufactured in a manner to be managed in a lump or individually. Alterations may be made within the scope of this invention.

If half cutting is combined in the cutting of the connection portions as described above, each of the labels can be formed in a neat manner. However, when a fact is considered that the connection portions are torn off by hands, the release tape Ta side will sometimes be deformed by being roughly torn off. In such a case, the release tape Ta which covers the end portions of each label will be missing or lost.

As a solution, a description will now be made, as a second embodiment, about a method of manufacturing a label in which, even if the connection portions are roughly torn off, the release tape Ta which covers the print image printed on the base tape Tb (i.e., the portion to form the label) is prevented from missing or is reduced in the degree of loss.

In the tape printing apparatus 1 of this second embodiment, between a plurality of print images in the continuous printing, a second connection cutting is performed (hereinafter referred to as a "complex cutting") which is different from the above-described "connection cutting" in which a connection portion is simply left or reserved. The method of manufacturing a label according to this "complex cutting" executes printing while leaving or securing a predetermined space or blank between respective sets of the print images. "Connection cutting" is then executed on the blank by the above-described full cutting fc (half cutting hc need not be accompanied). Further, to the end of each of the print images (i.e., to both the ends of the above-described blank, or to each of the borders between the respective print images and the blanks), half cutting hc is executed (see FIG. 22).

Figure 21:
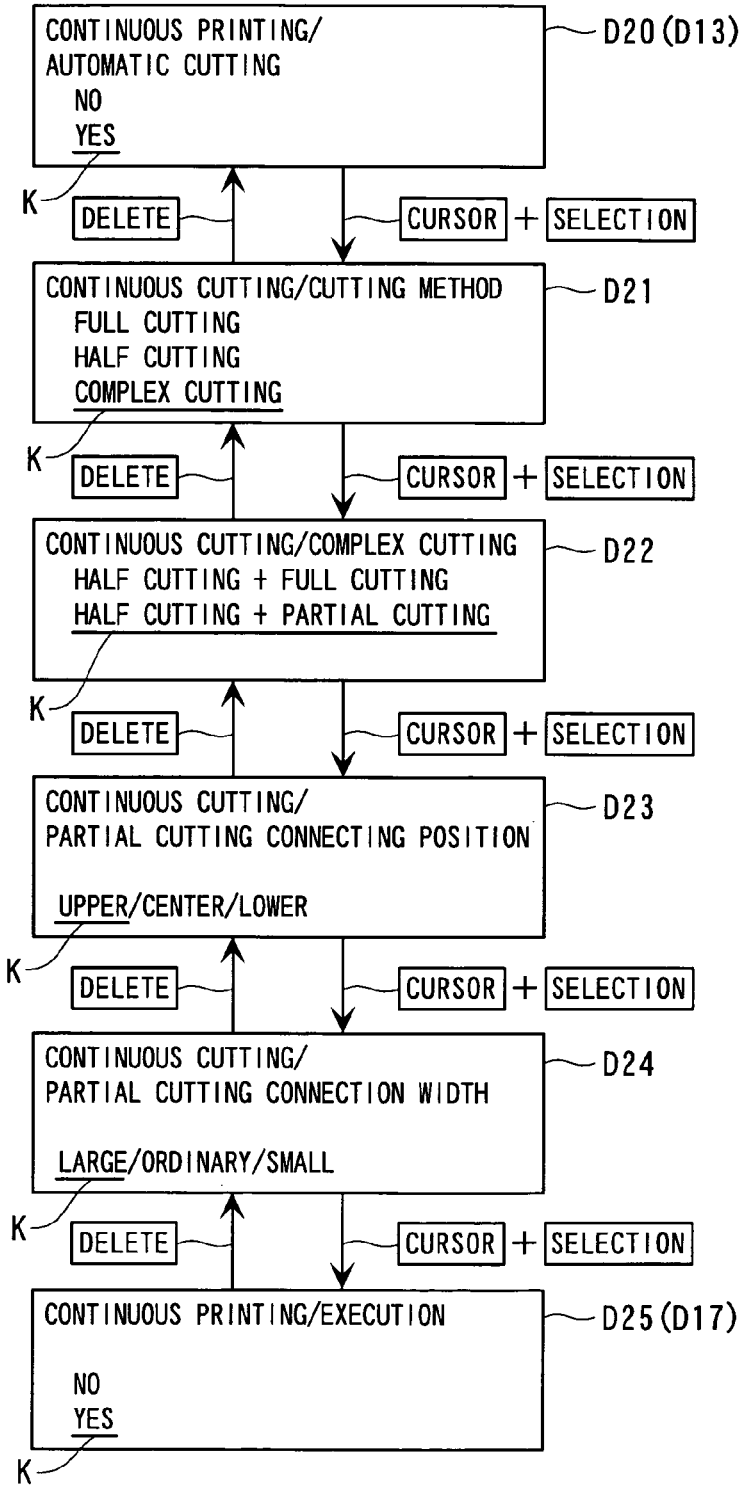
FIG. 21 is an explanatory view, similar to those in FIGS. 17 and 18, of operations for performing complex cutting in case continuous printing is designated as a second embodiment.

As shown in FIG. 21, according to this embodiment, the following steps are taken. Namely, on a selection screen of "automatic cutting" in "continuous printing" (D20: same as D13 in FIG. 17; processing in D10–D13 are also the same), if a selection is made to execute the automatic cutting ("Yes" for "automatic cutting": D20), like in the first embodiment, the procedure transfers to the operating screen (here, selection screen) in the lower hierarchy, and an option of "full cutting," "half cutting," and "complex cutting" is displayed as the "cutting method" of "automatic cutting" in the "continuous printing."

On this selection screen (D21), it is assumed that a cutting method of center cutting is also selected. As the final cutting, the full cutting may be fixedly selected like in the first embodiment or a selection screen may alternatively be added so as to allow for selection out of options. It may alternatively be so arranged that a single cutting is selectable. The procedure of not executing the continuous cutting (i.e., the single cutting is selected like in D11 in FIG. 17) is the same as that in the first embodiment.

If the "complex cutting" is selected here (D21), the procedure then transfers to the selection screen of the lower hierarchy. As the kind of "complex cutting," there are displayed "half cutting+full cutting" (see FIG. 4D), "half cutting+partial cutting" (FIGS. 22A–22C), or the like (D22).

Among them, the latter option of "half cutting+partial cutting" is the option showing the features of this embodiment. If the "half cutting+partial cutting" is selected (D22), the procedure then transfers to the selection screen of the lower hierarchy. There are displayed options of "upper," "center," and "lower," or the like, as options of the "cutting position" ("partial-cutting connecting position") like in the first embodiment (D23). Options "upper," "center," and "lower" show "upper-side connection," "center connection," and "lower-side connection," respectively.

Figure 22A:
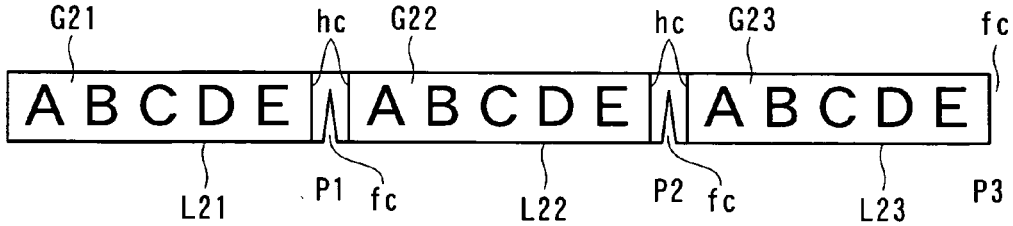
FIGS. 22A–22F are explanatory views of an example of each of labels showing the result of printing when the complex cutting is designated in the continuous printing, as well as the result of cutting and separation.

If the "upper" is selected (D23), the procedure transfers to the selection screen of the lower hierarchy to display, as the "connection width" of the "partial cutting," options of "large," "ordinary," and "small" (D24: FIGS. 23A–23C and FIG. 27). Similarly, if "ordinary" is selected (D24), and if a selection is made to execute the continuous printing ("Yes" is selected in "execution" of "continuous printing": D25), a message of "under printing" is displayed and, as shown in FIG. 22A, the print images G21–G23 in the form of "ABCDE" are continuously printed in sequence. A "complex cutting" of the "upper-side connection" in which the upper side in the figure is constituted as a connection portion is executed in the cutting positions P1 and P2 which correspond to the border positions of each of the print images. Once they are finished, the procedure returns to the original text editing screen.

Figure 22B:
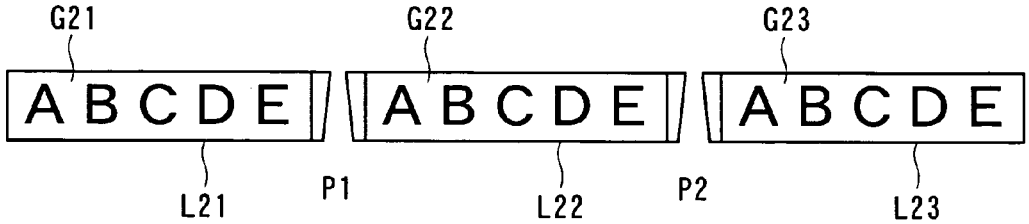
Figure 22C:
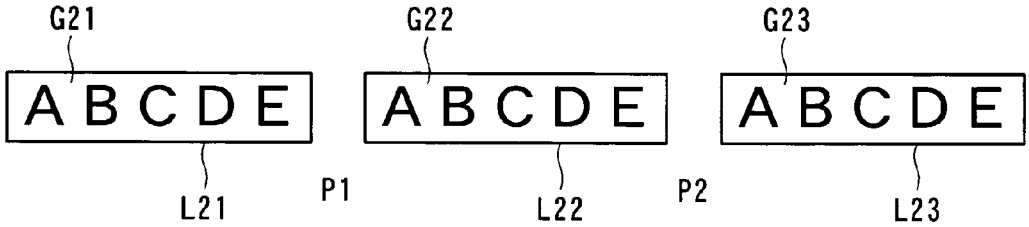

Thereafter, as shown in FIG. 22B, by tearing off each of the labels depending on the necessity, the release tape Ta can be easily separated at this stage while leaving sufficient blanks. As shown in FIG. 22C, each of the labels L21–L23 can be peeled off from the release tape Ta just before adhering.

As described above, in the state in FIG. 22A right after printing by "continuous printing," the labels are not torn off because they are connected together at the connection portions. Therefore, if they are not readily put to use, they can be easily kept in a lump. When they are to be separated from one another into independent labels L21–L23, they can be easily torn off by hands as shown in FIG. 22B because they are connected together only at the connection portions. In addition, since each of the labels have sufficient blanks in the release tape Ta, the release tape Ta can be separated without lacking or partially losing the release tape Ta that covers end portions of each of the labels. Still furthermore, since the tape has been subjected to half cutting, when they are attached to an object, only the labels can be easily released from the release tape Ta in a state, as shown in FIG. 22C, in which the end portions are cut in a neat manner to the better aesthetic appearance. In other words, a plurality of print images G21–G23 can be prepared such that each of the labels L21–L23 is suitable for keeping or handling both in a lump and individually.

This second embodiment has the same advantages as those in the first embodiment in that the various elements regarding the cutting such as "cutting method," "connecting position," and "connection width," etc. can be simply and arbitrarily selected in a menu style. Similarly, each of the labels L21–L23 can be managed in a lump or separately also when the "center connection" ("center" is selected) or when the "lower-side connection" ("lower" is selected) in the "connecting position," although they are not selected in the above description. Instead of using the same printing key as the "single printing," a separate key for continuous printing may also be provided so as to separately start "continuous printing." Otherwise, continuous printing operation may be started up separately by providing a continuous printing setting key and a continuous printing execution key.

Figure 22D:
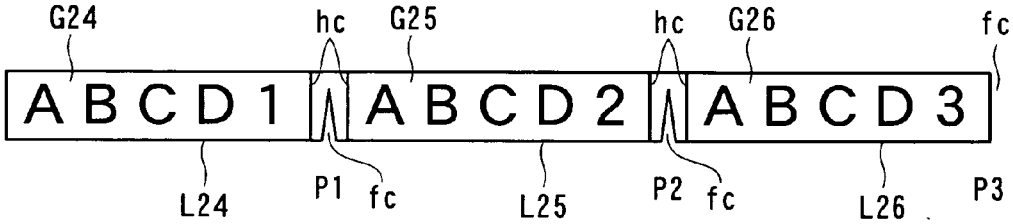
Figure 22E:
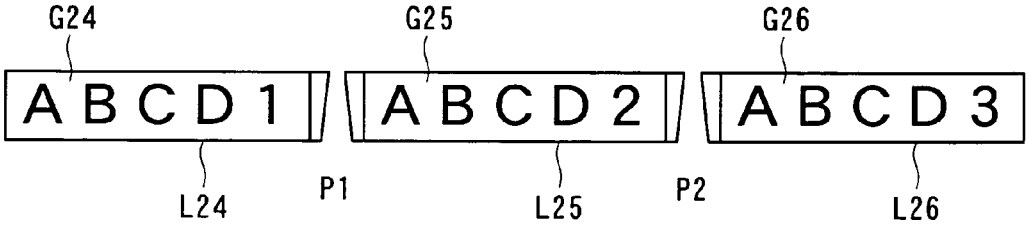
Figure 22F:
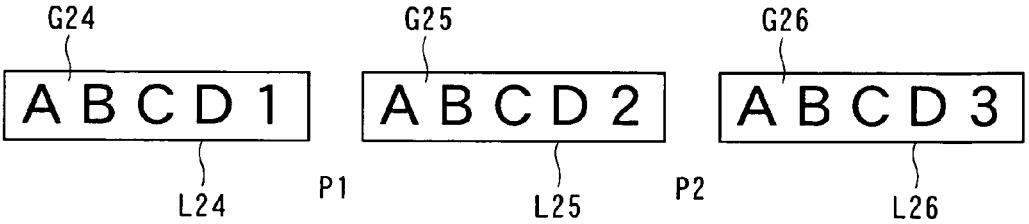
Figure 23A:
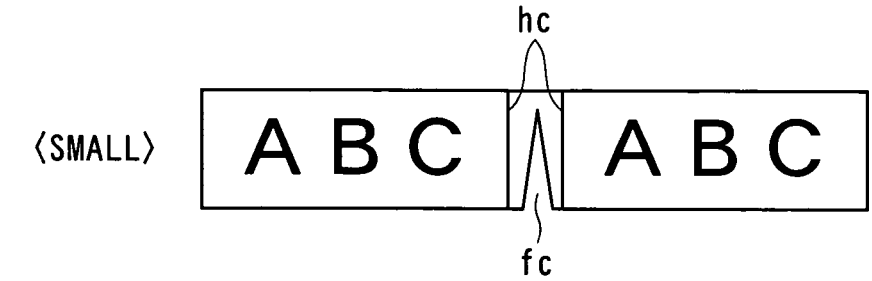
FIGS. 23A–23F are explanatory views of an example of each of labels showing the result of printing when the options of small, ordinary and large are designated in the continuous printing.
Figure 23B:
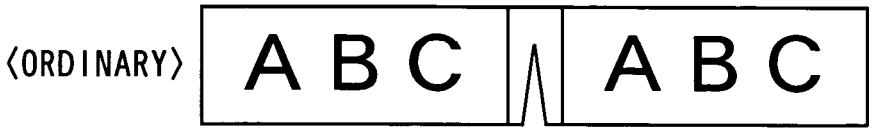
Figure 23C:
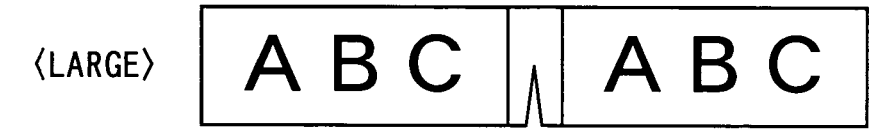
Figure 23D:
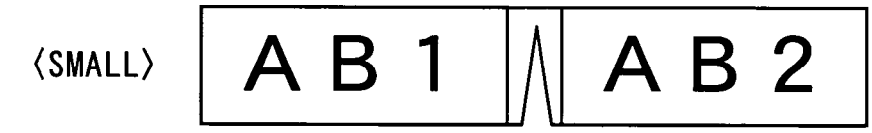
Figure 23E:
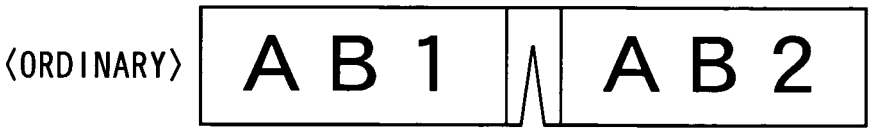
Figure 23F:
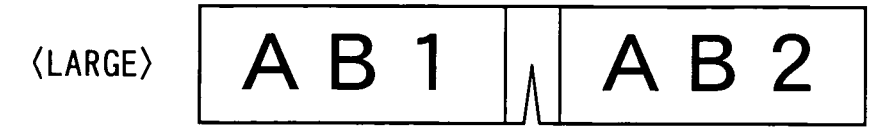
Figure 24B:
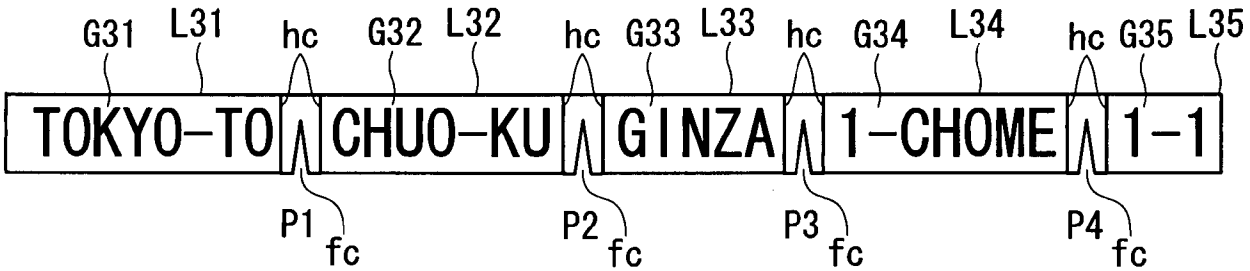

An arrangement may also be made to be of a specification of the "serial number printing" as described with reference to FIGS. 19C and 19D (see FIGS. 22D–22F). Or else, it may be made of a specification of the "group printing" as described hereinbefore so that a series of related print images (e.g., print images G31–G35 in FIG. 24B) such as an address, name, title, belonging department, or the like (hereinafter referred to as "address, or the like"), can be printed continuously so that the arrangement or allocation of each line, or the like, can be arbitrarily adjusted depending, e.g., on the size, or the like, of an article on which the label is to be attached, such as a name card, a post card, an envelope, or the like (see FIGS. 25A–25C).

Like in the above-described first embodiment, this method of label manufacturing is applicable to a program and to a memory medium for storing therein the program. By storing this kind of program and reading it out of the memory medium for execution, a plurality of print images can be continuously printed on the tape. Each of the labels of respective print images can be manufactured in a manner to be managed in a lump or individually.

Figure 26A:
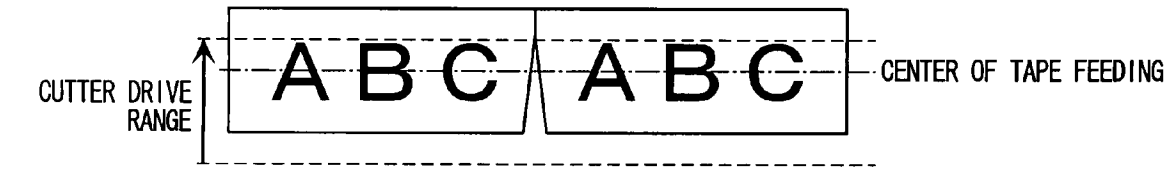
FIGS. 26A–26C are explanatory views showing the relationship between the tape width and the cutter drive range (or cutter driving range) in the connection cutting and complex cutting.
Figure 26B:
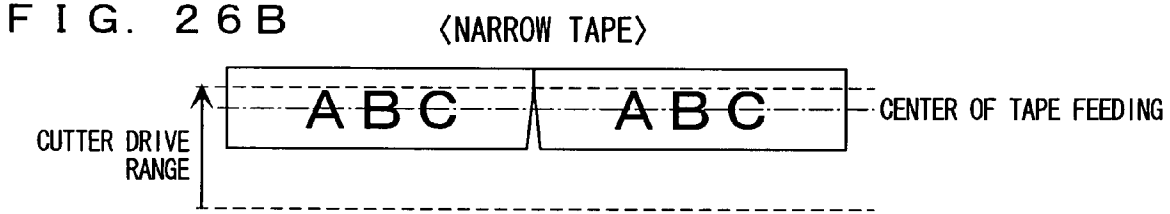
Figure 26C:
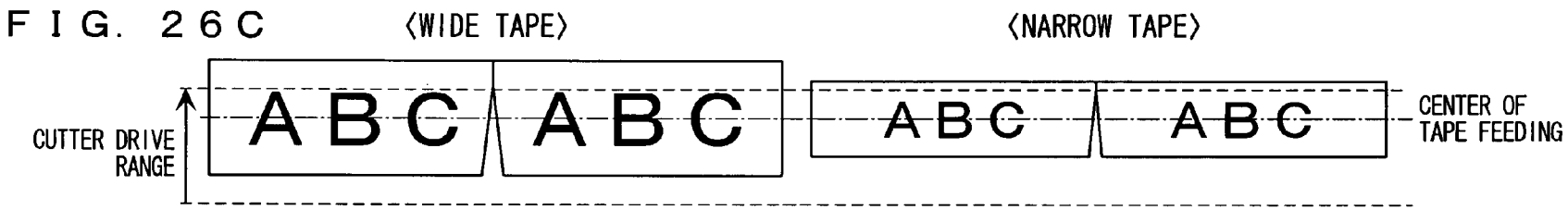

In the "connection cutting" of the above-described first embodiment and in the "complex cutting" of the above-described second embodiment, similar cutting cannot be applied to all of the tape widths, unlike the conventional full cutting. Namely, as shown in FIG. 26C, if the cutter drive width is arranged to be able to secure sufficient connection width for a wide tape, a connection width cannot be secured for a narrow tape any longer. On the other hand, if the cutter drive width is adapted to the narrow tape, the cutting width will become insufficient in the wide tape, resulting in a problem in that the printed tape cannot easily be torn off into respective individual labels.

In view of the above, a description will now be made about a third embodiment with reference to FIGS. 26A–26C and 28. This third embodiment relates to a method of manufacturing a label in which a label can be manufactured while leaving a connection portion of an adequate connection width by adjusting the amount of cutting in (cut-in or notch length: see FIG. 27). In the following description, the cutting while leaving the connection portion (hereinafter referred to as "notch-cutting") is defined to be the similar cutting to the "continuous cutting" in the "upper-side cutting" in the first embodiment.

Figure 29:
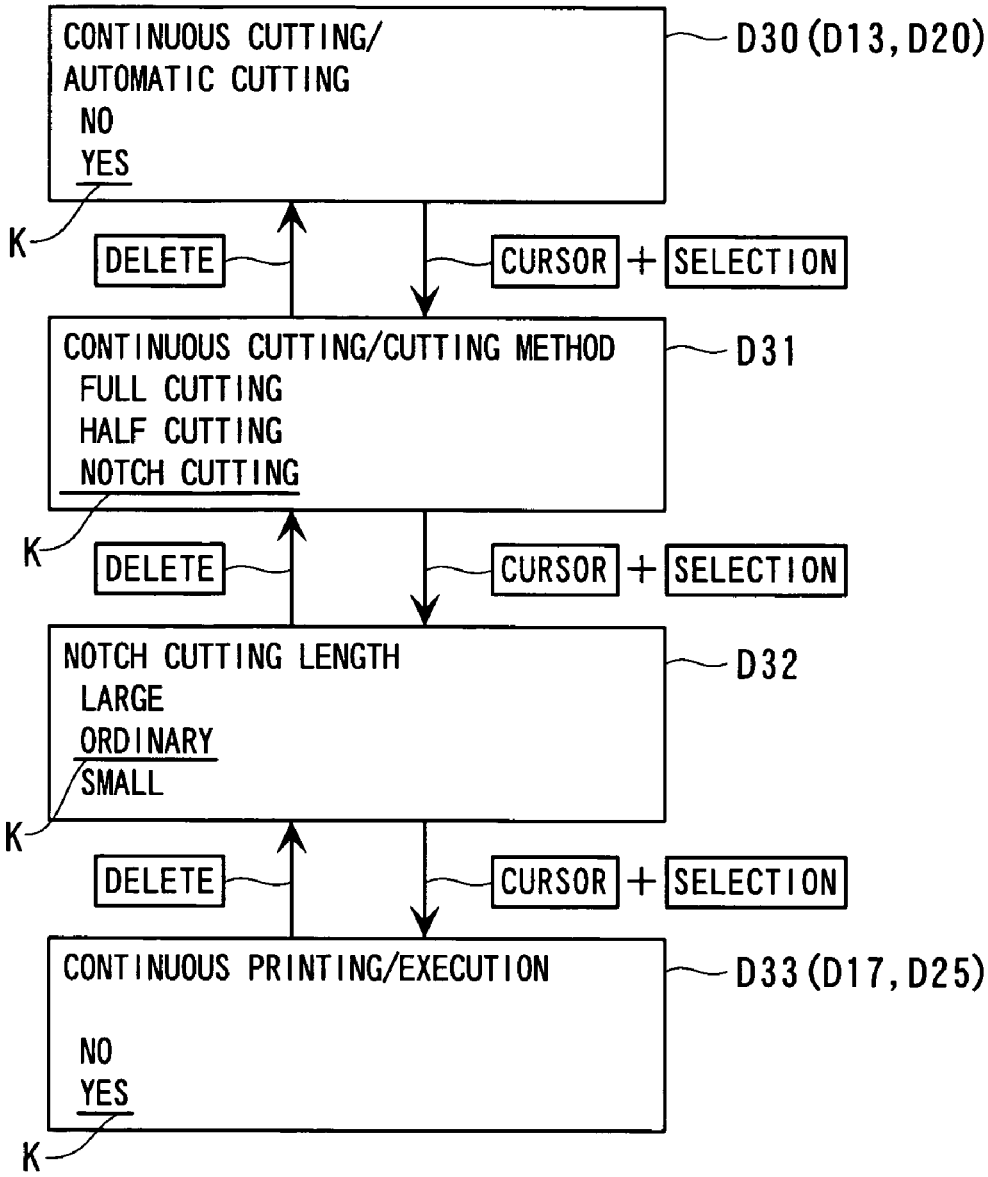
FIG. 29 is an explanatory view, similar to that in FIG. 21, showing an example of operations for performing notch cutting in case continuous printing is designated as a third embodiment.

In this embodiment, if "automatic cutting" is selected ("Yes" is selected) on a display screen for "continuous printing" as shown in FIG. 29 (D30: same as D13 in FIG. 17 and D20 in FIG. 21: the same applies to D10–D13), the procedure transfers to the selection screen in the lower hierarchy like in the previous embodiments. A selection screen of "full cutting," "half cutting," "notch-cutting," or the like, is displayed as the "cutting method" of "automatic cutting" in "continuous printing" (D31).

Figures 28A, 28B, 28C:
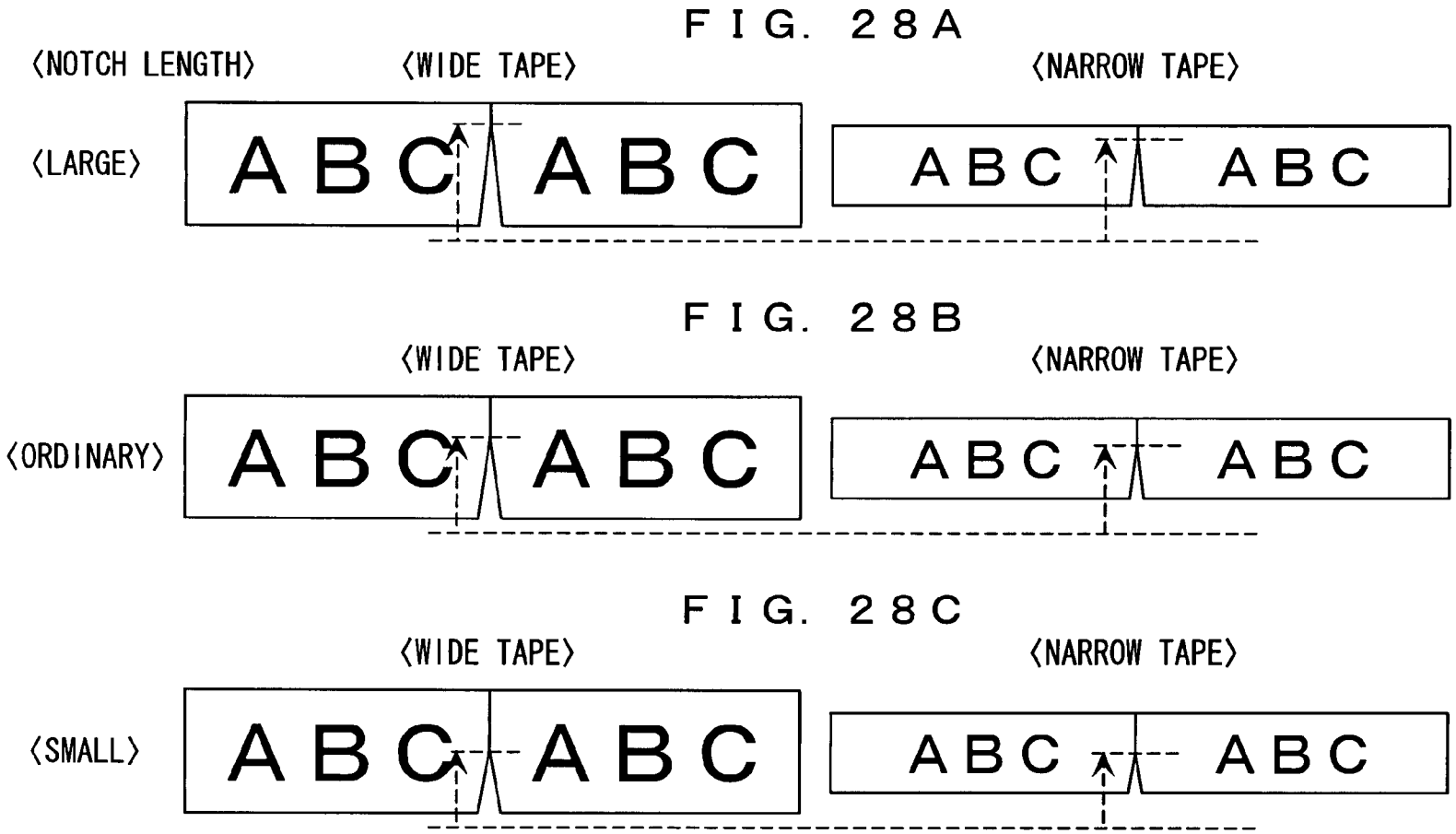
FIGS. 28A–28C are explanatory views showing the relationship between the notch length and the tape width in the case of connection notch-cutting according to the definition in table of FIG. 27.

If "notch-cutting" is selected (D31), the procedure transfers to the selection screen in the lower hierarchy, and an option of "large," "ordinary," "small," or the like, is displayed as the "cutting length" of the "notch-cutting" (D32: FIGS. 27 and 28A though 28C).

The option of the notch-cutting is not an option showing an absolute notch-cutting value based on the unit of the length but an option of a relative notch-cutting length showing a ratio to the full length of the tape width, such as relatively "large (or wide)," "ordinary," "small (or narrow)," or the like. Since it is not a concrete value, it is an option of an abstract notch-cutting length, and is defined as an absolute and concrete notch-cutting length as a result of combination of each of the tapes (see FIG. 27).

If "ordinary" is selected (D32), the tape printing apparatus 1 recognizes the kind of the tape by means of the tape recognition sensor 141 (see FIG. 3). Depending on the tape width of the kind, a cutter drive range setting table (see FIG. 27) inside the ROM 220 is searched. A cutter drive range of "ordinary" notch-cutting length corresponding to the tape width is set, and the procedure transfers to the selection screen of the lower hierarchy (D33).

If the "continuous printing" is selected to be executed ("Yes" is selected for "execution" of "continuous printing") (D33: same as D17 in FIG. 18 and D25 in FIG. 21: the same applies to D18 and D19), a display is made of "under printing" and the above-described print images G21–G23 of "ABCDE" are printed in sequence for three times continuously (see FIG. 19A). Cut positions P1, P2 are subjected to the "notch-cutting" of "upper-side connection." Upon completion of the above, the procedure returns to the original text editing screen.

Like in the first embodiment, in the state right after the printing as shown in FIG. 19A, the labels are connected together at the connection portions and are not separated from one another. Therefore, they can be easily managed in a lump. In addition, since they are connected together only at the connection portions, they can be easily separated by tearing off by hands as shown in FIG. 19B and are easily adhered to an object. Furthermore, in this embodiment, since the tape width is detected and the cutter drive range is set depending on the detected result, cutting can be executed, as shown in FIGS. 27 and 28, by leaving a connection portion of an adequate connection width depending on the tape width. In other words, a plurality of print images are continuously printed on the tape and each of the labels of the respective print images can be manufactured in a manner easily managed in a lump or separately depending on the tape width.

On the selection screen (D31) for the above-described cutting method, it is presumed that the cutting method for the center cutting is selected. The final cutting may be fixed to "full cutting" as in the above-described embodiments or may be made to be selectable by providing a selection screen. Or else, it may be used in common with the selection of the cutting method of "single cutting." If a selection is made not to execute the "continuous printing" (i.e., "single printing" is made) (D11 in FIG. 17), the procedure is the same as that in the first embodiment.

The "connecting position" in the above "notch-cutting" is selected to be "upper-side connection." It may also be arranged to be selectable from "upper-side connection," "center connection," and "lower-side connection" out of options of "upper," "center," and "lower" like in the above-described embodiments. In both the "center connection" and "lower-side connection, each of the labels of the respective print images can be manufactured in a manner easily managed in a lump or individually. The advantages of arranging the various elements relating to the cutting such as "cutting method" and "connecting position" to be selectable in a menu style are the same as those in each of the above-described embodiments. The "single printing," "continuous printing," "continuous printing execution," or the like, may be started up by using separate keys. In addition, the specification may be arranged to be like the one of "serial number printing" (see FIGS. 19C–19D and FIGS. 22D–22E), or like the one of "group printing" (see FIGS. 24 and 25).

Like in the above-described embodiments, this method of label manufacturing is applicable to a program and to a memory medium for storing therein the program. By storing this kind of program and reading it out of the memory medium for execution, a plurality of print images can be continuously printed on the tape. Each of the labels of respective print images can be manufactured in a manner to be managed in a lump or individually.

The above-described "notch-cutting" is adapted to the "connection cutting" of the first embodiment. It may, however, be arranged to be similar to the "complex cutting" in the second embodiment in which a predetermined blank is provided between each of the print images so as to combine with half cutting. Furthermore, they may be arranged to be selectable. Still furthermore, the "connection cutting" with an adjustment in the notch-cutting depending on the tape width or "complex cutting" may be arranged to be, e.g., "connection notch-cutting" or "complex notch-cutting", or the like, so as to make them selectable independent of the original "connection cutting" or "complex cutting."

A description will now be made about a method of label manufacturing according to a fourth embodiment in which the above-described "connection notch-cutting," "complex notch-cutting," or the like, is employed as the "connection cutting" or "complex cutting" so that the "full cutting," "half cutting," or the like, is selectable.

Figure 30:
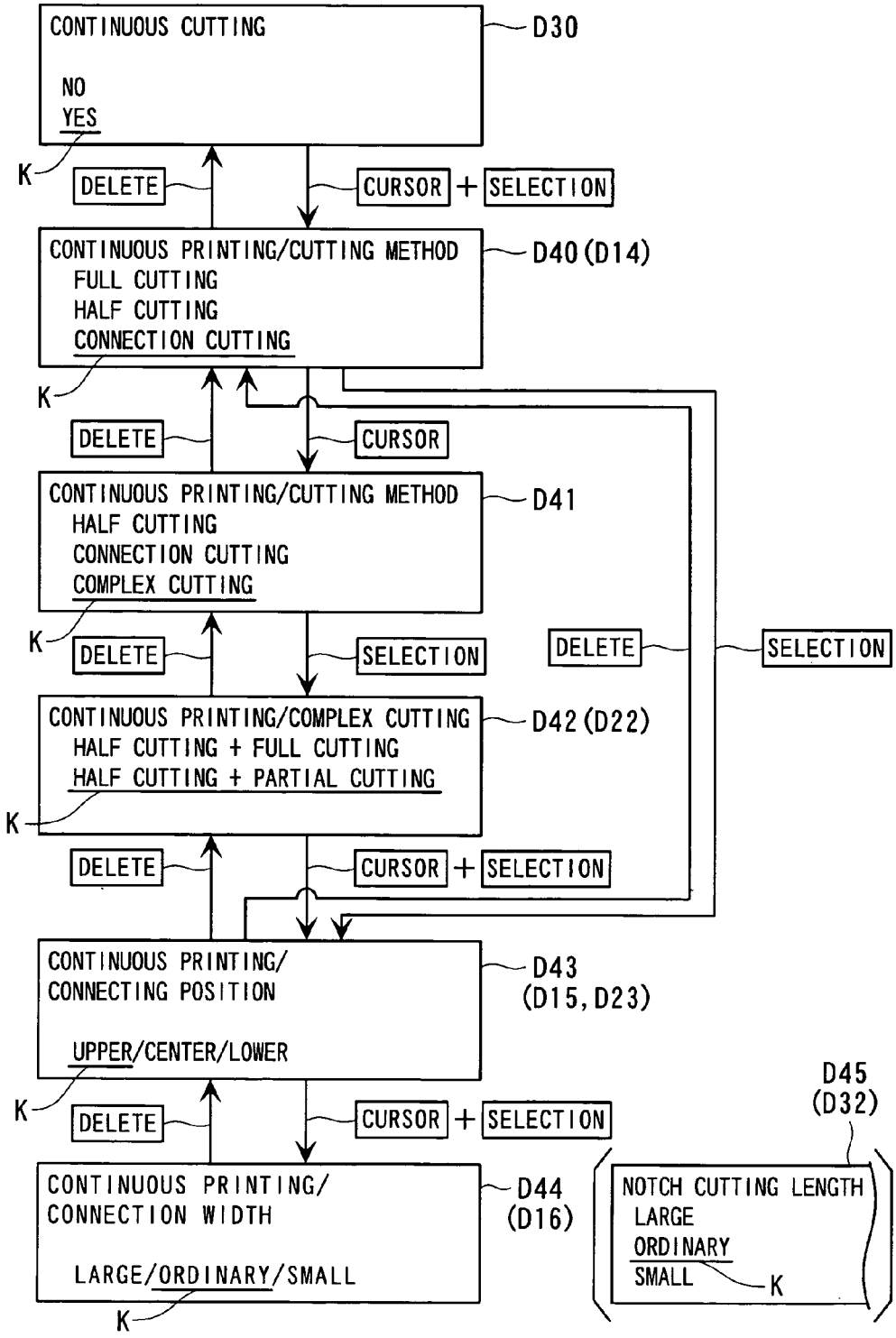
FIG. 30 is an explanatory view, similar to that in FIG. 21, showing an example in which complex (notch) cutting can be designated in performing continuous cutting as a fourth embodiment.

In this embodiment, if the "automatic cutting" in the "continuous printing" is selected ("Yes" is selected) on the selection screen as shown in FIG. 30 (D30: same as in FIG. 29), the procedure transfers to the selection screen of the lower hierarchy, and an option such as "full cutting," "half cutting," "connection cutting," "complex cutting," or the like, is displayed as the "cutting method" of the "automatic cutting" in the "continuous printing" (D40 and D41).

Namely, in this embodiment, one of the following can be selected as the cutting method of the center cutting: i.e., "full cutting" in which the entire width of the tape width is cut off (full cut) without securing the connection portion; "half cutting" in which only the base tape Tb is cut, although over the entire width; "connection cutting" (above-described "connection notch-cutting") in which a plurality of print images are printed without securing blanks therebetween, and the borders of the print images are cut while leaving the connection portions (here, the notch-cutting length is adjusted depending on the tape width); and "complex cutting" (above-described "complex notch-cutting") in which printing is made while providing predetermined blanks among print images and the blanks are then subjected to the above-described "connection cutting" and in which the ends (i.e., the borders between each of the print images and the blanks) are subjected to half cutting.

As the final cutting, the full cutting may be fixedly selected like in each of the above-described embodiments or a selection screen may alternatively be added so as to be selectable from options. It may alternatively be so arranged that a single cutting is selectable. The procedure of not executing the continuous cutting (i.e., the single cutting is selected like in D11 in FIG. 17) is the same as that in each of the above-described embodiments.

If "complex cutting" is selected (D41) after operating the cursor from the state of the above-described selection screen (D40), like in the second embodiment, the procedure transfers to the selection screen of the lower hierarchy. As a kind of the "complex cutting," options are displayed such as "half cutting+full cutting" (see FIG. 4D), "half cutting+partial cutting" (see FIGS. 22A–22F), or the like. If the "half cutting+partial cutting" is selected here (D42: same as D22 in FIG. 21), the procedure transfers to the selection screen of further lower hierarchy. As the "connecting position," an option is displayed of "upper," "center," "lower," or the like (D43: same as D15 in FIG. 18 and D23 in FIG. 21). The options of "upper," "center," and "lower" means "upper-side connection," "center connection," and "lower-side connection," respectively.

If the "upper" is selected (D43), the procedure transfers to the selection screen of the lower hierarchy, and display is made of "large," "ordinary," small," or the like, as the "connection width" of the "partial cutting" (D44: same as D16 in FIG. 18: the subsequent display and operation are the same as D17–D19).

The "connection cutting" and "complex cutting" in this embodiment are the "connection notch-cutting" and "complex notch-cutting" with adjustment in the notch amount depending on the respective tape widths. Therefore, the options of "large," "ordinary," and "small" in the "connection width" are defined in the cutter drive range as shown in FIG. 27. If, e.g., "ordinary" is selected (D44), the cutter drive range setting table is searched depending on the tape width corresponding to the detected kind of the tape, so that the corresponding cutter drive range is set in response to the "ordinary" of "connection length."

If the "continuous printing" is selected to be executed ("Yes" is selected in "execution"), the display is made of "under printing" and the print images G21–G23 of "ABCDE" are continuously printed in sequence three times (see FIG. 22A). The cut positions P1, P2 corresponding to the border positions of each of the print images are subjected to the "complex cutting" of the "upper-side connection." Upon completion thereof, the procedure returns to the original text editing screen.

Thereafter, each of the label portions can be torn off depending on the necessity. At this time, the release tape Ta can be easily separated while leaving the blanks wide enough (see FIG. 22B) and the individual labels L21–L23 can be released from the release tape Ta right before adhering for subsequent use by adhering to an object (see FIG. 22C).

If "connection cutting" is selected as it is on the above-described selection screen (D40), the procedure transfers to the selection screen in the lower hierarchy as in the first embodiment. As the "connecting point," there is displayed an option of "upper," "center," "lower," or the like. If the "upper" is selected (D43), the procedure transfers to the selection screen of the lower hierarchy, and the option is displayed of "large," "ordinary," "small," or the like, as the "connection width" of the "connection cutting" (D44). Similarly, if "ordinary" is selected and the "continuous printing" is selected to be executed ("Yes" is selected in "execution" of "continuous printing"), display of "under printing" is made and the "connection cutting" in the "upper-side connection" of the continuous printing is executed (FIG. 19A), and the selection screen then returns to the original selection screen. Thereafter, depending on the necessity, each of the label portions can be easily torn off (FIG. 19B).

As described above, in this embodiment, the "connection cutting" like in the first embodiment, or the "complex cutting" similar to that in the second embodiment can be selected as the cutting method. Therefore, various cutting can be executed and each label can be controlled in a lump or individually. In addition, by employing the "connection cutting" and the "complex cutting" accompanied by the notch-cutting amount adjustment, there can be executed the cutting while leaving the connection portions of an adequate connection widths depending on the tape width. Each of the labels can be manufactured in a manner to be managed in a lump or individually depending on the tape width.

Instead of the selection screen (D44) of the above-described "connection width," the selection screen of the "notch-cutting length" (D45: same as D32 in FIG. 29) may also be used. In this arrangement, it is also possible to execute the cutting while leaving or securing the connection portion of an adequate width depending on the tape width. Each of the labels can thus be manufactured in a manner to be easily manageable in a lump or separately. Although the above-described "connecting position" is set to be "upper-side connection," it may also be arranged to be "center connection" or "lower-side connection." Similar labels can also be easily manufactured and manageable in a lump or individually. In addition, the specification of "serial number printing" or "group printing" may also be employed (see FIGS. 19C–19D, 22D, 22E, 24 and 25: both 24A, 24B are possible in this embodiment).

The above-described method of label manufacturing is applicable, like in the above-described embodiment, to a program as well as to a memory medium for storing therein such a program. By storing this kind of program and reading it out of the memory medium for execution, a plurality of print images can be continuously printed on the tape. Each of the labels of respective print images can be manufactured in a manner manageable in a lump or individually.

In each of the above-described embodiments, the following arrangement is employed. Namely, by pressing the print key the procedure transfers from the text editing screen to the continuous printing setting screen (D11 in FIG. 17), and then display is made of the selection screen of "cutting method," "connecting position," "connection width," or the like, of the "continuous printing" by screen transfer to the lower hierarchy. However, as described above, "single printing," "continuous printing setting," "continuous printing execution," or the like, may be discriminated with keys, or the like, at the time of starting up.

As to the cutting by continuous printing, it may be so arranged that independent setting can be made by pressing the setting key for "continuous-printing cutting." A description will now be made about this example as a fifth embodiment.

Figure 31:
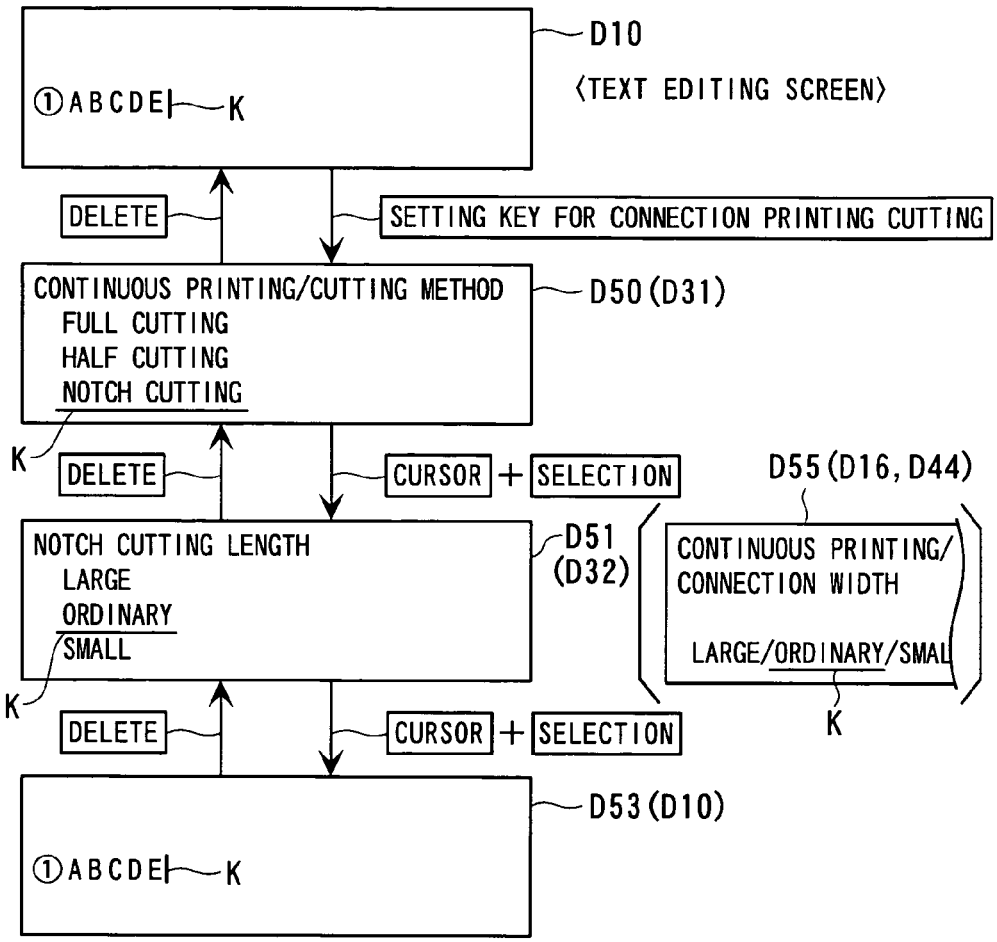
FIG. 31 is an explanatory view, similar to that in FIG. 17, showing an example of setting only the cutting method of continuous printing as a fifth embodiment.

In this case, as shown in FIG. 31, if the user presses the setting key for the above-described continuous-printing cutting in a state of displaying the text editing screen (D10), the procedure transfers to a selection screen which is similar to that (D31) in the third embodiment as described with reference to FIG. 29. There is thus displayed, as the "cutting method" of "continuous printing," an option of "full cutting," "half cutting," "notch-cutting," or the like (D50).

If the "notch-cutting" is selected (D50), the procedure transfers to the selection screen in the lower hierarchy so as to display an option of "long," "ordinary," "short," or the like, the "cutting length" of the "notch-cutting." For example, if "ordinary" is selected (D51: same as D32 in FIG. 29), the cutter drive range setting table (see FIG. 27) is searched to thereby set the "ordinary" notch-cutting length depending on the tape width.

In this embodiment, the "execution" of "continuous printing" is processed independent of the other processing. Therefore, once the setting of the cutter drive range has been finished (D51), the procedure returns to the text editing screen (D53; same as D10).

In the above-described example, "notch length" (displayed as "notch-cutting length") is selected at the time of "notch-cutting." Like the selection screen in the first, second, and fourth embodiments, the selection screen of the "connection width" (D55: same as D16 in FIG. 18 and D44 in FIG. 30) may be employed to thereby search for the cutter drive range setting table (FIG. 27) based on the "connection width" so that the cutter drive range can be set depending on the tape width.

In the above example, setting is made of "full cutting," "half cutting," and "notch-cutting" as well as "notch length" (i.e., cutter drive range setting) as the "cutting method" of the "continuous printing." They may also be classified in further details so that independent setting can be made by providing independent keys, or the like.

As the "cutting method," the above-described "connection cutting" or "complex cutting" may be employed instead of the "notch-cutting." Or else, by combining the above, there may be provided an option, as in the fourth embodiment, of "full cutting," "half cutting," "connection cutting," "complex cutting," or the like. In case the "connection cutting" and "complex cutting" are arranged to be selectable, there may be provided "continuous-printing setting key," or the like, instead of "continuous-printing cutting setting key" because not only the "cutting method" but also the printing method (as to whether blanks shall be provided among the print images) is selectable.

In the above embodiments, descriptions have so far been made about the method of setting various cutting methods. In the following, a description will now be made about the "printing processing" which is executed based on the data to be set in the above-described various settings (hereinafter referred to as "setting data" or "set data").

If a command for printing is issued in one of the following cases, i.e.: when "Yes" is selected on the selection screen of "execution" of "continuous printing" (D17 in FIG. 18, D25 in FIG. 21, D33 in FIG. 29, or the like); when the continuous printing execution key is depressed in case where such an independent key (continuous printing execution key) for "continuous printing execution" is provided; when a single printing key is depressed in case where an independent key (independent printing key) to command the independent printing is provided; or the like, the interruption for printing command occurs so that the printing processing is started. If the print image forming has already been prepared by that time, the print images can be printed based on the print image data.

Figure 32:
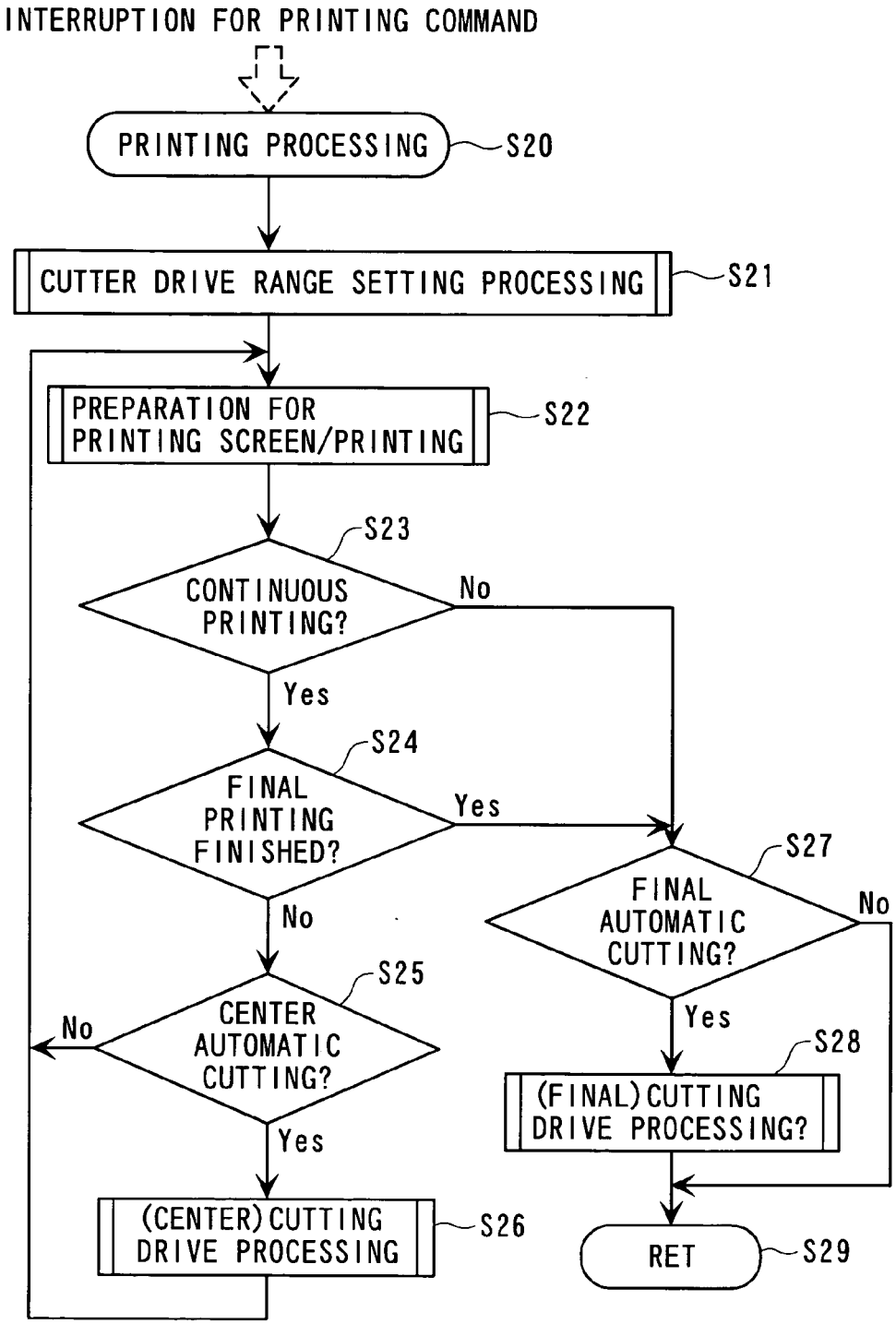
FIG. 32 is a flow chart showing the printing processing.

In concrete, when the above-described interruption for printing command occurs, the printing processing is started (S20) as shown in FIG. 32, and the cutter drive range setting processing is executed first (S21).

Figure 33:
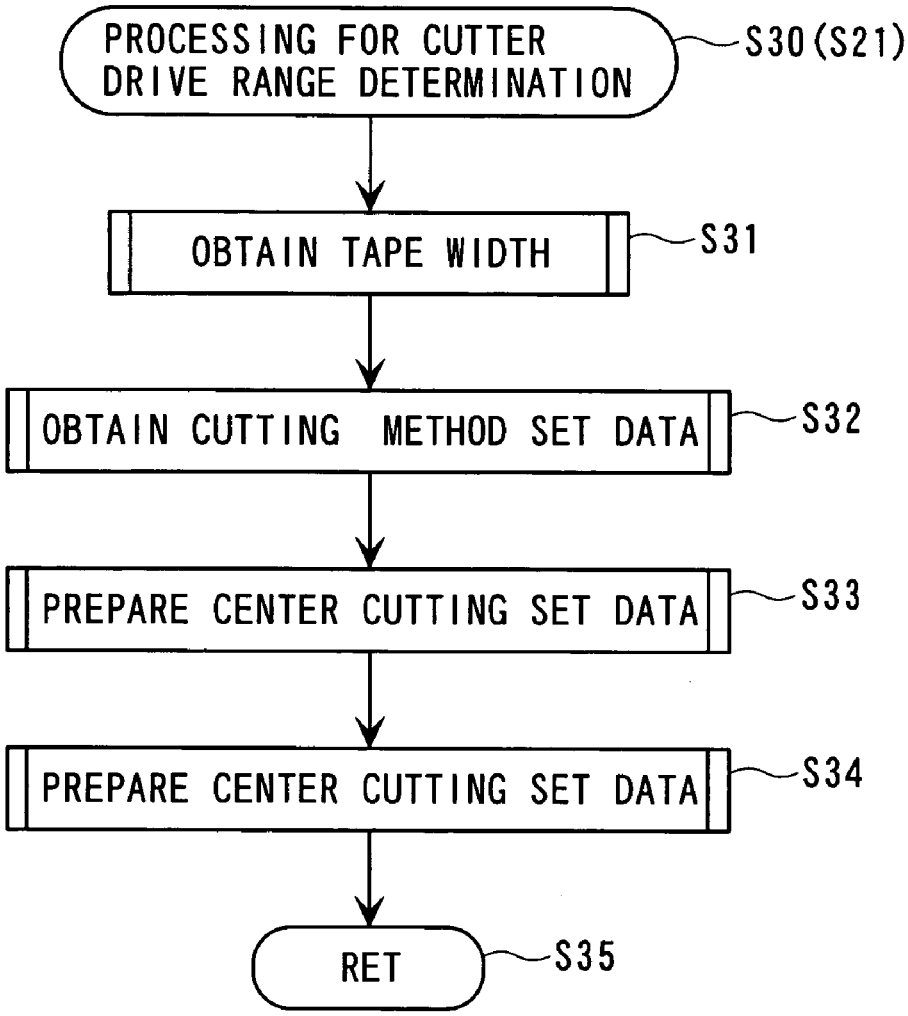
FIG. 33 is a flow chart showing the processing of determining the cutter drive range.

In this cutter drive range setting processing (S30: processing of S21), as shown in FIG. 33, the tape width is obtained (S31) based on the result of detection by the tape recognition sensor 141. Then, the results of selection and setting of the cutting method by the various settings in the above-described embodiments are obtained as the cutting method setting data (S32). Based on them, the cutting setting data relating to the center cutting (hereinafter referred to as "center-cutting setting data") are prepared (S33). Thereafter, the cutting setting data relating to the final cutting (hereinafter referred to as "final-cutting setting data") are prepared (S34), and the processing (S30) is finished. (S35).

As the setting data relating to the cutting method, there are contained the setting data showing the various setting results relating to the cutting method such as the selection results of "connection cutting," "complex cutting," and the selection results of those of lower hierarchy such as "connecting position," "connection width," or the like. The center-cutting setting data and the final-cutting setting data to be prepared based on the cutting method setting data include the setting data showing the above-described various setting results, and the detection data on the kind of the tape (particularly, the tape width). In the full-cutter drive processing (S50: see FIG. 35) to be described later, they serve as the data in setting the full-cutting starting position, the direction and distance thereof (number of rotation of the full-cutting motor 131).

As shown in FIG. 32, when the processing for the cutter drive range setting has been finished (S21), the print image is prepared and is printed (S22). Here, the above-described character string images of "ABCDE" are transferred from the print image data region 244 to the printing buffer, and are printed after due printing preparations.

In the "continuous printing," the character string image of the first print image (i.e., "ABCD1") among the "ABCD1," "ABCD2," "ABCD3" is prepared in the printing buffer and is printed. In the "group printing," the character string image of the first print image (i.e., "Tokyo-to") among the above-described "Tokyo-to," "Chuo-ku," "Ginza," "1-chome," 1—1" is prepared from the registered address in the text data region 242 to the printing buffer, and is printed.

Once the print image preparation/printing is finished (S22), a discrimination is made as to whether the printing is "continuous printing" or not (S23). If it is "continuous printing," a discrimination is made as to whether "final printing" has been finished or not (S24). If it is "continuous printing" and "final printing" has not been finished (S23: "Yes" and S24: "No"), a discrimination is made as to whether it is "center automatic cutting" or not (S25).

If "Yes" is selected on the selection screen (see D13 in FIG. 17; D20 in FIG. 21; and D30 in FIGS. 29 and 30) of "automatic cutting" of "continuous printing," a discrimination is made that it is "center automatic cutting" (S25: "Yes", see FIG. 32). After executing the cutting drive processing relating to the center cutting based on the center-cutting setting data (center-cutting drive processing: details to be given hereinafter, see FIG. 34) (S26), the procedure transfers to the next print image preparations/printing (S22). If "No" is selected in "automatic cutting" of "continuous printing," a discrimination is made that it is not "center automatic cutting" (S25: "No") and the procedure transfers to the next print image preparation/printing processing (S22).

As to the second round (second set, second sheet), the similar processing is executed (loop processing from S22 to S26). When the print image preparation/printing of the third round (third set, third sheet) is finished (S22), a discrimination is made as to whether the cutting is "final automatic cutting" or not (S27) because the procedure is "continuous printing" and also "final printing finished" (S23: "Yes" and S24: "Yes").

In the above-described example, the "final cutting" is made to be "full cutting." Therefore, a discrimination is made here that the cutting is "final automatic cutting" (S27: "Yes") and, after the cutting drive processing relating to the final cutting based on the final-cutting setting data (final-cutting drive processing) (S28), the printing processing (S20) is finished (S29).

If a selection is made not to execute "continuous printing" (i.e., "single printing" is selected by pushing "No" ) (D11 in FIG. 17), or if a single printing key is depressed in case where such a key is provided to command the single printing, a discrimination is made as to whether "continuous printing" shall be executed or not as soon as the preparation for, and printing of, the print image screen character string "ABCDE" have been finished (S22). Thereafter, since the command is not to execute the "continuous printing" (S23: "No"), then a discrimination is made as to whether the command is "final automatic cutting or not (S27).

If "Yes" is selected on the selection screen (D13S in FIG. 17) of "automatic cutting" for "single printing," a discrimination is made to be "final automatic cutting" (S27: "Yes"). After executing the final cutting drive processing (S28), the processing (S20) is finished (S29). If "No" is selected in the "automatic cutting" for "single printing," a discrimination is made that it is not the "final automatic cutting" (S27: "No"), the processing is finished as it is (S29).

As regards the "final cutting" in the "continuous printing," it can also be made selectable between "Yes" and "No" as to the method of cutting, or the like. If "No" is selected, a discrimination is made that it is not the "final automatic cutting" (S27: "No") and the processing (S20) is finished (S29) as it is. If "Yes" is selected and a discrimination is made that it is the "final automatic cutting" (S27: "Yes"), various cuttings are made possible in the final-cutting drive processing (S28).

Figure 34:
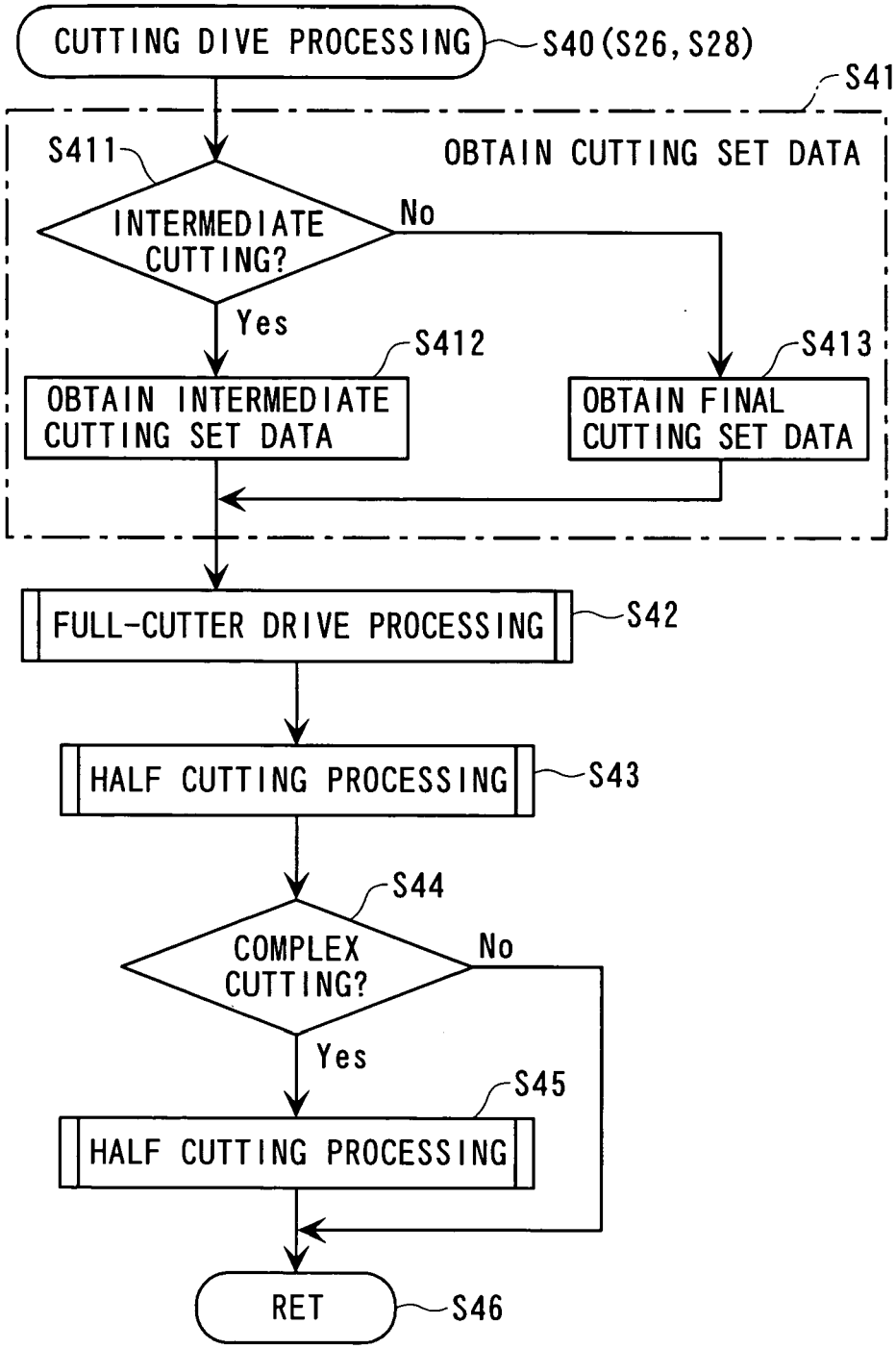
FIG. 34 is a flow chart showing the processing of cutter drive.

With reference to FIG. 34, a description will now be made about the cutting drive processing in the intermediate cutting or final cutting. If the cutting drive processing (S40: processing of S26 in the intermediate cutting, and processing of S28 in the final cutting) is started, as shown in FIG. 34, the cutting setting data prepared in the cutter drive range setting processing (processing of S30 in FIG. 33, and of S21 in FIG. 32) are obtained (S41). In concrete, a discrimination is made as to whether the starting up is made as the intermediate cut-drive processing or not (S411). If it is the intermediate cutting (S411: "Yes"), intermediate-cutting setting data are obtained (S412) and, if it is not the intermediate cutting (i.e., it is the final cutting) (S411: "No"), the final-cut setting data are obtained (S413).

When the cutting set data have been obtained (S41), full-cutter drive processing (details to be explained hereinafter, see FIG. 35) is executed first based on the obtained cutting set data by the full cutting unit 13F because the full cutting unit 13F is on the upstream side, as seen in the tape feed direction, of the half cutting unit 13H. Then, the half cutting processing is executed (S43) by the half cutting unit 13H.

A discrimination is made here as to whether "complex cutting" is further selected or not (S44: "Yes"). If "complex cutting" is selected (S44: "Yes"), the two portions on the upstream side and on the downstream of the full cutting (connection cutting) positions are subjected to half cutting. For example, the cutting position P1 in FIG. 22A is subjected to half cutting hc at two positions located with the full cutting fc in between. After executing the half cutting processing to the remaining one position (S45), the processing is finished (S46). If "complex cutting" is not selected (S44: "No"), the processing (S40) is finished as it is (S46).

The above-described full-cutter drive processing (S42) is different from the half-cutting processing (S43) which has always a cutting object of the entire width of the tape or simply the full cutting processing. Therefore, detailed description will be made hereinbelow.

Figure 35:
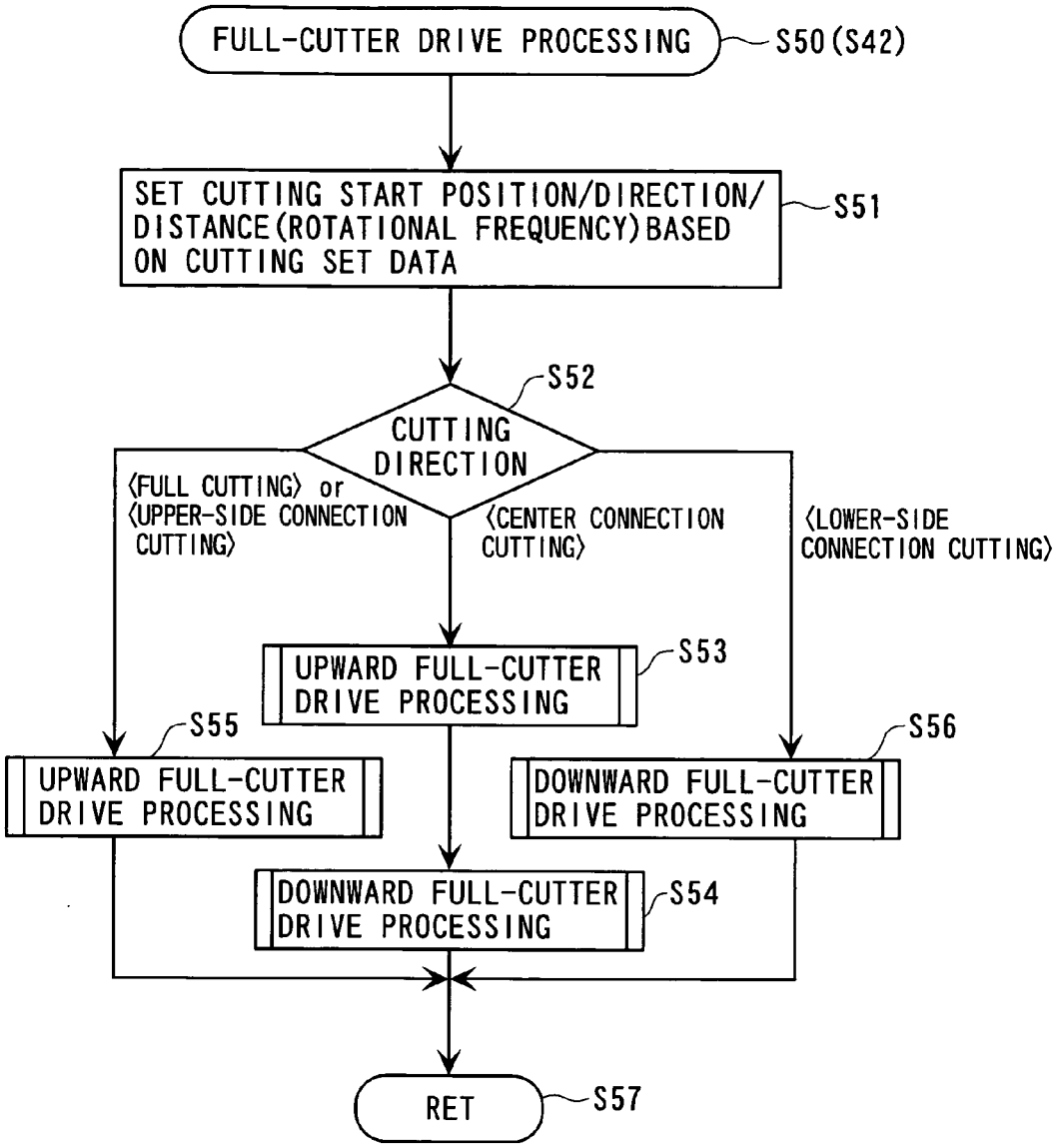
FIG. 35 is a flow chart showing the processing of full-cutter drive.

If the full-cutter drive processing (S50: processing of S42 in FIG. 34) is started, as shown in FIG. 35, the starting position, direction and distance (rotational frequency of the full-cutting motor 131) of the full cutting are set (S51) based on the cutting set data as obtained in the step of obtaining data on the setting for cutting (S41 in FIG. 34). Thereafter, a discrimination is made of the cutting direction (S52) and the full cutter drive processing depending on the "cutting direction" is started up (S53–S56). If they are finished, the processing (S50) is finished (S57).

In concrete, if, for example, "center" is selected (center connection) as the "connecting position" in the "complex cutting" or "connection cutting" (D15 in FIGS. 17 and 18; D23 in FIG. 21; D43 in FIG. 30), upward full-cutting drive processing (details to be described hereinafter, see FIG. 36) is executed in which the full cutter 132 is driven from the bottom upward (normal direction) as the "center connection cutting" (S53). Thereafter, downward full-cutting drive processing is executed in which downward cutting from the top downward (in the reverse direction) is executed (details to be descried hereinafter, see FIG. 37) (S54).

In case the "full cutting" is simply selected instead of "connection cutting," or else, in case the "upper" is selected as the similar "connecting position" (upper connection: opposite end connection), similar upward full-cutting drive processing is executed (S55: same processing as S53). Similarly, in case the "lower" is selected as the "connecting position" (lower-side connection: reference end connection), the downward full-cutting drive processing is executed as the "lower-side connection cutting" (reference-end connection cutting) (S56: same processing as S54).

Figure 36:
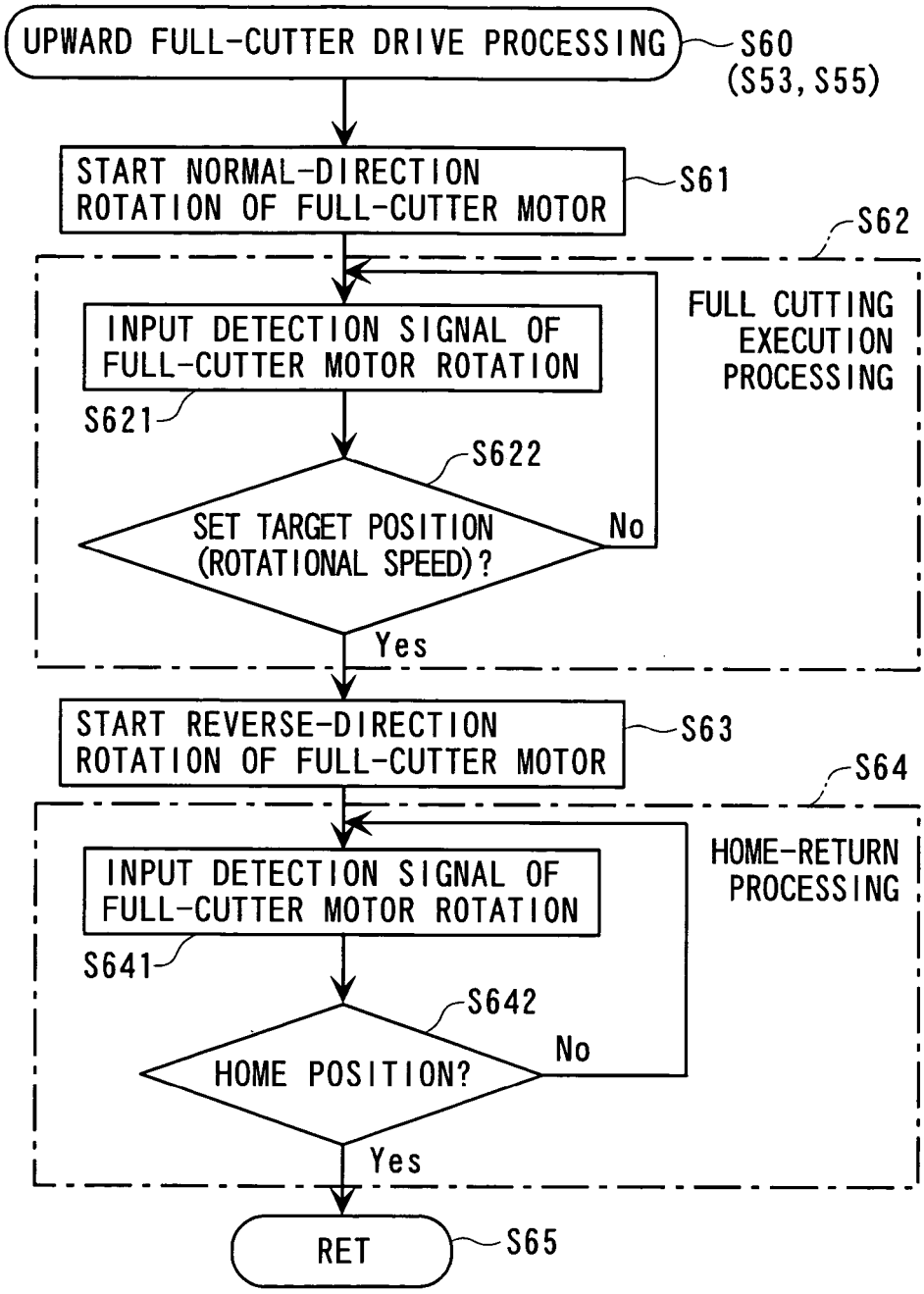
FIG. 36 is a flow chart showing the processing of upward full-cutting drive.

In more concrete, if the above-described upper-direction full-cutter drive processing (S60: processing of S35 and S53 in FIG. 35) is started, the full-cutting motor 131 is first rotated in the normal direction of rotation (S61) as shown in FIG. 36. Here, the "normal direction of rotation" refers to the direction of rotation, as shown in FIGS. 10–13, in which the rotary disk 360 is rotated in circulation from the state of 300A to the state of 300B, to the state of 300C, to the state of 300D, and to the state of 300A. By the motion from the state of 300B to the state of 300C, the upward direction of rotation (normal direction), the cutting processing is executed.

The rotation start position is the home position in the state of 300A, i.e., the detection position by the full cutter home position detection sensor 144 (see FIGS. 3 and 10–13). Based on the cut-setting data, the starting position of the cutter drive is basically set to the home position. The distance is set depending on that rotational frequency of the full-cutting motor 131 which is required to cause the transfer of state from the home position to the target position. This target position is, as shown in FIG. 27, determined based on the detected tape width and "connection width" (or notch-cutting length).

If the full-cutting motor has started its normal rotation (S61), the upward-full cutting is executed (S62) based on the rotational frequency set by the normal rotation. In more concrete, by inputting the rotation detection signal (pulse signal) detected by the rotation detection sensor 143 (see FIGS. 3 and 9) for the full-cutting motor. The rotational frequency is detected by the number of pulses (S621). A discrimination is then made as to whether the set position (rotational frequency) has been reached or not (S622). The normal direction of rotation is maintained (S622: "Yes" through S621) until the target position has been reached (S622: "Yes"). At the time when the target position has been reached (S622: "Yes"), the rotation in the normal direction is braked and the rotation of the full-cutting motor in the reverse direction of rotation is started (S63).

In the above-described full cutting execution processing (S62), the "full cutting" as shown in FIG. 35 can be executed if the normal direction of rotation is continued until the state of 300C is attained (or until the home position state of 300A is attained). If the rotation is stopped at the target position on the way from the state of 300B to the state of 300C, the "upper-side connection cutting" can be executed. Similarly, if the rotation is stopped at the target position which is below the center on the way from the state of 300B to the state of 300C, the cutting below the "center connection cutting" can be executed.

The "reverse rotation" of the full-cutting motor 131 is the rotation, as show in FIGS. 10–13, in which the rotary disk 360 is rotated counterclockwise as seen in the figures so as to attain the circulating state from the state of 300S to the state of 300D, to the state of 300C, to the state of 300B, and to the state of 300A. By the rotation from the state of 300C to the state of 300B, the downward cutting processing can be executed.

However, only the returning to home position (also referred to as "home returning") is executed here along the direction from the state of holding state to the state of 30B and to the state of 300A (S64). In other words, the rotation in the reverse direction is maintained by an amount of rotation in the normal direction in the full cutting processing (S62) by similarly inputting the detected rotation signal so that the home position can be detected by the full-cutter position sensor 1441, i.e., until the home position is attained (S642: "Yes"). When the home position has been reached (S642: "Yes"), the reverse rotation is stopped by applying a brake and the processing (S60) is finished (S65). As a result, the cutter operating mechanism 300 is returned from the target position to the home position, and the processing is finished.

In the above-described home-returning processing (S64), the operation only up to the detection of the home position, i.e., only until the home position is attained (S642: "Yes"). The processing of inputting the detected signal of the full-cutting motor rotation (S641) may be omitted or, alternatively, the home position detection may be omitted. By means of the inputting of the detected signal of the full-cutting motor rotation (S641), it is possible to rotate in the reverse direction of rotation until the set rotational frequency (in the normal direction) is attained (i.e., the similar processing can be carried out as the full-cutting execution processing (S62)).

At the time of "full cutting" in FIG. 3, only the rotation in the normal direction (or in the reverse direction) is possible. Therefore, only the starting of the full-cutting motor in the normal direction (S61) and the full cutting execution processing (S62) are made possible. Or else, since both the normal rotation and the reverse rotation are possible, it is possible to cope with the downward full-cutter drive processing (S70) as described hereinbelow.

Figure 37:
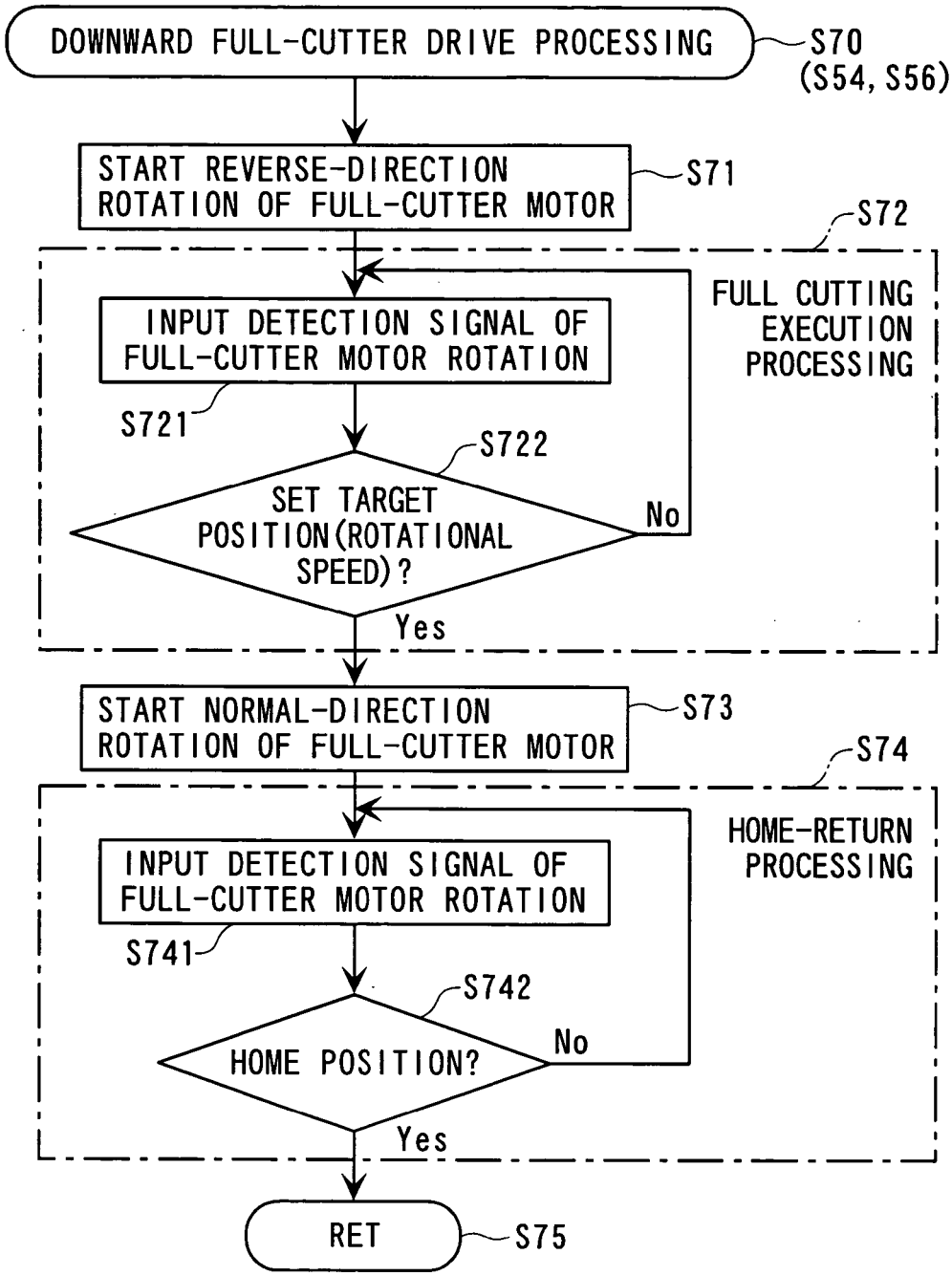
FIG. 37 is a flow chart showing the processing of downward full-cutting drive.

The downward full-cutter drive processing (S70: steps S54 and S56 in FIG. 35) is a processing, as shown in FIG. 37, in which the direction of rotation of the motor in the upward full-cutter drive processing (S60) is reversed.

In other words, when this processing (S70) is started up, the reverse rotation of the full-cutting motor 131 is started first. The reverse rotation is maintained in the direction from the state of 300A to the state of 300D, to the state of 300C, and to the state of 300B (S722: "Yes"-S721) until the set target position (rotational frequency) is attained (S722: "Yes"). Thereafter, the reverse rotation is stopped by applying brake, thereby performing the downward full-cutting down to the target position (S72). Thereafter, the normal rotation is started (S73). Due to this normal rotation, only the returning to the home position is performed (S74) in the direction from the braked state to the state of 300C, to the state of 300D, and to the state of 300A. As a result, the cutter operating mechanism 300 of the full cutter 132 is returned from the target position to the home position, thereby finishing the processing.

The position of starting the rotation is, like in the above-described upward full-cutter drive processing (S60), the home position in the state of 300A. The starting position of the cutter drive is set to the home position, and its distance is set by the rotational frequency from the home position to the target position. The target position is determined by the "connection width" (or "notch length" as described with reference to FIG. 27).

In the above-described full-cutting execution processing (S72), if the reverse rotation is continued until, e.g., the state of 300B (or until the home position in the state of 300A) is attained, the "full cutting" in FIG. 35 can be performed. If, on the other hand, the operation is stopped at the target position which is set on the way from the state of 300C to the state of 300B, the "lower-side connection cutting" can be performed.

Similarly, if the cutter operating mechanism 300 is stopped at the target position which is above the one on the way from the state of 300C to the state of 300B, the "center connection cutting" can be performed. Therefore, as shown in FIG. 35, by performing both the lower-side cutting and the upper-side cutting by combining the upward full-cutter drive processing (S60 in FIG. 36) and the downward full-cutter drive processing (S70 in FIG. 37), there can be finished the "center connection cutting" in which the center portion as seen in the widthwise direction of the tape is the connection portion.

Both the above-described upward full-cutter drive processing (S60) and the downward full-cutter drive processing (S70) finish the processing after returning the full-cutter operating mechanism 300 from the target position to the home position. They can therefore be started up at an arbitrary position. For example, the order of processing of the upward full-cutter drive processing (S60) and the downward full-cutter drive processing (S70) can be reversed.

In the above-described home-returning processing (S74), the processing of inputting the rotational signal of the full-cutting motor (S741) may be omitted. Or else, the home-position detection may be omitted so as to attain the same processing as the full-cutter processing (S72).

The above-described examples are based on the presumption that the full-cutting motor 131 is made of a DC motor. Therefore, there are employed the inputting of the rotation detection signal by the full-cutting motor rotation detection sensor 143 and the home position detection by the full-cutting home position detection sensor 144. Alternatively, the full-cutting motor 131 may be constituted by a stepper motor (pulse motor, or the like).

Figure 38:
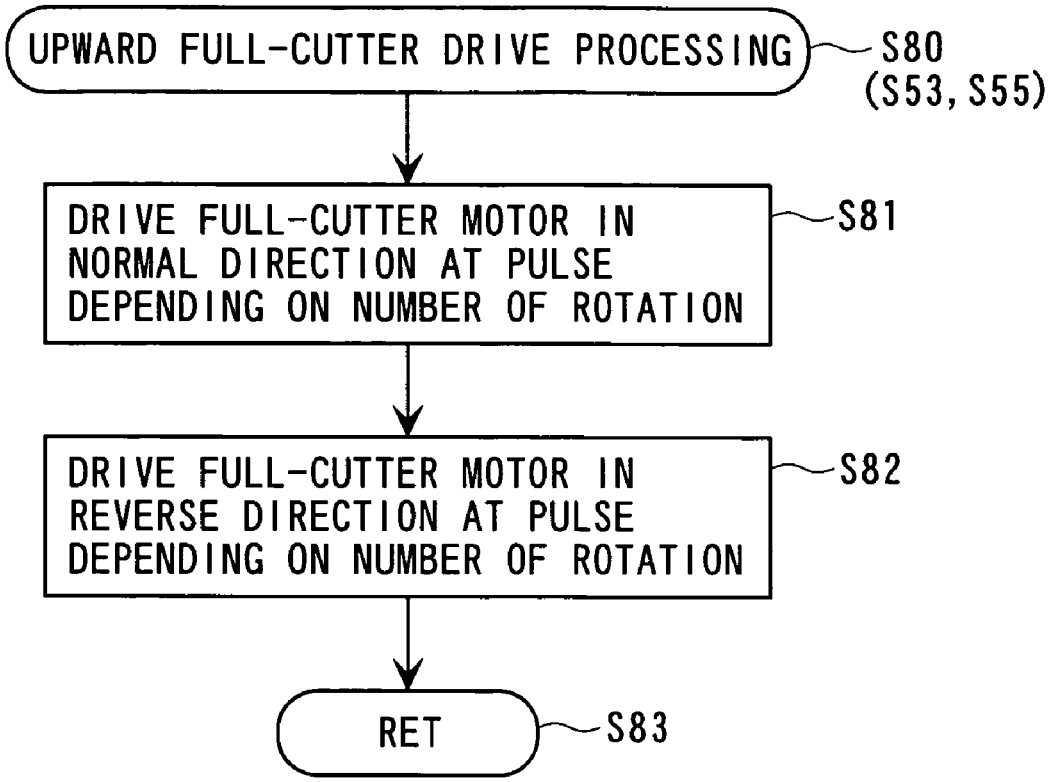
FIG. 38 is a flow chart, similar to that in FIG. 36, showing another example of the processing of upward full-cutting drive in case the drive motor is a stepper motor.
Figure 39:
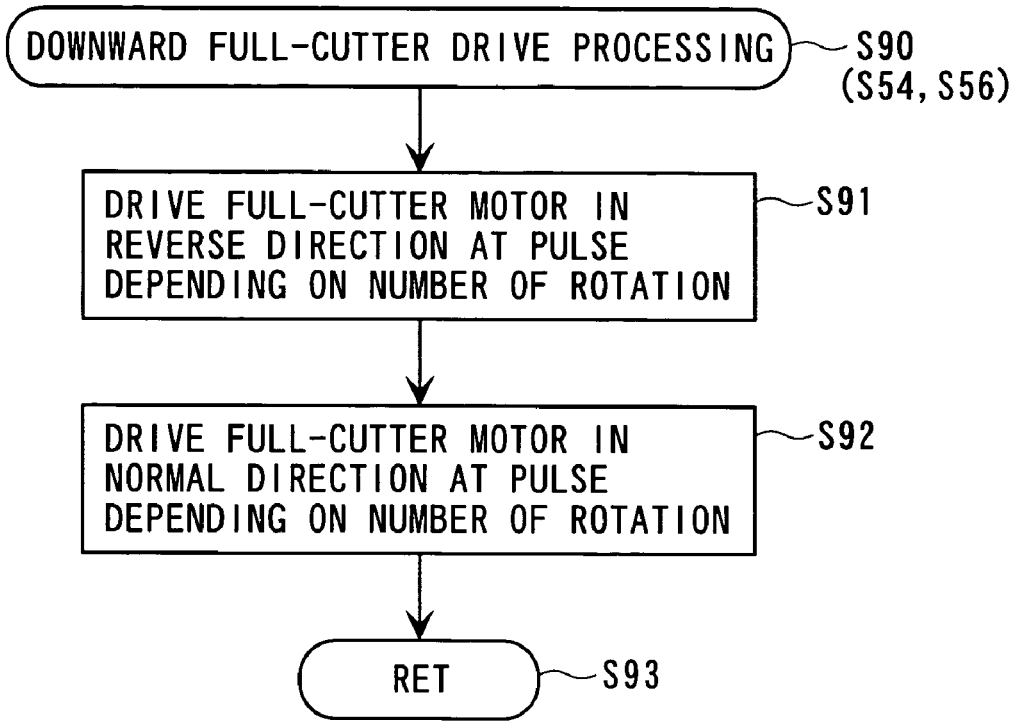
FIG. 39 is a flow chart, similar to that in FIG. 37, showing the processing of downward full-cutting drive corresponding to the example in FIG. 38.

In this case, the above-described upward full-cutter drive processing (S60) in FIG. 36 and the downward full-cutter drive processing (S70) in FIG. 37 can be replaced by the upward full-cutter drive processing (S80) in FIG. 38 and the downward full-cutting drive processing (S90) in FIG. 39, respectively. In other words, the full-cutting motor 131 is controlled to be driven in the normal direction (S81 in FIG. 38 and S92 in FIG. 39) and in the reverse direction (S82 in FIG. 38 and S91 in FIG. 91) by a pulse depending on the amount of rotational speed to the target position, thereby performing the upward and downward full-cutting drive processing.

In each of the above-described embodiments, the full-cutting portion 13F employs a sliding type of full cutter 132 which is capable of cutting in the vertical (up and down) direction. Alternatively, a scissors-type of cutter may also be employed by arranging such that the "connecting position" is limited to "upper-side connection" or "lower-side connection." Otherwise, all of the "upper-side connection," "lower-side connection," and "center connection" may be arranged to be available as the "connecting position" by constituting the mechanism by a pair of the upward full cutter and the downward cutter of scissors type.

In the above-described embodiments, the options of the "connecting position" are made in a style represented or displayed in characters, as shown in D15, or the like, in FIG. 18, e.g., "upper" (upper-side connection: one widthwise end: reference-side connection), "lower" (lower side: the other end: opposite-end connection), and "center" (central connection: central portion). Instead, the options may be represented in an image after cutting (see FIGS. 40A–40C, D61–D63). Or else, both may be arranged to be displayed.

Figure 40A:
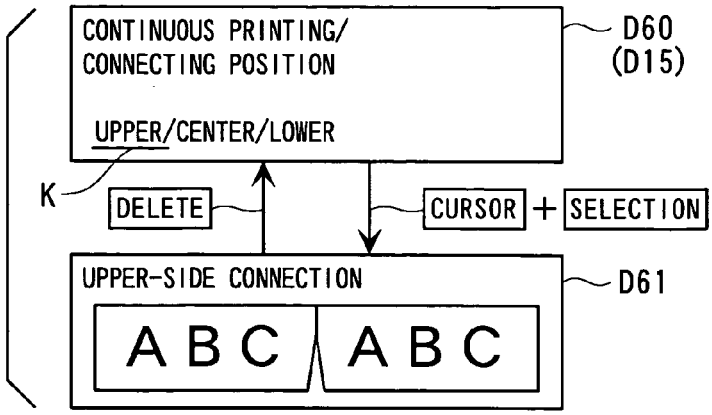
FIGS. 40A–40C are explanatory views showing an image display of the connecting position and confirmation screen (preview) making use thereof.
Figure 40B:
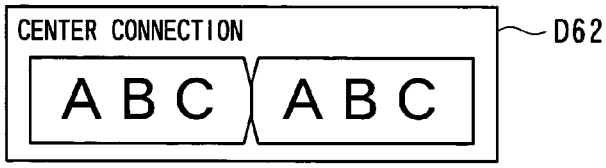
Figure 40C:
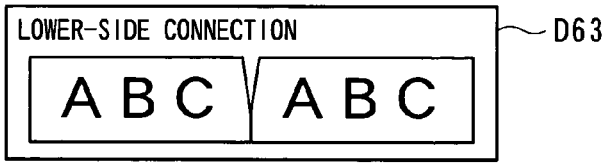

Further, in case both the above-described display means are provided, the one for the image representation may be utilized as a screen for preview (i.e., for confirmation purpose before execution). In such a case, as shown in FIGS. 40A–40C, based on the display by means of option of character representation, i.e., character representation of options of connecting positions (D60: same as D15 in FIG. 18, or the like), a confirmation can be made, after an arbitrary option has been selected ("upper" in the illustrated example), by image representation after cutting (D61: see also D62 and D63) corresponding to the selected option ("upper": upper-side connection). If it is acceptable, the procedure can be transferred to the next display screen (e.g., D16 in FIG. 18, or the like) by depressing the selection key. In case of cancellation so as to select another option, the delete key is depressed, so that the original screen (e.g., D15 in FIG. 18, or the like) for another selection.

In the above-described embodiments, the representation may similarly be changed as follows. Namely, the options of "connection width" are in the style of character representation in the form of "large (larger width)," "ordinary," "small (smaller width)," or the like as shown in FIG. 18 (D16, or the like). Instead, each of the options may be represented by means of images (see D65–D67 in FIG. 41) so that both the above may be displayed. It may also be so arranged that the image representation is made in a preview screen or display.

Figure 41A:
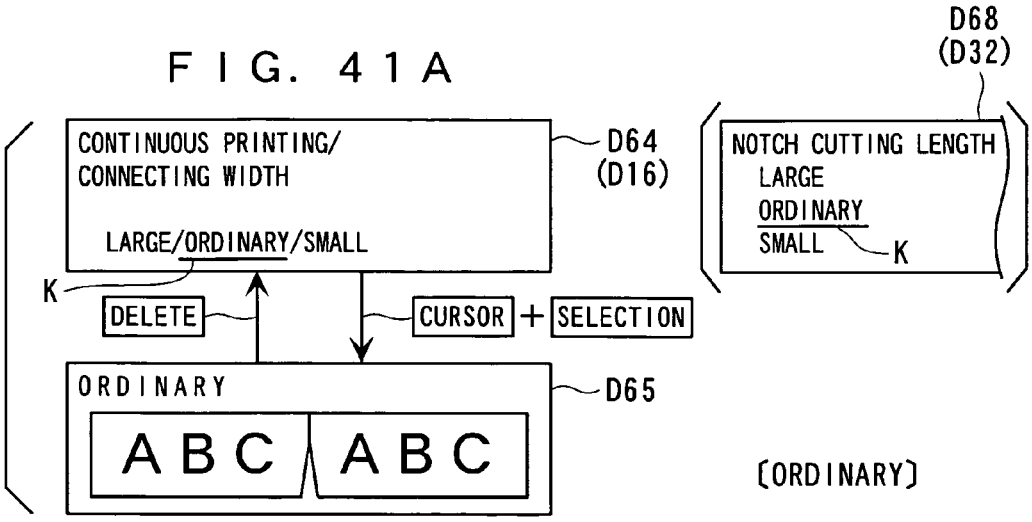
FIGS. 41A–41C are explanatory views, similar to those in FIGS. 40A–40C, showing an example of connection width or notch length.

In this case, as shown in FIG. 41A, after selecting an arbitrary option ("ordinary" in the illustrated example) based on the style of character display (character display of the connection width)(D64: same as D16 in FIG. 18), an image after cutting corresponding thereto is confirmed by image representation (D65: see also D66 and D67). If it is acceptable, the selection key is depressed to thereby transfer to the next screen (e.g., D17 in FIG. 18). In case of cancellation, the delete key is depressed to thereby return to the original screen (D16 in FIG. 18, or the like) for another selection work.

The above-described example relates to "connection cutting" of the first embodiment (i.e., without a blank between the respective pairs of adjoining print images). In the "complex cutting" in the second embodiment in which each of the blanks between the respective pairs of the print images is sandwiched by half cutting (see FIGS. 22A–22F, 24B), the options are in the style of selecting the character representation such as "connecting position" (see D23 in FIG. 21) and "connection width" (see D24 in FIG. 21). Instead, the image representation may be employed, or else, both may be arranged to be capable. Similarly, the image representation may be arranged in a preview screen.

Figure 20A:
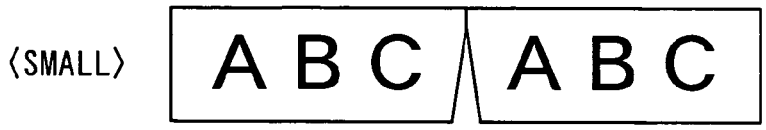
FIGS. 20A–20F are explanatory views showing one example of result of cutting having different connection widths in the connection cutting.
Figure 20B:
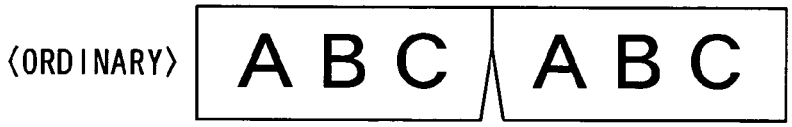
Figure 20C:
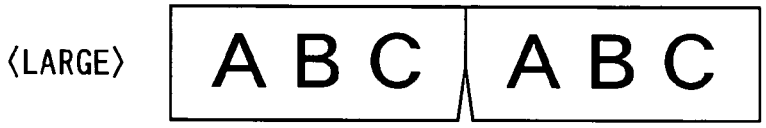
Figure 20D:
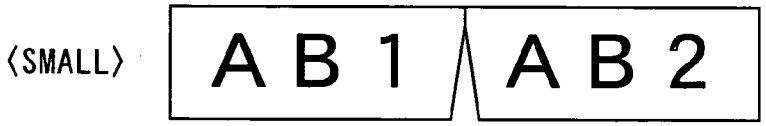
Figure 20E:
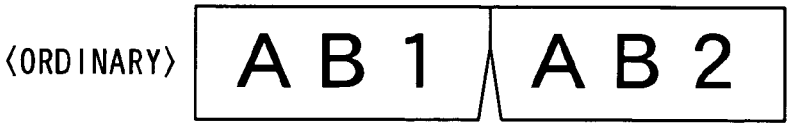
Figure 20F:
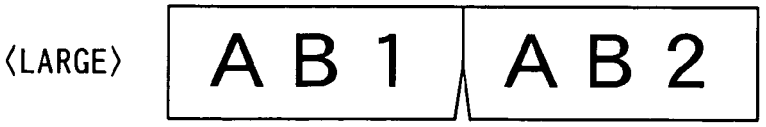

In this case, the following idea may be formed, i.e., D23 in FIG. 21 may be assumed instead of D60 in FIG. 40A, and a reduced image of FIG. 20B may be assumed instead of D61 in FIG. 40A. Further, if D24 in FIG. 21 is assumed instead of D60 in FIG. 40A, reduced images can be displayed of FIG. 23B ("ordinary"), FIG. 23B ("small"), and FIG, 23C ("large") instead of D65 ("ordinary"), D66 ("small"), and D67 ("large").

The same applies to the third embodiment relating to "notch cutting" in which the "notch length" has the above-described relationship with the "connection width" (see FIG. 27, or the like). Therefore, instead of the options of character representation style, each of the options may be represented in images, or both may be arranged to be capable. Or else, the image representation may be arranged to be of a preview screen style.

Figure 41B:
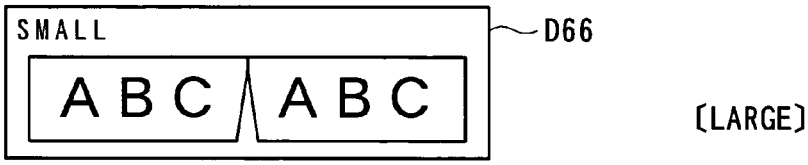
Figure 41C:
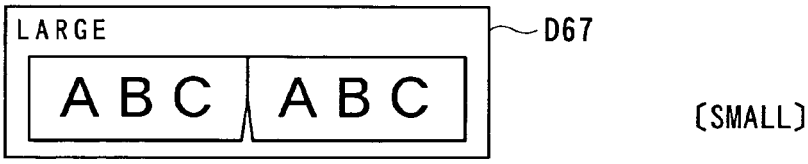
Figure 42A:
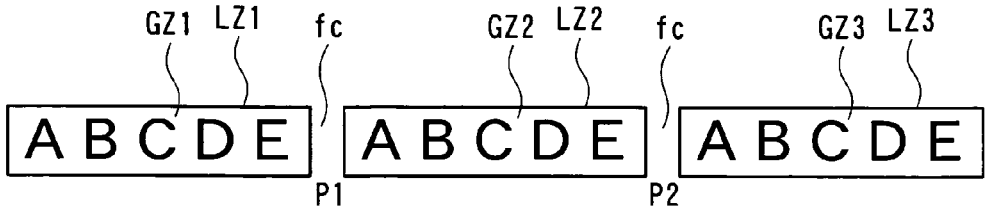
FIG. 42A PRIOR ART
FIGS. 42A and 42B are explanatory views showing one example of the result of printing by a conventional continuous printing as well as of a cutting image of the tape.
Figure 42B:
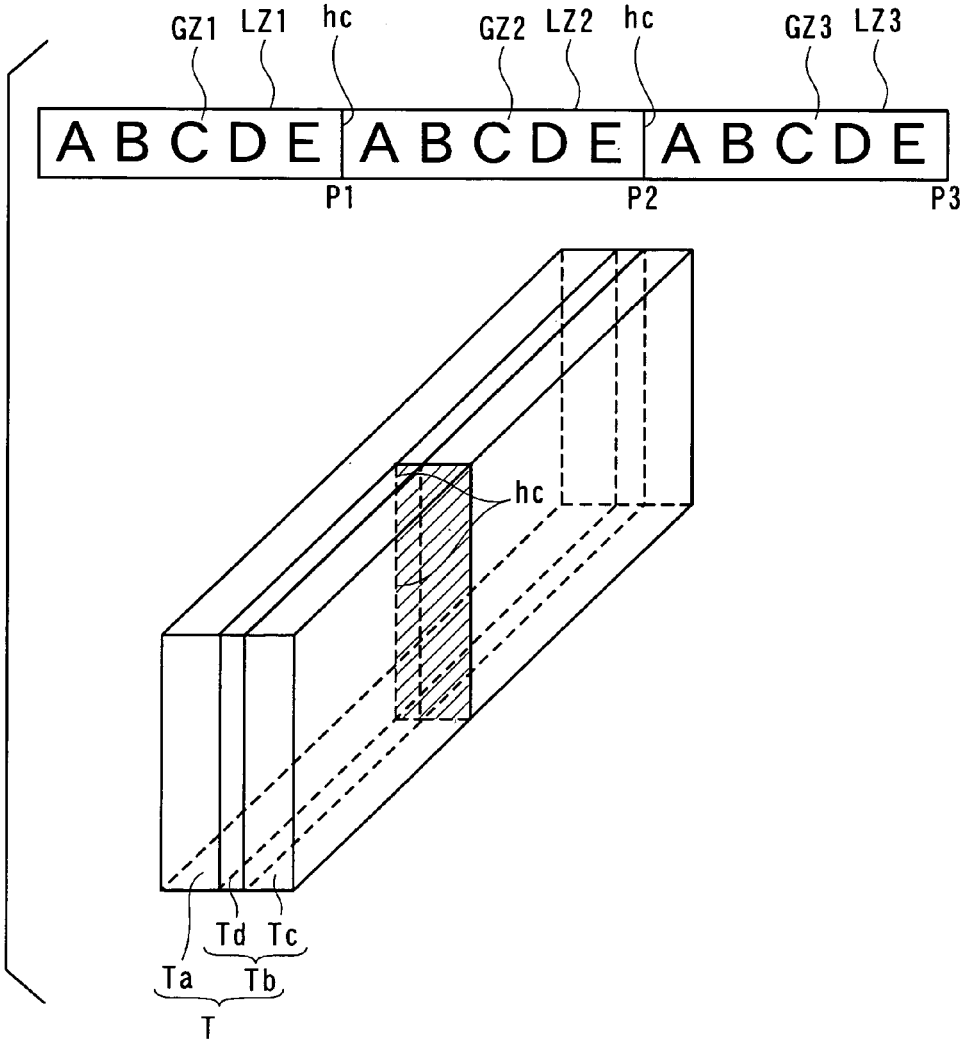
FIG. 42B PRIOR ART

In this case, as shown on the right column of FIGS. 41A–41C, the "notch-cutting length" is selected by the option in the character representation style (display of option of character representation of notch-cutting length) (D68: same as D32 in FIG. 29). Confirmation is made of the image representation after cutting (see D65–D67: title of representation is as given in parentheses ([ ]) on the right column). If acceptable, the selection key is depressed to thereby transfer to the next screen. If the cancellation key is depressed the procedure returns to the original screen (D32 in FIG. 29, o the like) so as to be ready for another selection.

In the above-described examples, the following arrangement may also be employed. Namely, the options may be made up, e.g., of 9 options by combining the options of "connecting position" and the options of "connection width" (or "notch length") so as to make representations in character representation style and image representation style. Regarding the "connection width" and "notch length," there may be employed options in which actual values (see cutting width range in FIG. 27) are used, aside from the above-described example.

Furthermore, the options of various cuttings inclusive of "connection notch cutting," "complex cutting," "full cutting," "half cutting," or the like, as described in the above-described fourth embodiment may also be arranged to be capable of displaying in the image representation instead of the character representation (see FIG. 30, or the like). The method of image representation may be arranged to be of a preview screen style.

Aside from the above-described various cutting methods, there may be employed the following methods. Namely, in one cutting method, the connecting position may be set alternately in the upper and lower positions. In another cutting method, the connection cutting is employed in the half cutting so as to enable adhesion of the label in circular shape, polygonal shape, or the like. Of course, there may be options in menu style of combinations of the above-described various cutting methods and the "connecting position," "connection width," "notch length," or the like. These options may be displayed in characters, in images or in both. The method of image representation may be arranged to be of a preview screen style.

The above-described printing processing (method) in the FIGS. 32–39 and, in particular, the above-described cutter drive processing and the label manufacturing method in FIGS. 34–39, and the various displaying or representing (selection, confirmation) methods in FIGS. 40A–40C, 41A–41C are applicable to a program as well as to a recording medium for storing therein the program. By storing in advance the program in the tape printing apparatus and by reading out the memory therefrom to thereby execute the methods, a plurality of print images can be serially printed on a tape, and the labels having printed thereon the print images can be prepared in a neat manner in a manner to be managed or controlled individually or in a lump depending on the tape width. Other modifications may be made within the scope of disclosure of this invention.

As described above, according to the tape printing apparatus, the program, and the memory medium of this invention, each of the labels having continuously printed print images thereon can be manufactured in a neat manner so as to be easily manageable in a lump or individually by using the various cutting methods.

What is claimed is:

1. A tape printing apparatus comprising:

tape mounting means for mounting a printing tape made up of a base tape having a front printing surface and a rear adhesive surface, and a release tape covering the adhesive surface;

printing means for printing a plurality of print images on the printing surface, said print images being arrayed in a longitudinal direction of the printing tape;

cutting means for cutting the printing tape in a widthwise direction thereof, wherein said cutting means is capable of performing normal-direction cutting in which the printing tape is cut from one end as a reference end as seen in the widthwise direction thereof to an opposite end thereof, and reverse-direction cutting in which the printing tape is cut in a reverse direction from the opposite end to the reference end, wherein said cutting means comprises:

a cutter capable of performing slide cuffing in both the normal direction and the reverse direction;

cutter operating means capable of transferring said cutter among: a first state in which said cutter is away from a feeding passage of the printing tape by said printing means; a second state in which said cutter is located close to the feeding passage but is on a side of the reference end relative to the feeding passage; and a third state in which said cutter is close to the feeding passage but is on a side of the opposite end relative to the feeding passage, wherein the normal-direction cutting is performed on a way of transfer from the second state to the third state, the reverse-direction cutting is performed on a way of transfer from the third state to the second state, and a state transfer is performed between the second state and the third state accompanying no cutting due to a state transfer through the first state; and control means for controlling said cutting means, said cutting means being capable of performing connection cutting in which at least a widthwise part of the release tape remains connected as a connection portion, said control means having connection-cutting control means for causing said cutting means to perform connection cutting in a space between each of the plurality of adjoining print images printed on the printing tape.

2. The tape printing apparatus according to claim 1, wherein said cutting means further comprises:

half-cutting means for cutting only the base tape in the widthwise direction thereof; and full-cutting means for cutting both the base tape and the release tape in the widthwise direction thereof, said full-cutting means being capable of the connection cutting.

3. The tape printing apparatus according to claim 1, further comprising cutting method selection means for selecting, as a cutting command out of a plurality of options, the cutting method under control by said cutting means.

4. The tape printing apparatus according to claim 3, wherein the plurality of options of the cutting command include a half-cutting command for commanding the half-cutting, a connection-cutting command for commanding the connection, and a full-cutting command for commanding the full cutting so that the connection portion is not left behind, said options being selectable in a menu style.

5. The tape printing apparatus according to claim 1, further comprising connecting position selecting means for selecting a widthwise position of the connection portion out of a plurality of options.

6. The tape printing apparatus according to claim 5, wherein said connecting position selecting means includes at least one of means for displaying in characters the options of the cutting positions and means for displaying an image, after cutting, of each of the options of the connecting positions.

7. The tape printing apparatus according to claim 1, wherein said cutting means further comprises a drive motor for driving the normal-direction cutting in one of the normal direction and the reverse direction, which are opposite to each other, and the reverse-direction cutting in the other of the normal direction and the reverse direction, and wherein said control means further comprises a rotation control means for controlling the rotation of said drive motor.

8. A tape printing apparatus comprising:

tape mounting means for mounting a printing tape made up of a base tape having a front printing surface and a rear adhesive surface, and a release tape covering the adhesive surface;

printing means for printing a plurality of print images on the printing surface, said print images being arrayed in a longitudinal direction of the printing tape;

cutting means for cutting the printing tape in a widthwise direction thereof, wherein said cutting means is capable of performing normal-direction cutting in which the printing tape is cut from one end as a reference end as seen in the widthwise direction thereof to an opposite end thereof, and reverse-direction cutting in which the printing tape is cut in a reverse direction from the opposite end to the reference end;

control means for controlling said cutting means, said cutting means being capable of performing connection cutting in which at least a widthwise part of the release tape remains connected as a connection portion, said control means having connection-cutting control means for causing said cutting means to perform connection cutting in a space between each of the plurality of adjoining print images printed on the printing tape;

connecting position selecting means for selecting the widthwise connecting position out of a plurality of options, wherein said options include a reference-end connection for connection at the reference end, an opposite-end connection for connection at the opposite end, and a center connection for connection at a center, wherein said control means comprises:

opposite-end connection-cutting control means for causing said cutting means to perform, when the opposite-end connection is selected, the opposite-end connection cutting which executes the normal-direction cutting so that the connection portion becomes the opposite-end connection;

reference-end connection-cutting control means for causing said cutting means to perform, when said reference-end connection is selected, the reference-end connection cutting which executes the reverse-direction cutting so that the connection portion becomes the reference-end connection;

center connection-cutting control means for causing said cutting means to perform, when the center connection cutting is selected, both the normal-direction cutting and the reverse-direction cutting so that the connection portion becomes the center connection; and cutting control starting means for starting up one of the opposite-end connection-cutting control means, the reference-end connection-cutting control means, and the center connection-cutting control means depending on a result of selection of the connecting position so as to leave the connection portion.

9. A tape printing apparatus comprising:

tape mounting means for mounting a printing tape made up of a base tape having a front printing surface and a rear adhesive surface, and a release tape covering the adhesive surface;

printing means for printing a plurality of print images on the printing surface, said print images being arrayed in a longitudinal direction of the printing tape while leaving a print-free portion which serves as a space between respective adjoining sets of the print images;

cutting means for cutting the printing tape in a widthwise direction thereof and control means for controlling said cutting means, wherein said cutting means comprises: half-cutting means capable of performing widthwise half cutting in which only the base tape is cut; and full-cutting means capable of performing widthwise full cutting in which both the base tape and the release tape are cut and also capable of performing connection cutting in which a widthwise part thereof is left connected as a connection portion, and wherein said control means further comprises complex-cutting control means for causing said cutting means to perform complex cutting which is made up of the connection cutting to substantially a center of the print-free portion and the half cutting to a neighborhood on both longitudinal sides of the connection cutting.

10. The tape printing apparatus according to claim 9, further comprising cutting method selection means for selecting the cutting method in a menu style by said cutting means out of a plurality of options as a cutting command, wherein said plurality of options include a half-cutting command for commanding the half-cutting, a complex-cutting command for commanding the complex cutting, and a full-cutting command for commanding the full cutting so that the connection portion is not left behind.

11. The tape printing apparatus according to claim 9, wherein said full-cutting means is capable of performing a normal-direction cutting in which the printing tape is cut from one end as a reference end as seen in the widthwise direction thereof to an opposite end thereof, and a reverse-direction cutting in which the printing tape is cut in a reverse direction from the opposite end to the reference end.

12. The tape printing apparatus according to claim 11, wherein said full-cutting means further comprises a drive motor for driving the normal-direction cutting in one of the normal direction and the reverse direction, which are opposite to each other, and the reverse-direction cutting in the other of the normal direction and the reverse direction, and wherein said control means further comprises a rotation control means for controlling the rotation of said drive motor.

13. The tape printing apparatus according to claim 11, wherein said full-cutting means comprises:

a cutter capable of performing slide cutting in both the normal direction and the reverse direction;

cutter operating means capable of transferring said cutter among: a first state in which said cutter is away from a feeding passage of the printing tape by said printing means; a second state in which said cutter is located close to the feeding passage but is on a side of the reference end relative to the feeding passage; and a third state in which said cutter is close to the feeding passage but is on a side of the opposite end relative to the feeding passage, wherein said control means causes said cutter to perform, through state transfer control by said cutter operating means, the normal-direction cutting on a way of direct transfer from the second state to the third state, the reverse-direction cutting on a way of direct transfer from the third state to the second state, and a state transfer between the second state and the third state accompanying no cutting due to a state transfer through the first state.

14. The tape printing apparatus according to claim 11, further comprising connecting position selecting means for selecting a widthwise connecting position of the connection portion out of a plurality of options, wherein said options include a reference-end connection for connection at the reference end, an opposite-end connection for connection at the opposite end, and a center connection for connection at a center.

15. The tape printing apparatus according to claim 14, wherein said control means comprises:

opposite-end connection-cutting control means for causing said cutting means to perform, when the opposite-end connection is selected, the opposite-end connection cutting which executes the normal-direction cutting so that the connection portion becomes the opposite-end connection;

reference-end connection-cutting control means for causing said cutting means to perform, when said reference-end connection is selected, the reference-end connection cutting which executes the reverse-direction cutting so that the connection portion becomes the reference-end connection;

center connection-cutting control means for causing said cutting means to perform, when the center connection cutting is selected, both the normal-direction cutting and the reverse-direction cutting so that the connection portion becomes the center connection; and cutting control starting means for starting up one of the opposite-end connection-cutting control means, the reference-end connection-cutting control means, and the center connection control means depending on a result of selection of the connecting position so as to leave the connection portion.

16. A tape printing apparatus in which a plurality of print images arrayed in a longitudinal direction of a printing tape are printed on a front printing surface thereof, said printing tape being made up of a base tape having the front printing surface and a rear adhesive surface, and a release tape covering the adhesive tape, said printed printing tape being cut for each of the print images in a longitudinal direction thereof, said printing apparatus comprising:

half-cutting means capable of performing widthwise half cutting in which only the base tape is cut;

full-cutting means capable of performing widthwise full cutting in which both the base tape and the release tape are cut and also capable of performing connection full-cutting in which a widthwise part thereof is left connected as a connection portion;

cutting method selecting means for selecting a cutting method out of a plurality of options inclusive of a complex cutting made up of the connection full-cutting to a border between respective adjoining sets of the plurality of print images and the half cutting to both longitudinal sides of the border, and a connection cutting which performs both the full cutting and the half cutting to the border; and control means for controlling said half-cutting means and said full-cutting means according to a selected cutting method.

17. The tape printing apparatus according to claim 16, wherein the plurality of print images are printed, when the complex cutting is selected, while leaving a print-free portion in a space inclusive of the border and both longitudinal sides of the border, and wherein said complex cutting is performed on the print-free portion.

18. The tape printing apparatus according to claim 16, wherein said plurality of options include an option to command only the half cutting and an option to command the full cutting so as to leave no connection portion.

19. The tape printing apparatus according to claim 16, wherein said full-cutting means comprises a slide cutter to perform the full cutting by a sliding movement in the widthwise direction, and cutter operating means to cause the slide cutter to perform the sliding movement, wherein said half-cutting means comprises a slide half cutter to perform the half cutting by a sliding movement in the widthwise direction, and half-cutter operating means to cause the slide half cutter to perform the sliding movement, wherein said slide half cutter has a construction identical with said slide cutter whose notch depth is made small, and wherein said half-cutter operating means has a construction identical with said cutter operating means.

20. The tape printing apparatus according to claim 16, further comprising connecting position selecting means for selecting a widthwise position of the connection portion out of a plurality of options.

21. A tape printing apparatus in which a plurality of print images arrayed in a longitudinal direction of a printing tape are printed on a front printing surface thereof, said printing tape being made up of a base tape having the front printing surface and a rear adhesive surface, and a release tape covering the adhesive tape, said printed printing tape being cut for each of the print images in a longitudinal direction thereof, said printing apparatus comprising:

tape width detecting means for detecting a width of the printing tape;

cutting means for cutting the printing tape in a widthwise direction thereof, wherein said cutting means comprises half-cutting means capable of performing widthwise half cutting in which only the base tape is cut;

control means for controlling said cutting means, wherein said cutting means comprises full-cutting means capable of performing widthwise full cutting in which both the base tape and the release tape are cut and also capable of performing connection cutting in which a widthwise part thereof is left connected as a connection portion, wherein said control means further comprises connection notch-cutting control means for controlling said full cutting means so as to perform connection notch-cutting on a border between respective adjoining sets of the plurality of print images; and cutting method selecting means capable of selecting a method of cutting by said cutting means out of a plurality of options, wherein the plurality of options include the connection notch-cutting, and a complex notch-cutting made up of the connection notch-cutting and the half cutting to a neighborhood on both longitudinal sides of the connection notch-cutting.

22. The tape printing apparatus according to claim 21, wherein said control means controls said half-cutting means to perform the half cutting to the connection portion.

23. The tape printing apparatus according to claim 21, wherein a plurality of options in relative notch depths showing a ratio between a total width and the notch depth, in the widthwise direction of the tape, and an absolute notch depth corresponding to a combination of each of the options and each of detectable tape widths, are defined in advance, wherein said control means comprises:

relative notch depth selection means for selecting one of the options in the relative notch depths; and notch depth setting means for setting, corresponding to the detected tape width and the selected relative notch depth, a corresponding absolute notch length as a notch length in the connection notch cutting.

24. The tape printing apparatus according to claim 23, wherein said relative notch length selection means comprises at least one of:

means for displaying in characters the options of the relative cutting depths; and means for displaying an image, after cutting, of each of the options of the relative notch depths.

25. The tape printing apparatus according to claim 21, wherein said full-cutting means comprises:

a slide cutter capable of normal-direction cutting in which cutting is made in a direction from a reference end which is one widthwise end of the printing tape to an opposite end thereof, and of reverse-direction cutting in which cutting is made in a reverse direction from the opposite end to the reference end; and cutter operating means capable of slidably moving said slide cutter in the normal and reverse directions.

26. The tape printing apparatus according to claim 25, further comprising connecting position selecting means for selecting a widthwise position of the connection portion out of a plurality of options, and wherein said options include a reference-end connection for connection at the reference end, an opposite-end connection for connection at the opposite end, and a center connection for connection at a center.

27. The tape printing apparatus according to claim 26, wherein said connecting position selecting means includes at least one of means for displaying in characters the options of the cutting positions and means for displaying an image, after cutting, of each of the options of the connecting positions.

28. A tape printing apparatus as claimed in any one of claims 9, 16 and 21 further comprising a memory medium which stores a program in a manner readable by the tape printing apparatus which is capable of processing program.

29. A method of manufacturing a label, comprising the steps of:

printing a plurality of print images on a printing tape made up of a base tape having a front printing surface and a rear adhesive surface, and a release tape covering the adhesive surface, said print images being arrayed in a longitudinal direction of the printing tape while leaving a print-free portion which serves as a space between respective adjoining sets of the print images;

providing cutting means capable of performing connection cutting by full cutting in which both the base tape and the release tape are cut while leaving a widthwise part thereof connected as a connection portion, as well as of performing half cutting in which only the base tape is cut; and performing complex cutting made up of the connection cutting to substantially the center of the print-free portion and the half cutting to both longitudinal sides thereof.

* * * * *